US011918105B2

(12) United States Patent
Choi

(10) Patent No.: US 11,918,105 B2
(45) Date of Patent: Mar. 5, 2024

(54) PICNIC TABLE WITH DETACHABLE TABLE AND BENCH

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 146 days.

(21) Appl. No.: 17/588,958

(22) Filed: Jan. 31, 2022

(65) Prior Publication Data

US 2022/0240666 A1 Aug. 4, 2022

(30) Foreign Application Priority Data

| | | |
|---|---|---|
| Feb. 3, 2021 | (CN) | 202120313761.8 |
| Mar. 24, 2021 | (CN) | 202120600896.2 |
| Apr. 20, 2021 | (CN) | 202120807399.X |
| Apr. 20, 2021 | (CN) | 202120807432.9 |
| Apr. 20, 2021 | (CN) | 202120813476.2 |
| Apr. 20, 2021 | (CN) | 202120830216.6 |
| Sep. 24, 2021 | (CN) | 202122324614.3 |

(51) Int. Cl.

| | |
|---|---|
| ***A47B 3/14*** | (2006.01) |
| ***A47B 83/02*** | (2006.01) |
| ***A47B 87/00*** | (2006.01) |

(52) U.S. Cl.

CPC ..... *A47B 3/14* (2013.01); *A47B 83/02* (2013.01); *A47B 87/002* (2013.01); *A47B 2003/145* (2013.01)

(58) Field of Classification Search

CPC ..... A47B 3/145; A47B 3/14; A47B 2003/145; A47B 87/002; A47B 3/063; A47B 83/02; A47B 83/021

See application file for complete search history.

(56) References Cited

U.S. PATENT DOCUMENTS

| | | | | |
|---|---|---|---|---|
| 2,875,007 A | | 2/1959 | Fox | |
| 3,027,209 A | | 3/1962 | Nielsen | |
| 3,262,734 A | * | 7/1966 | Kuks | A47B 83/02 297/158.3 |
| 3,276,815 A | | 10/1966 | Ernest | |
| 3,574,393 A | * | 4/1971 | Hughes | A47B 3/14 108/35 |
| 4,330,151 A | | 5/1982 | Healey | |
| 4,974,871 A | | 12/1990 | Mao | |

(Continued)

FOREIGN PATENT DOCUMENTS

| | | |
|---|---|---|
| CN | 208863696 U | 5/2019 |
| CN | 209284468 U | 8/2019 |
| FR | 2807632 | 10/2001 |

*Primary Examiner* — Milton Nelson, Jr.

(74) *Attorney, Agent, or Firm* — MORGAN, LEWIS & BOCKIUS LLP

(57) ABSTRACT

A picnic table includes first and second structures detachably connected to each other by linking assemblies. One of the first and second structures is a table and the other of the first and second structures is a bench. A linking assembly includes a linking member, which has a first end portion connected to the first structure and a second end portion detachably connected to the second structure. When the second end portion is disconnected from the second structure, the linking member is retractable or rotatable toward the first structure.

20 Claims, 45 Drawing Sheets

(56) References Cited

U.S. PATENT DOCUMENTS

| | | | | |
|---|---|---|---|---|
| 5,352,015 | A * | 10/1994 | Morgan | A47B 83/02 297/463.1 |
| 5,414,895 | A | 5/1995 | Kazmark, Jr. | |
| 5,499,426 | A | 3/1996 | Hsieh | |
| 5,921,623 | A | 7/1999 | Nye | |
| 6,047,442 | A | 4/2000 | Workman | |
| 6,186,590 | B1 | 2/2001 | Tseng | |
| 6,247,203 | B1 | 6/2001 | Kuo | |
| 6,347,831 | B1 | 2/2002 | Nye | |
| 6,572,203 | B1 | 6/2003 | Cheng | |
| 6,644,734 | B1 | 11/2003 | Tseng | |
| 6,843,183 | B2 | 1/2005 | Strong | |
| 6,883,864 | B2 | 4/2005 | Gregory | |
| 7,410,194 | B2 | 8/2008 | Chen | |
| 7,735,915 | B2 | 6/2010 | Nye | |
| 8,474,098 | B1 | 7/2013 | Yang | |
| 9,738,295 | B1 | 8/2017 | Horowitz | |
| 10,159,334 | B1 | 12/2018 | Wang | |
| 10,206,496 | B1 | 2/2019 | Miller | |
| 10,470,561 | B2 | 11/2019 | Clegg et al. | |
| D895,345 | S | 9/2020 | Leng | |
| 10,806,247 | B1 | 10/2020 | Chen | |
| 10,806,248 | B1 | 10/2020 | Chen | |
| 11,026,505 | B2 | 6/2021 | Leng | |
| 2004/0070235 | A1 | 4/2004 | Gregory | |
| 2004/0195869 | A1 | 10/2004 | Zhurong | |
| 2004/0227382 | A1 * | 11/2004 | Lin | A47B 83/02 297/158.4 |
| 2006/0181114 | A1 | 8/2006 | Nye | |
| 2008/0018142 | A1 | 1/2008 | Yul | |
| 2012/0175919 | A1 | 7/2012 | Kane | |
| 2017/0340100 | A1 | 11/2017 | Tsai | |
| 2021/0007474 | A1 | 1/2021 | Nye | |
| 2021/0106132 | A1 | 4/2021 | Chen | |
| 2021/0112967 | A1 | 4/2021 | Leng | |
| 2021/0112968 | A1 | 4/2021 | Ponomar | |
| 2021/0169214 | A1 | 6/2021 | Choi | |
| 2021/0177135 | A1 | 6/2021 | Leng | |
| 2021/0274929 | A1 | 9/2021 | Choi | |
| 2021/0274930 | A1 | 9/2021 | Choi | |

* cited by examiner

PICNIC TABLE WITH DETACHABLE TABLE AND BENCH

CROSS-REFERENCE TO RELATED APPLICATIONS

The present application claims priority to Chinese Utility Model Applications CN 202120313761.8 filed Feb. 3, 2021, CN 202120600896.2 filed Mar. 24, 2021, CN 202120813476.2 filed Apr. 20, 2021, CN 202120830216.6 filed Apr. 20, 2021, CN 202120807432.9 filed Apr. 20, 2021, CN 202120807399.X filed Apr. 20, 2021, and CN 202122324614.3 filed Sep. 24, 2021. The disclosure of each application is incorporated herein for all purposes by reference in its entirety.

FIELD OF THE INVENTION

The present invention generally relates to tables and, in particular, to picnic tables with detachable table and bench.

BACKGROUND

A picnic table generally includes a table and one or more benches. However, many existing picnic tables have the table and benches that are fixedly connected to each other. Such existing picnic tables are usually too bulky or heavy for people to carry around, and cannot meet the needs and preferences of various end users. Some existing picnic tables have separate table and benches. But the table and benches are not configured to connect to each other to form an integrated picnic table. Few existing picnic tables have detachable table and benches that can be easily and conveniently connected and separated when desired.

Given the current state of the art, there remains a need for portable picnic tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides picnic tables having detachable table and benches that can be easily and conveniently connected and separated when desired.

In various exemplary embodiments, the present disclosure provides a picnic table including a first structure, a second structure and a pair of second linking assemblies. One of the first and second structures is a table and the other of the first and second structures is a bench. The first structure includes a first panel, and a pair of first leg assemblies coupled with the first panel at first and second sides of the first panel. The second structure includes a second panel, and a pair of second leg assemblies coupled with the second panel at first and second sides of the second panel. The pair of first linking assemblies is configured to detachably connect the pair of first leg assemblies with the pair of second leg assemblies, thereby selectively integrating the first and second structures into a single structure or allowing the first and second structures to be separated from each other. A respective first linking assembly in the pair of first linking assemblies includes a first linking member. A first end portion of the first linking member is connected to a corresponding first leg assembly in the pair of first leg assemblies. A second end portion of the first linking member is configured to be detachably connected to a corresponding second leg assembly in the pair of second leg assemblies. The first linking member is retractable or rotatable toward the corresponding first leg assembly when the second end portion of the first linking member is disconnected from the corresponding second leg assembly.

In some exemplary embodiments, each first leg assembly in the pair of first leg assemblies is foldable with respect to the first panel, and each second leg assembly in the pair of second leg assemblies is foldable with respect to the second panel.

In some exemplary embodiments, the picnic table further includes a third structure and a pair of second linking assemblies. The third structure includes a third panel, and a pair of third leg assemblies coupled with the third panel at first and second sides of the third panel. The pair of second linking assemblies is configured to detachably connect the pair of third leg assemblies with the pair of first or second leg assemblies, thereby selectively integrating the third structure into the single structure or allowing the third structure to be separated from the first or second structure.

In an exemplary embodiment, a respective second linking assembly in the pair of second linking assemblies includes a second linking member. A first end portion of the second linking member is connected to the corresponding first or second leg assembly. A second end portion of the second linking member is configured to be detachably connected to a corresponding third leg assembly in the pair of third leg assemblies. The second linking member is retractable or rotatable towards the corresponding first or second leg assembly when the second end portion of the second linking member is disconnected from the corresponding third leg assembly.

In an alternative exemplary embodiment, a respective second linking assembly in the pair of second linking assemblies includes a second linking member. A first end portion of the second linking member is connected to a corresponding third leg assembly in the pair of third leg assemblies. A second end portion of the second linking member is configured to be detachably connected to the corresponding first or second leg assembly. The second linking member is retractable or rotatable towards the corresponding third leg assembly when the second end portion of the second linking member is disconnected from the corresponding first or second leg assembly.

In an exemplary embodiment, the third structure is a bench.

In an alternative exemplary embodiment, the third structure is a table.

In some exemplary embodiments, each third leg assembly in the pair of third leg assemblies is foldable with respect to the third panel.

In some exemplary embodiments, the corresponding first leg assembly includes a first leg member, and the corresponding second leg assembly includes a second leg member. The respective first linking assembly includes a first coupler and a second coupler. The first coupler pivotally connects the first end portion of the first linking member with the first leg member of the corresponding first leg assembly. The second coupler detachably connects the second end portion of the first linking member with the second leg member of the corresponding second leg assembly.

In an exemplary embodiment, the first leg member is a leg of the first leg assembly, and the second leg member is a leg of the second leg assembly.

In another exemplary embodiment, the first leg member is a leg of the first leg assembly, and the second leg member is a leg lateral bar of the second leg assembly.

In some exemplary embodiments, the second coupler is fixed at the second end portion of the first linking member and includes a mounting port to receive an end portion of the second leg member, thereby detachably coupling the second end portion of the first linking member with the corresponding second leg assembly.

In some exemplary embodiments, the second coupler further includes a pair of lugs extended beyond the mounting port and collectively forming a groove to accommodate at least a portion of the second leg member when the second end portion of the first linking member is connected to the second leg assembly and to accommodate at least a portion of the first leg member or another leg member of the first leg assembly when the second end portion of the first linking member is disconnected from the second leg assembly and the first linking member is rotated toward the first leg assembly.

In an exemplary embodiment, the second coupler further includes a fastener to detachably affix the first or second leg member on a lug in the pair of lugs.

In some exemplary embodiments, the second coupler includes a plurality of ribs formed on at least a portion of a side wall of the mounting port to enhance a strength of the mounting port, and a flange protruded outwardly along at least a portion of an upper edge of the mounting port to enhance the strength of the mounting port or to aid insertion of the end portion of the second leg member.

In some exemplary embodiments, the second coupler includes a shoulder protruded inwardly along at least a portion of a lower edge of the mounting port. A base is disposed at the end portion of the second leg member and formed with a step at a lower portion of the base. The step of the base resides on the shoulder of the second coupler when the end portion of the second leg member is received in the mounting port of the second coupler.

In some exemplary embodiments, at least the end portion of the second leg member is hollow to receive at least a portion of the base, and a hole is formed at a side wall of the end portion of the second leg member. The base includes a body and a pin elastically formed or coupled with the body. The pin is configured to selectively protrude out of the hole formed at the side wall of the end portion of the second leg member, thereby selectively affixing the base with the second leg member.

In some exemplary embodiments, one or more slip-resistant elements are formed on a bottom of the base to increase friction between the base and a ground.

In some exemplary embodiments, at least the second end portion of the first linking member is hollow, and the second coupler is formed with a slot to receive the second end portion.

In an exemplary embodiment, a retainer is disposed at the first leg member to hold the first linking member when it rotates to the corresponding first leg assembly.

In some exemplary embodiments, at least an end portion of the second leg member is hollow to receive the second end portion of the first linking member and a first restriction hole is formed at a side wall of the end portion of the second leg member. At least the second end portion of the first linking member is hollow with a second restriction hole formed at a side wall thereof. The second coupler includes an elastic piece and a pin coupled with the elastic piece. The elastic piece is disposed in the second end portion of the first linking member with the pin positioned at or adjacent to the second restriction hole. When the first and second limitation holes are aligned with each other, the elastic piece pushes the pin to protrude out of the first and second restriction holes, thereby connecting the first linking member with the second leg assembly.

In an exemplary embodiment, a third restriction hole is formed at the first leg member of the first leg assembly at a position corresponding to the second restriction hole. When the first linking member is disconnected from the second leg assembly and rotated to the first leg member of the first leg assembly, the third restriction hole is aligned with the second restriction hole and the elastic piece pushes the pin to protrude out of the second restriction hole and into the third restriction hole, thereby retaining the first linking member on the first leg member of the first leg assembly.

In an exemplary embodiment, a guide is formed or disposed at the end portion of the second leg member to aid insertion of the second end portion of the first linking member into the end portion of the second leg member.

In some exemplary embodiments, at least an end portion of the second leg member is hollow with a first restriction hole formed at a side wall thereof. At least the second end portion of the first linking member is hollow to receive the end portion of the second leg member, and a second restriction hole is formed at a side wall of the second end portion of the first linking member. The second coupler includes an elastic piece and a pin coupled with the elastic piece. The elastic piece is disposed in the end portion of the second leg member with the pin positioned at or adjacent to the second restriction hole. When the first and second limitation holes are aligned with each other, the elastic piece pushes the pin to protrude out of the first and second restriction holes, thereby connecting the first linking member with the second leg assembly.

In an exemplary embodiment, a guide is formed or disposed at the second end portion of the first linking member to aid insertion of the end portion of the second leg member into the second end portion of the first linking member.

In some exemplary embodiments, the first coupler includes a substantially U-shaped first body and a pair of lugs. The substantially U-shaped first body is fixedly connected to the first end portion of the first linking member. The pair of lugs is coupled or formed with the substantially U-shaped first body, and pivotally connected to the first leg member of the corresponding first leg assembly. When the first linking member is unfolded with respect to the first leg member, the first linking member is aligned substantially with the end portion of the first leg member, and the substantially U-shaped first body and the pair of lugs collectively enclose, cross-sectional-wise, a portion of the first leg member.

In an exemplary embodiment, the second leg member is a lateral bar of the corresponding second leg assembly. The second coupler includes a substantially U-shaped second body and a fastener. The substantially U-shaped second body is fixedly connected to the second end portion of the first linking member, and configured to enclose, cross-sectional-wise, a portion of the second leg member. The fastener is coupled with the substantially U-shaped second body, and configured to be inserted into a hole formed at the second leg member, thereby selectively connecting the second end portion of the first linking member with the second leg member of the corresponding second leg assembly.

In another exemplary embodiment, the second leg member is a leg of the corresponding second leg assembly. The second coupler includes a fastener selectively connecting the second end portion of the first linking member with the second leg member of the corresponding second leg assembly through a hole formed at the second end portion of the first linking member and a hole formed at the second leg member.

In some exemplary embodiments, a stopper is disposed at the first end portion of the first linking member. The stopper includes a first surface and a second surface. The first surface is configured to abut the first leg member when the first linking member is unfolded with respect to the first leg member, thereby aligning the first linking member to facilitate connecting the second end portion of the first linking member with the second leg member The second surface is configured to abut the first leg member when the first linking member is folded with respect to the first leg member, thereby preventing the first linking member from rotating beyond the first leg member.

In an exemplary embodiment, the first and second surfaces are substantially perpendicular to each other.

In an exemplary embodiment, a through hole is formed at the second leg member. The second coupler includes a bolt and a nut. The bolt is fixed at the second end portion of the first linking member, and configured to pass through a hole formed at the second leg member and coupled with the nut.

In some exemplary embodiments, the corresponding first leg assembly includes a first leg member that is a lateral bar of the corresponding first leg assembly. The corresponding second leg assembly includes a second leg member. The first linking member of the respective first linking assembly is telescopically coupled with the first leg member. The second end portion of the first linking member is detachably connected to the second leg member.

In some exemplary embodiments, at least a portion of the lateral bar is hollow, and the first end portion of the first linking member is inserted into the lateral bar.

In an exemplary embodiment, a first restriction hole is formed at a side wall of the first leg member. At least the first end portion of the first linking member is hollow with a second restriction hole formed at a side wall thereof Δn elastic piece is disposed in the first end portion of the first linking member. A pin is coupled with the elastic piece and positioned at or adjacent to the second restriction hole. When the first and second limitation holes are aligned with each other, the elastic piece pushes the pin to protrude out of the first and second restriction holes, thereby locking the first linking member with the first leg assembly.

In some exemplary embodiments, an engaging hole is formed at the second end portion of the first linking member to selectively engage with a fastener disclosed at the second leg member, thereby selectively connecting the second end portion of the first linking member with the second leg member of the corresponding second leg assembly.

In an exemplary embodiment, the engaging hole is formed at a connecting piece coupled with the second end portion of the first linking member.

In an exemplary embodiment, a base is disposed at the end portion of the second leg member, and includes a hole or thread to allow the fastener to pass through.

In some exemplary embodiments, a first coupling piece is disposed at the second end portion of the first linking member, and a second coupling piece is disposed at the second leg member and configured to selectively engage with the first coupling piece.

In some exemplary embodiments, the second coupling piece includes a slot and the first coupling piece includes a rib to be inserted into the slot.

In an exemplary embodiment, one or more side walls of the slot of the second coupling piece are hook-shaped, and one or more sides of the rib of the first coupling piece are indented to mate with the one or more hook-shaped side walls of the slot of the second coupling piece.

In various exemplary embodiments, the present invention provides a frame assembly including a first frame, a second frame, and a plurality of first linking assemblies. The first frame includes a first mounting assembly and a pair of first leg assemblies coupled with the first mounting assembly at first and second sides of the first mounting assembly. The second frame includes a second mounting assembly and a pair of second leg assemblies coupled with the second mounting assembly at first and second sides of the second mounting assembly. The pair of first linking assemblies is configured to detachably connect the pair of first leg assemblies with the pair of second leg assemblies, thereby selectively integrating the first and second frames into a single frame or allowing the first and second frames to be separated from each other. A respective first linking assembly in the pair of first linking assemblies includes a first linking member. A first end portion of the first linking member is connected to a corresponding first leg assembly in the pair of first leg assemblies. A second end portion of the first linking member is configured to be detachably connected to a corresponding second leg assembly in the pair of second leg assemblies. The first linking member is retractable or rotatable towards the corresponding first leg assembly when the second end portion of the first linking member is disconnected from the corresponding second leg assembly.

In some exemplary embodiments, the first mounting assembly is configured to couple with a first panel and the second mounting assembly is configured to couple with a second panel.

In an exemplary embodiment, the first panel is a table panel and the second panel is a bench panel.

In another exemplary embodiment, the first panel is a bench panel and the second panel is a table panel.

In still another exemplary embodiment, each of the first and second panels is a bench or table panel.

In some exemplary embodiments, each first leg assembly in the pair of first leg assemblies is foldable with respect to the first panel, and each second leg assembly in the pair of second leg assemblies is foldable with respect to the second panel.

In some exemplary embodiments, the frame assembly further includes a third frame and a pair of second linking assemblies. The third frame includes a third mounting assembly and a pair of third leg assemblies coupled with the third mounting assembly at first and second sides of the third mounting assembly. The pair of second linking assemblies is configured to detachably connect the pair of third leg assemblies with the pair of first or second leg assemblies, thereby selectively integrating the third frame into the single frame or allowing the third frame to be separated from the first or second frame.

In some exemplary embodiments, the third mounting assembly is configured to couple with a table or bench panel.

The frames and picnic tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
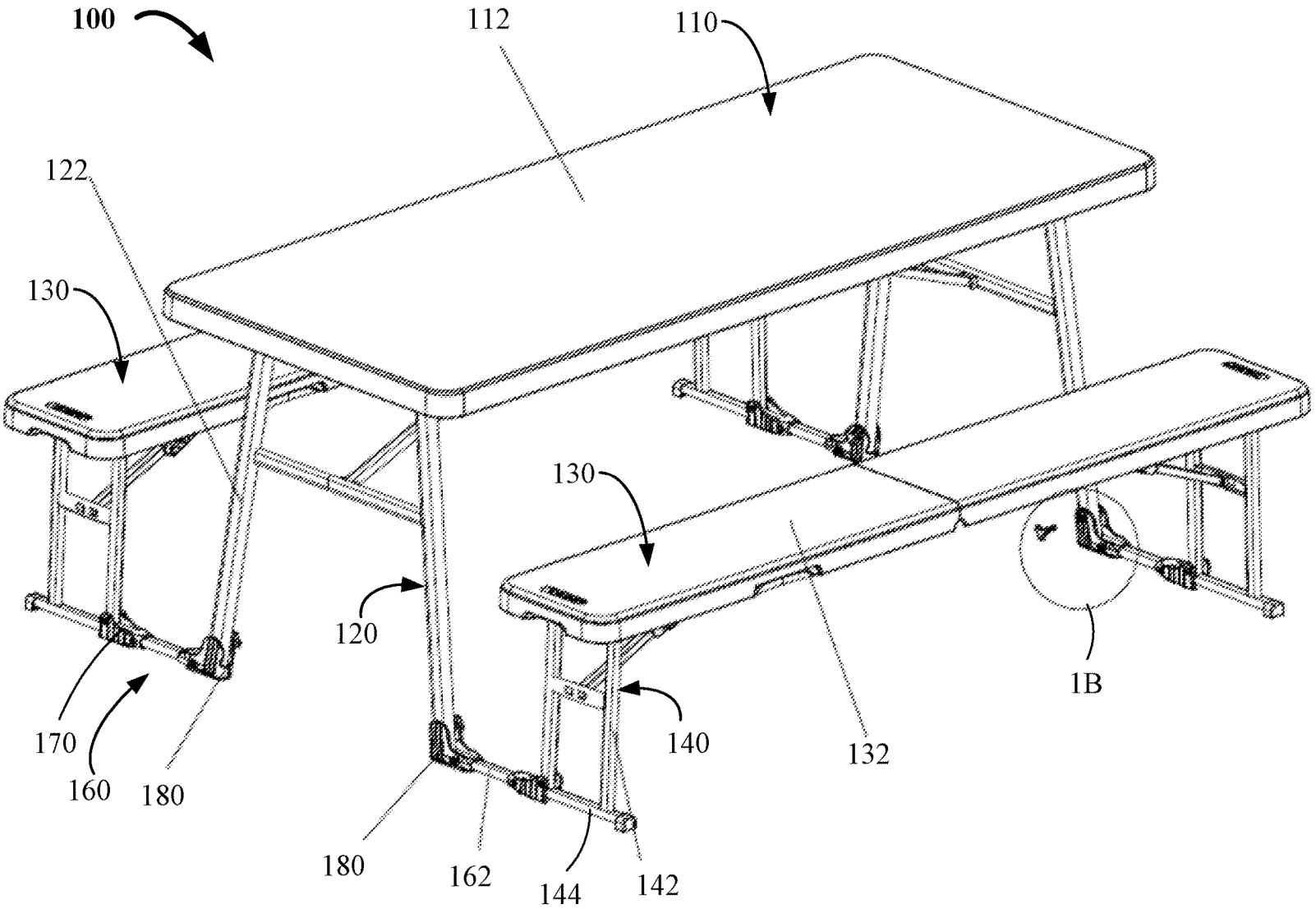
FIG. 1A is a top perspective view illustrating an exemplary picnic table in which the table and benches are connected to each other in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of picnic tables. A picnic table generally includes two or more structures detachably connected to each other by linking assemblies. A structure can be a table, a bench or the like, and generally includes a panel and a pair of leg assemblies coupled with the panel. A linking assembly generally includes a linking member. The linking member has an end portion connected to a leg assembly of one structure, and another end portion configured to be detachably connected to a leg assembly of another structure. For instance, in an exemplary embodiment, the linking member has an end portion connected to a leg assembly of a table and another end portion configured to be detachably connected to a leg assembly of a bench. In another exemplary embodiment, the linking member has an end portion connected to a leg assembly of a bench and another end portion configured to be detachably connected to a leg assembly of a table. When disconnected from the leg assembly of another structure, the linking member is retractable or rotatable toward the leg assembly of the one structure.

The detachable connection can be achieved by various means, such as snap fit, press fit, hook and loop fasteners (e.g., Velco connection), magnetic connection, bolts and nuts, screws, or the like. When connected, the two or more structures form an integrated single structure (e.g., a picnic table). When separated, each structure can be used alone. In some exemplary embodiments, when separated, each structure is foldable, e.g., the leg assemblies are foldable toward the panel or foldable in half, thus making it easy to carry around. In addition, when folded, one structure (e.g., bench) can be stacked on top of another structure (e.g., table or bench). Thus, when folded and stacked, the picnic table is compact with a generally layered block-like shape, making it easy and convenient for storage and transportation.

The panel of a structure (e.g., table panel, bench panel) disclosed herein can be of various shapes including but not limited to a square shape, a round shape or a rectangular shape, and can be made of various materials including but not limited to metals, plastics and woods. In some exemplary embodiments, the table panel, the bench panel or both are made of plastics by injection molding, blow molding or any other suitable processes. The leg assemblies of the present disclosure can be made of various materials including but not limited to metals (e.g., iron, steel, and aluminum) and plastics.

Referring now to FIGS. 1A-1J, there is depicted exemplary picnic table 100 in accordance with some embodiments of the present disclosure. As shown, picnic table 100 includes a table, such as table 110, and a pair of benches, such as bench 130. The two benches can be but do not have to be identical or symmetric to each other. By way of example, the two benches are illustrated to be substantially the same and symmetric to each other. In addition, while a table and two benches are illustrated, it should be noted that a picnic table can include different numbers of tables and benches. For instance, a picnic table can include a single table and a single bench, two tables with a single bench, two tables with two benches, or the like.

Table 110 includes a table panel, such as table panel 112, and a pair of table leg assemblies, such as table leg assembly 120. The pair of table leg assemblies is coupled with the table panel, for instance, through a table mounting assembly, such as mounting assembly 114. The table leg assemblies and table mounting assembly, along with other additional, optional or alternative components, are collectively referred to as a table frame. One of the table leg assembly is disposed at one side of the table panel and the other of the table leg assembly is disposed at another side of the table panel. In some exemplary embodiments, table leg assembly 120 includes one or more table leg members, such as table leg 122.

Figure 1B:
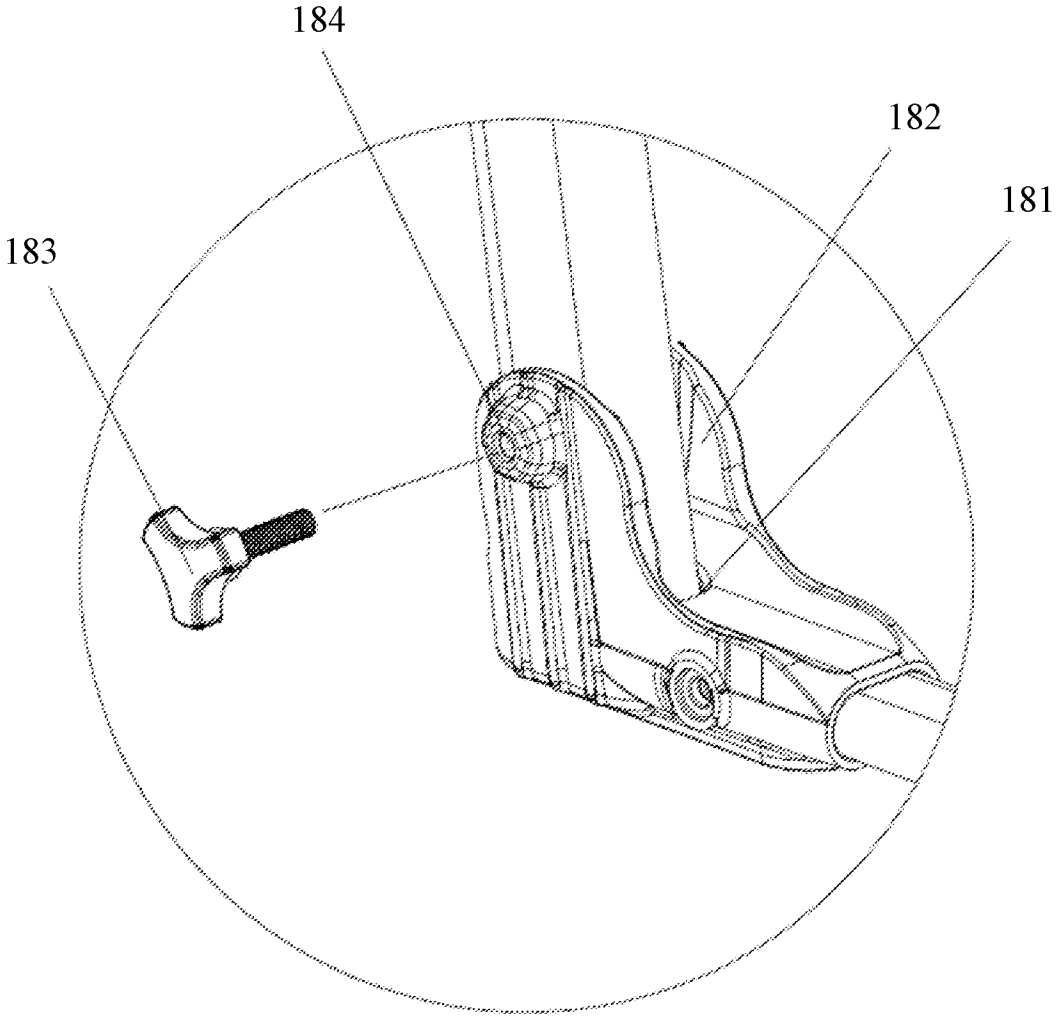
FIG. 1B is an enlarged view taken along circle 1B of FIG. 1A.
Figure 1C:
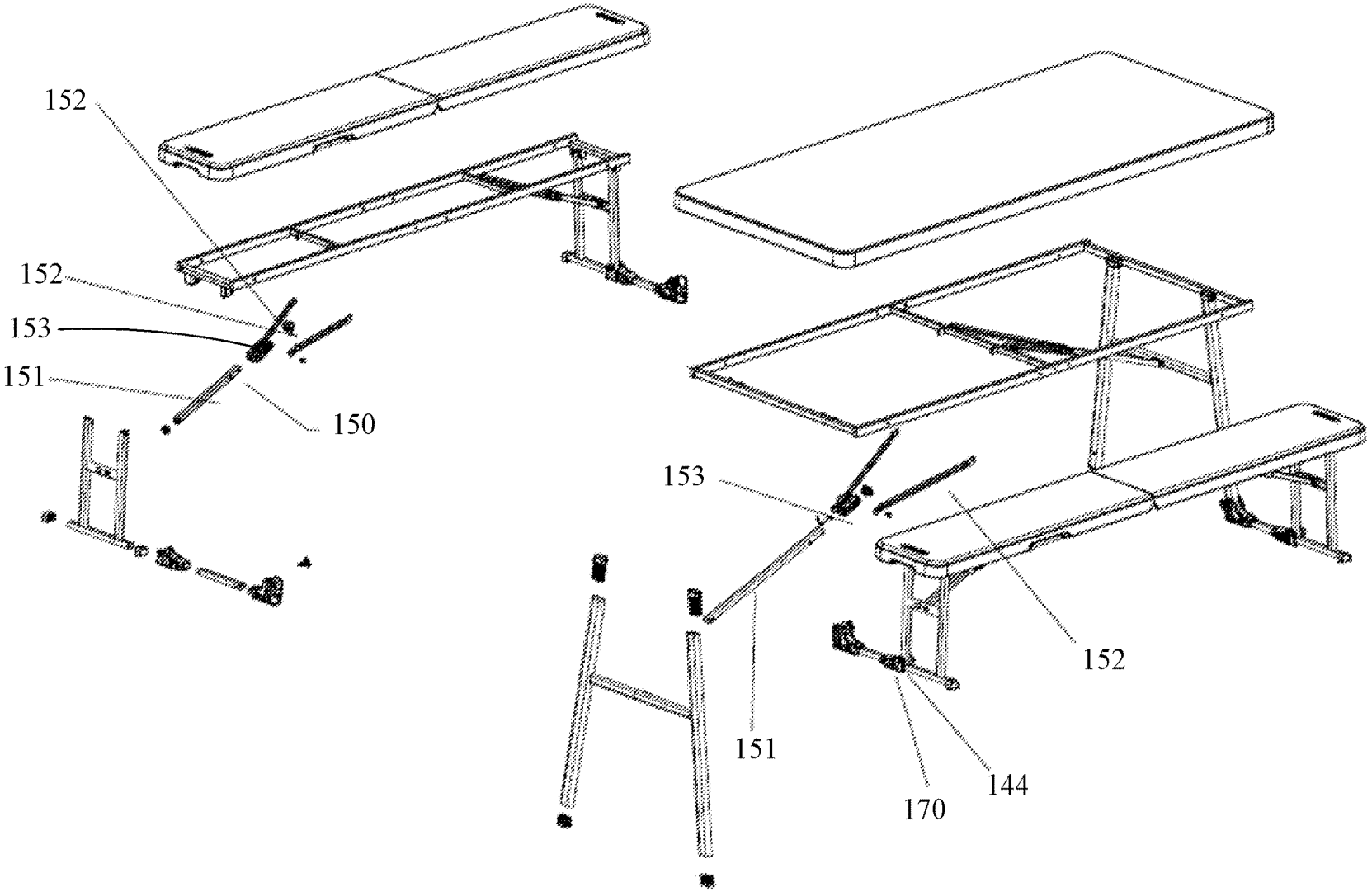
FIG. 1C is a partially dissembled view illustrating the exemplary picnic table of FIG. 1A in accordance with exemplary embodiments of the present disclosure.
Figure 1D:
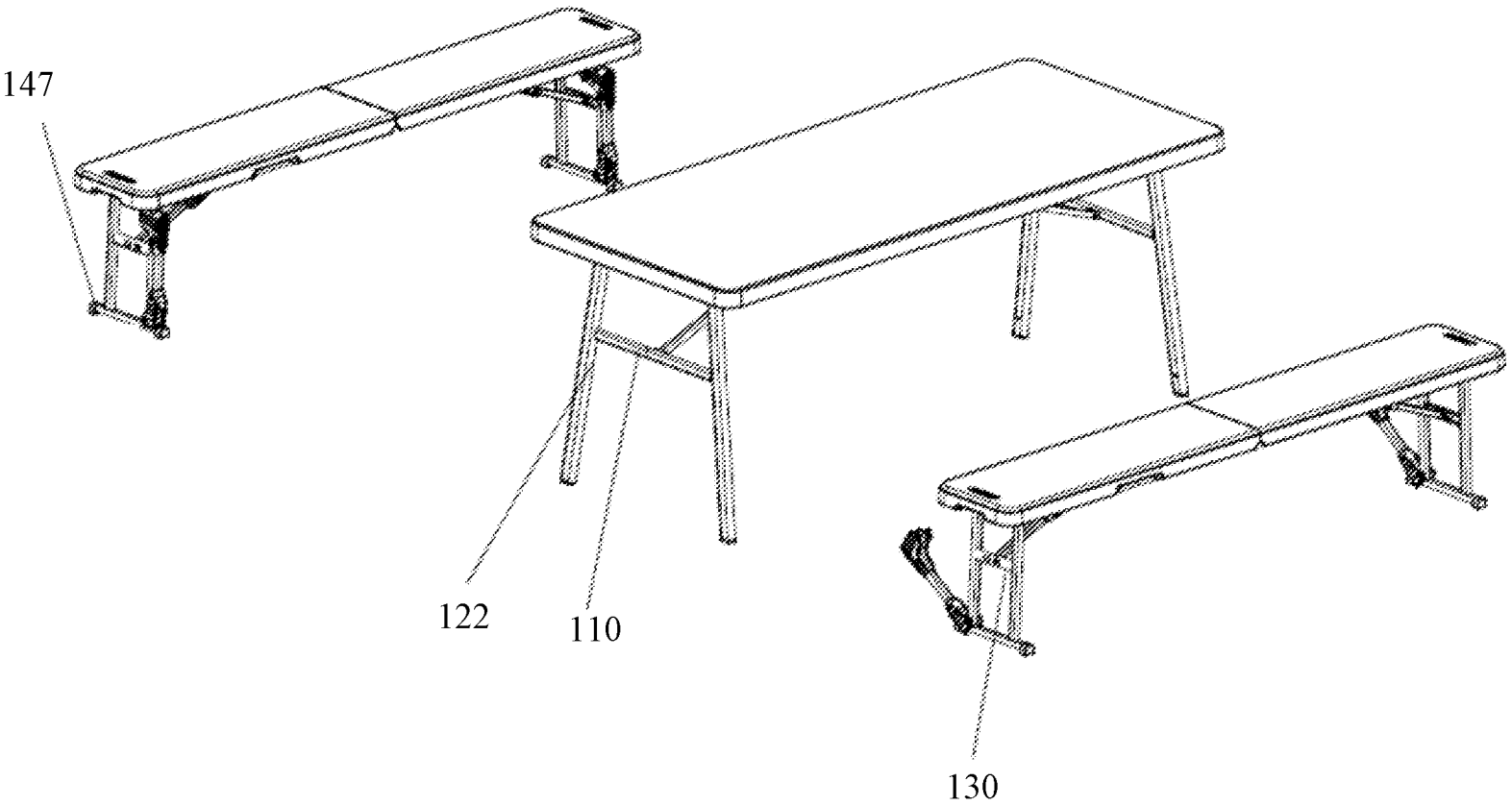
FIG. 1D is a top perspective view illustrating the exemplary picnic table of FIG. 1A in which the table and benches are separated from each other in accordance with exemplary embodiments of the present disclosure.
Figure 1E:
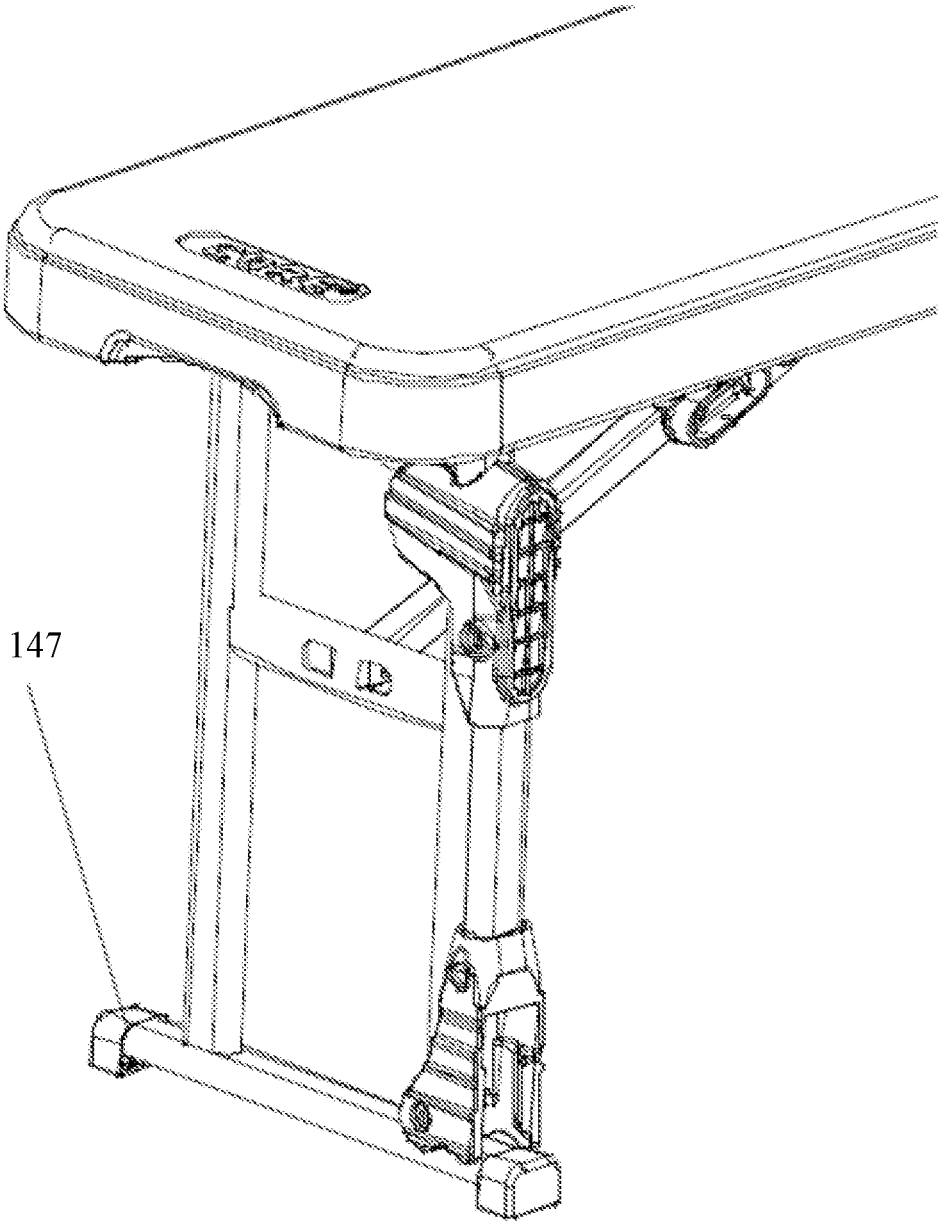
FIG. 1E is a partially enlarged view of FIG. 1D.
Figure 1F:
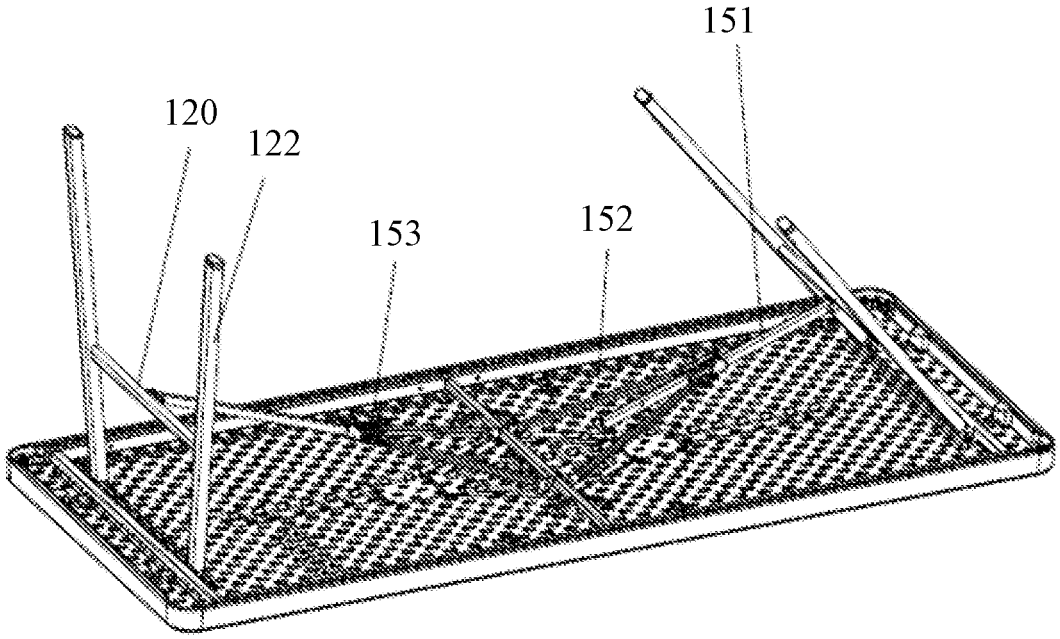
FIG. 1F is a bottom perspective view illustrating an exemplary table in a partially folded state in accordance with exemplary embodiments of the present disclosure.
Figure 1G:
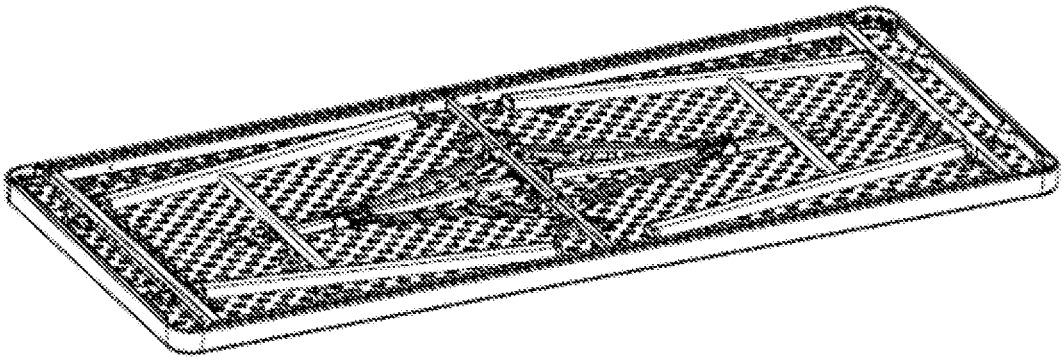
FIG. 1G is a bottom perspective view illustrating an exemplary table in a folded state in accordance with exemplary embodiments of the present disclosure.

In some exemplary embodiments, each table leg assembly is rotatable with respect to the table panel between a use position and a storage position as illustrated in FIGS. 1F and 1G. When in the storage position, the table leg assembly is folded onto the table panel. In some exemplary embodiments, to control rotation of the table leg assemblies, table 110 includes a pair of table supporting assemblies, such as supporting assembly 150. Supporting assembly 150 includes a first supporting member, such as first supporting member 151, at least one second supporting member, such as second supporting member 152, and a sliding mechanism, such as sliding mechanism 153. Examples of sliding mechanisms are disposed in U.S. patent application Ser. No. 16/838,939 (now U.S. Pat. No. 10,863,819 B1), U.S. patent application Ser. No. 16/951,461, and U.S. patent application Ser. No. 17/368,284, the disclosure of each application is incorporated herein for all purposes by reference in its entirety. One end portion of the first supporting member of the table supporting assembly is pivotally coupled with table leg assembly 120. One end of each second supporting member is coupled with the first supporting member, for instance, through the sliding mechanism. The other end of the second supporting member of the table supporting assembly is pivotally coupled with the table mounting assembly. In such embodiments, the table leg assemblies, table mounting assembly and table supporting assemblies, along with other additional, optional or alternative components, are collectively referred to as a table frame.

Bench 130 includes a bench panel, such as bench panel 132, and a pair of bench leg assemblies such as, bench leg assembly 140. The pair of bench leg assemblies is coupled with the bench panel, for instance, through a bench mounting assembly, such as mounting assembly 134. The bench leg assemblies and bench mounting assembly, along with other additional, optional or alternative components, are collectively referred to as a bench frame. One of the bench leg assembly is disposed at one side of the bench panel and the other of the bench leg assembly is disposed at another side of the bench panel. In some exemplary embodiments, bench leg assembly 140 includes one or more bench leg members, such as bench leg 142 and/or bench leg lateral bar 144. Preferably, the bench leg lateral bar is disposed at a lower end portion of the bench leg. In some exemplary embodiments, one or more bases, such as base 147, are disposed at the bench leg lateral bar to increase slip resistance and/or help stabilize the bench.

Figure 1H:
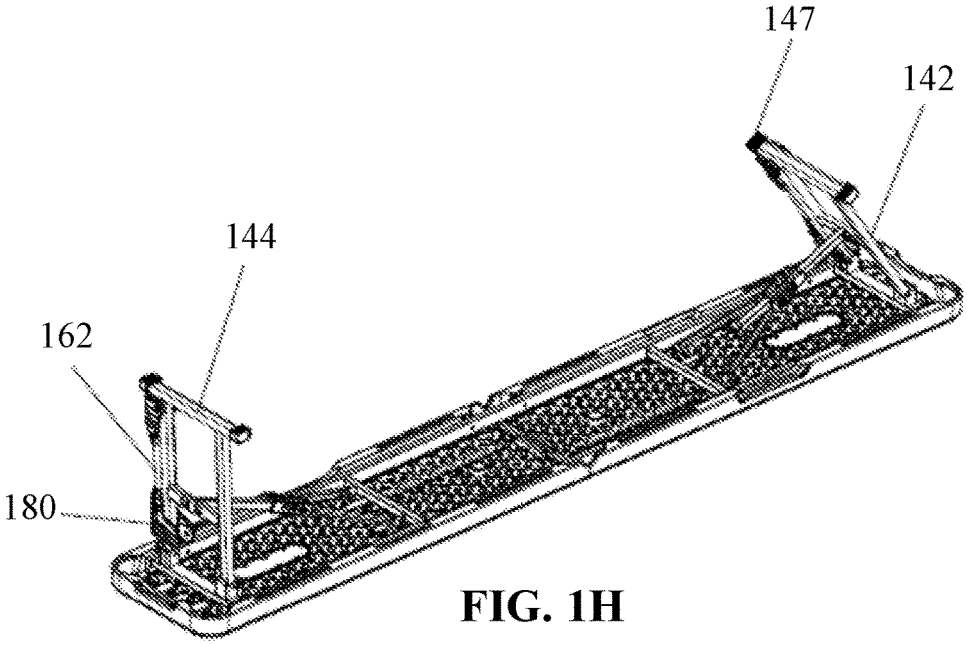
FIG. 1H is a bottom perspective view illustrating an exemplary bench in a partially folded state in accordance with exemplary embodiments of the present disclosure.
Figure 1I:
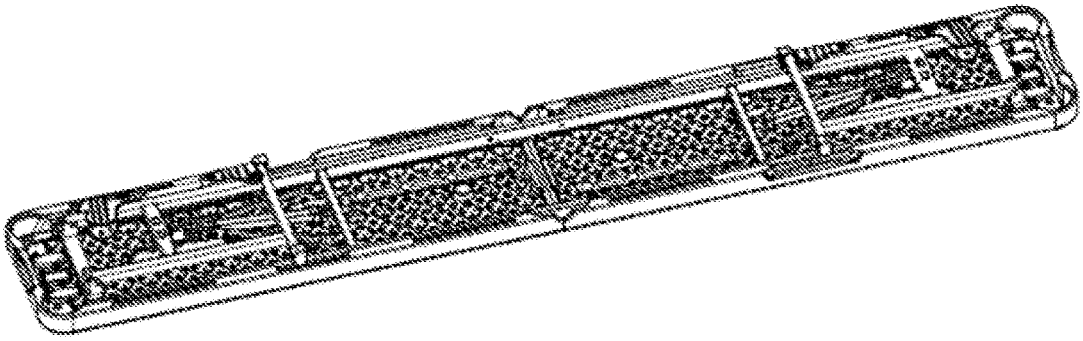
FIG. 1I is a bottom perspective view illustrating an exemplary bench in a folded state in accordance with exemplary embodiments of the present disclosure.

In some exemplary embodiments, each bench leg assembly is rotatable with respect to the bench panel between a use position and a storage position as illustrated in FIGS. 1H and 1I. When in the storage position, the bench leg assembly is folded onto the bench panel. In some exemplary embodiments, to control rotation of the bench leg assemblies, bench 130 includes a pair of bench supporting assemblies, which can be configured conceptually the same as the table supporting assembly or differently from the table supporting assembly. While the same reference numeral is used for both of the table and bench supporting assemblies, it should be noted that table and bench supporting assemblies may have different sizes, e.g., the first and/or second supporting members of table and bench supporting assemblies may have different lengths, different widths, different angles, or the like.

Similar to the table supporting assembly, one end portion of the first supporting member of the bench supporting assembly is pivotally coupled with bench leg assembly 140. One end of each second supporting member is coupled with the first supporting member, for instance, through the sliding mechanism. The other end of the second supporting member of the bench supporting assembly is pivotally coupled with the bench mounting assembly. In such embodiments, the bench leg assemblies, bench mounting assembly and bench supporting assemblies, along with other additional, optional or alternative components, are collectively referred to as a bench frame.

To detachably connect table 110 with each of the two benches, picnic table 100 includes a pair of linking assemblies. It should be noted that the pair of linking assemblies detachably connecting the table with one bench can be the same as or different from the pair of linking assemblies detachably connecting the table with another bench. By way of example, linking assembly 160 is used to detachably connect the table with both of the benches. It should also be noted that one linking assembly can be but do not have to be identical to the other linking assembly in the same pair.

Linking assembly 160 includes a linking member, such as linking member 162. In some exemplary embodiments, the linking member is elongated, and has a first end portion connected to one of the table and bench leg assemblies, and a second end portion configured to be detachably connected to the other of the table and bench leg assemblies. In some exemplary embodiments, the first end portion of the linking member is connected to one of the table and bench leg assemblies by a first coupler and the second end portion of the linking member is configured to be detachably connected to the other of the table and bench leg assemblies by a second coupler.

For instance, as a non-limiting example, it is illustrated that the first end portion of linking member 162 is connected to bench leg assembly 140, e.g., bench leg 142 and/or bench leg lateral bar 144 of the bench leg assembly, and the second end portion of linking member 162 is configured to be detachably connected to table leg assembly 120, e.g., table leg 122 of the table leg assembly. As such, when the second end portion of the linking member is not connected to the table leg assembly, the bench leg assembly is not engaged with the table leg assembly. When the pair of the bench leg assemblies of one bench is not connected to the pair of the table leg assemblies, the table and one bench are separated and independent from each other, and thus can be used alone or packed individually or the like. Similar, when the pair of the bench leg assemblies of one bench and the pair of the bench leg assemblies of another bench are not connected to the pair of the table leg assemblies, the table and each of the two benches are separated and independent from each other, as illustrated in FIG. 1D.

In some exemplary embodiments, the first end portion of linking member 162 is pivotally connected to bench leg 142 of the bench leg assembly by a coupler, such as coupler 170. For instance, in an exemplary embodiment, coupler 170 is fixed at the first end portion of linking member 162 and pivotally coupled with bench leg 142 of the bench leg assembly, or vice versa. As such, when the second end portion of the linking member is disconnected from the table leg assembly, linking member 162 can be rotated toward the bench leg assembly, e.g., toward bench leg 142 of the bench leg assembly, as illustrated in FIG. 1D.

Figure 1J:
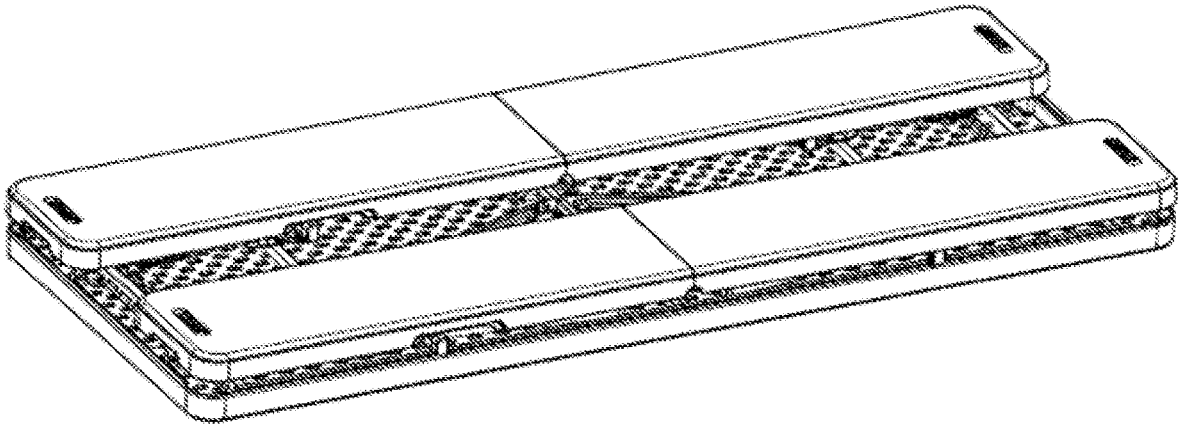
FIG. 1J is a perspective view illustrating an exemplary picnic table in which the benches are stacked on top of the table in accordance with exemplary embodiments of the present disclosure.
Figure 2A:
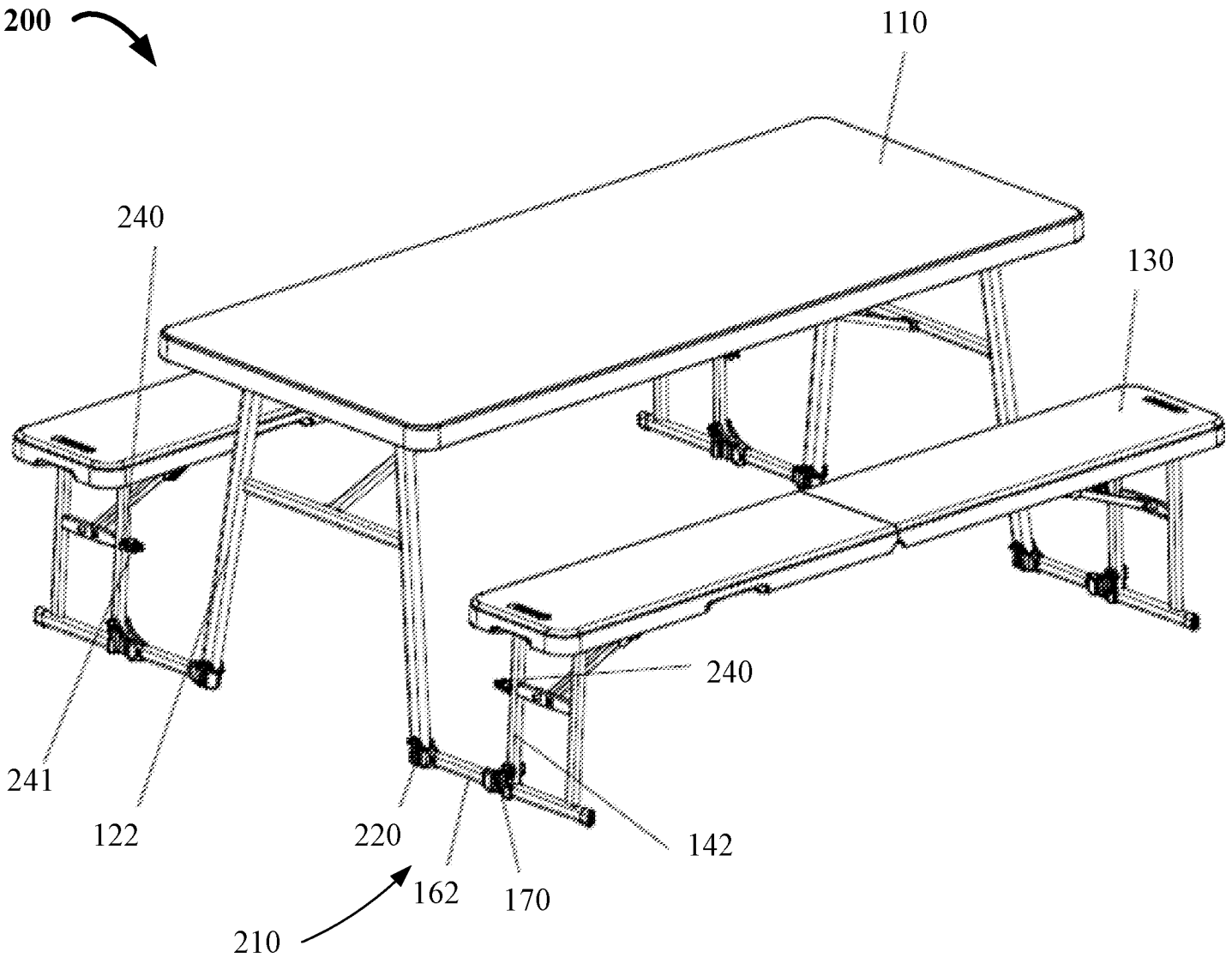
FIG. 2A is a top perspective view illustrating an exemplary picnic table in which the table and benches are connected to each other in accordance with exemplary embodiments of the present disclosure.
Figure 2B:
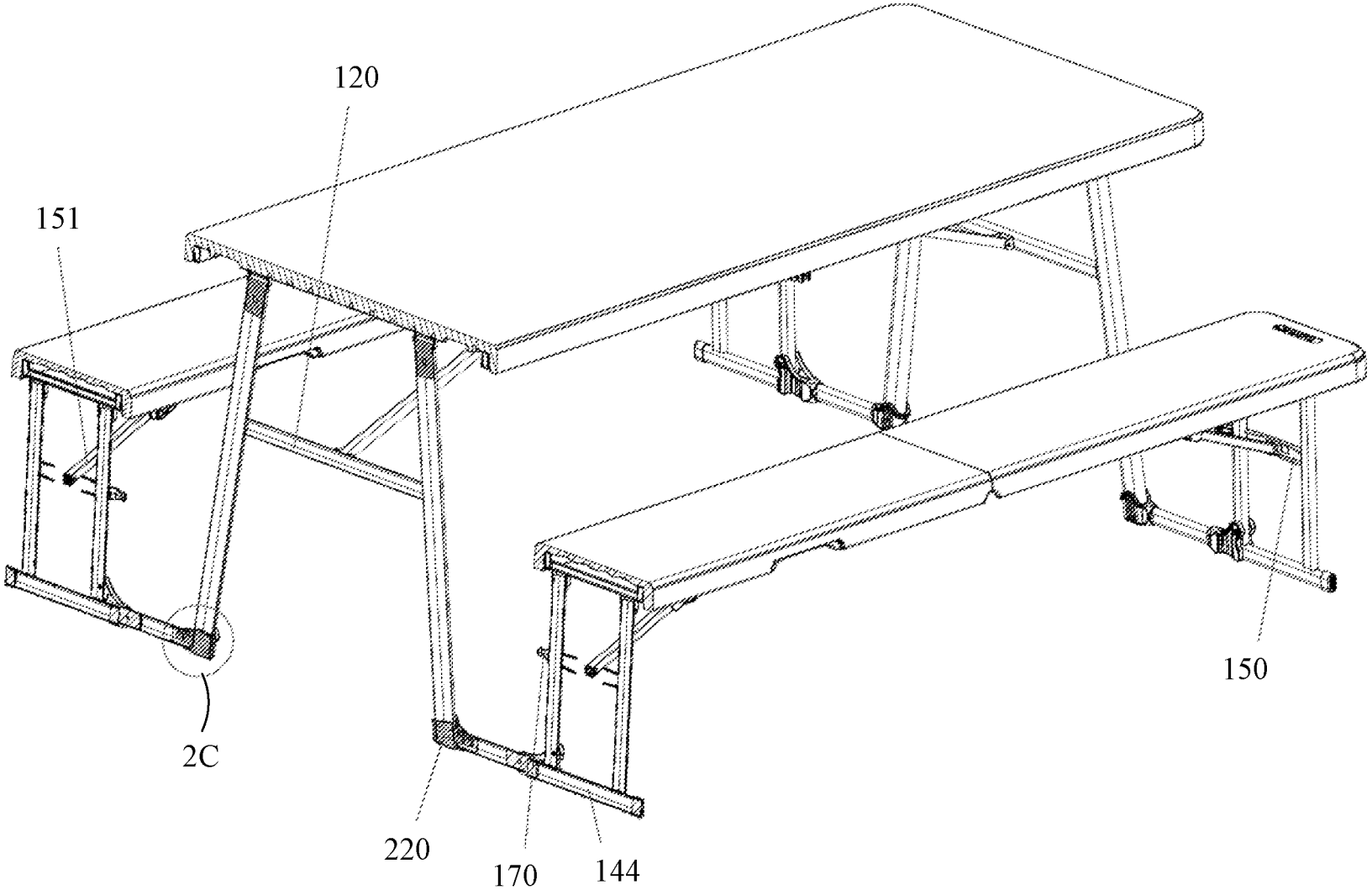
FIG. 2B is a partially cut-out view illustrating the exemplary picnic table of FIG. 2A in accordance with exemplary embodiments of the present disclosure.
Figure 2C:
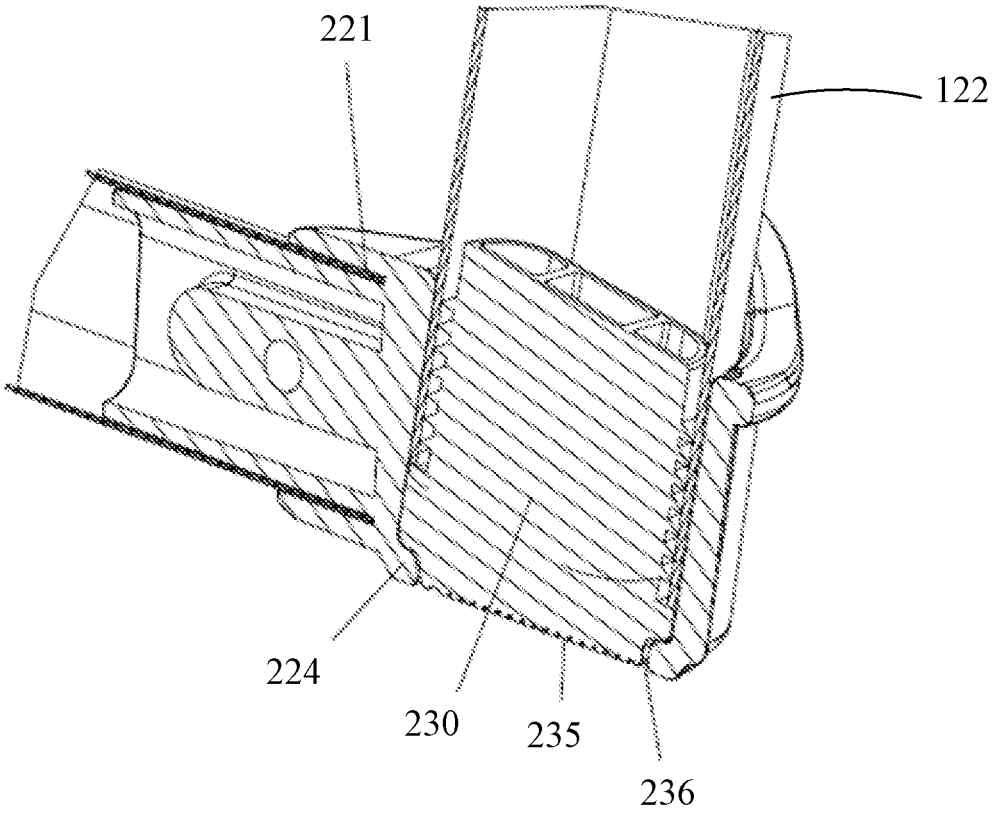
FIG. 2C is an enlarged view taken along circle 2C of FIG. 2B.
Figure 2D:
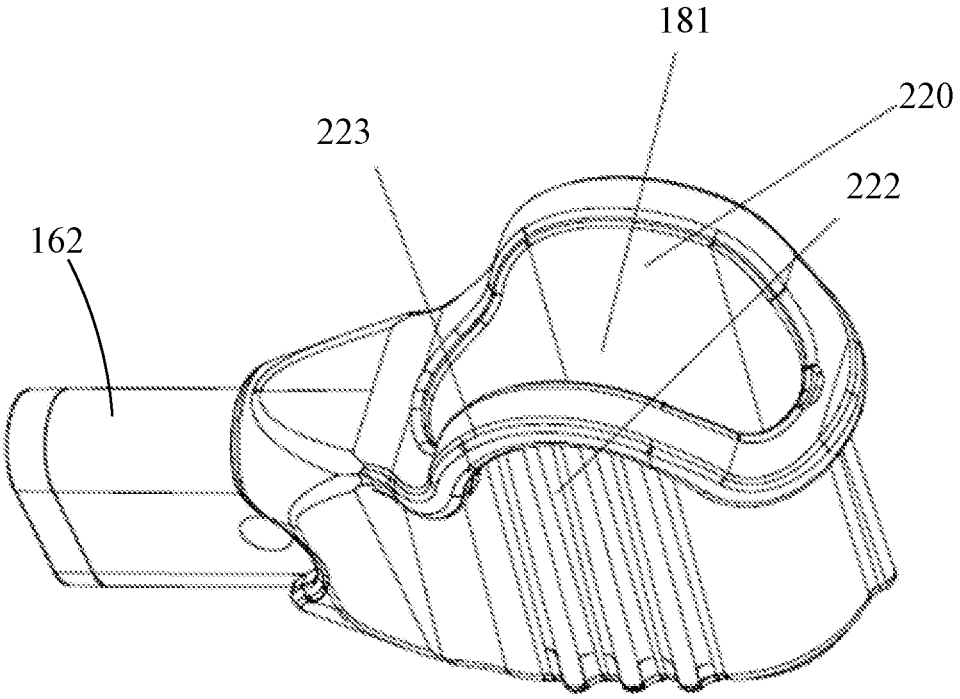
FIG. 2D is a perspective view illustrating an exemplary coupler in accordance with exemplary embodiments of the present disclosure.
Figure 2E:
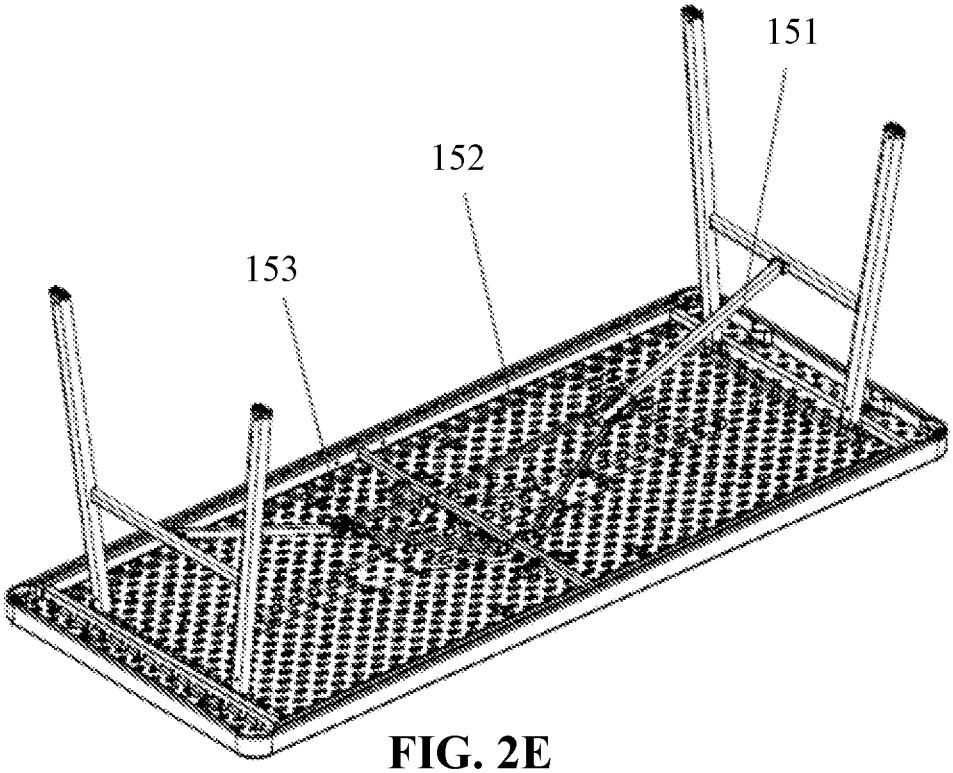
FIG. 2E is a bottom perspective view illustrating an exemplary table in an unfolded state in accordance with exemplary embodiments of the present disclosure.
Figure 2F:
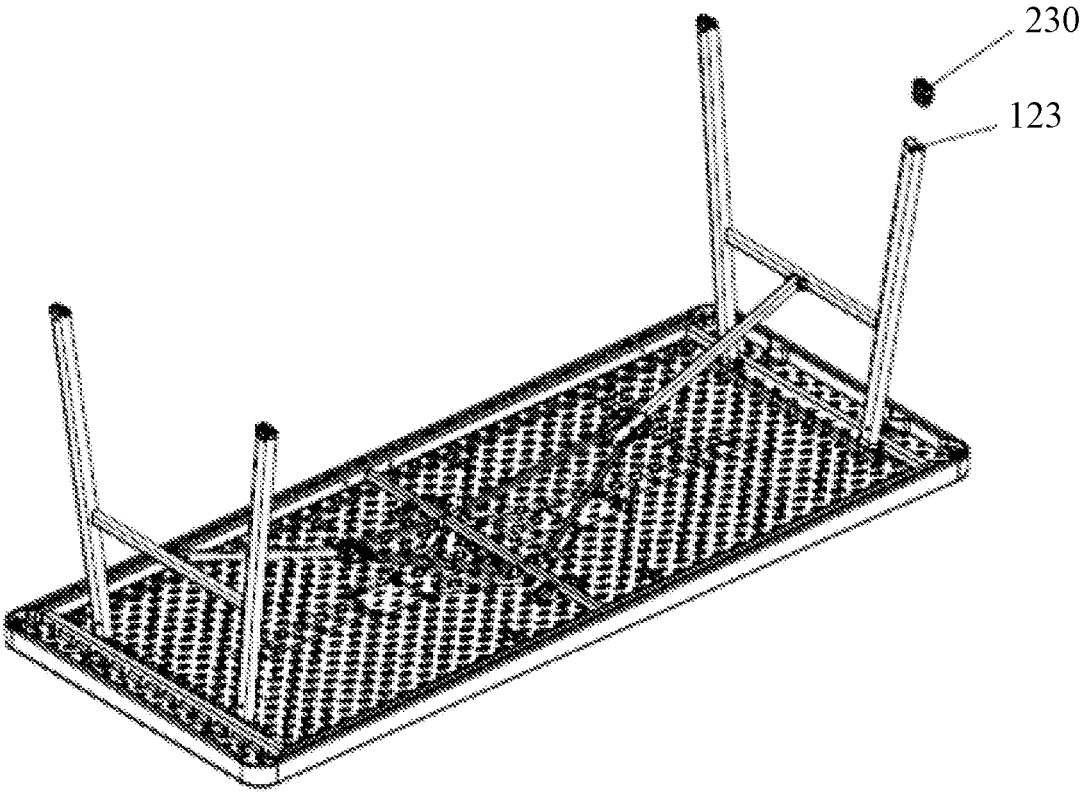
FIG. 2F is a partially dissembled view illustrating an exemplary table in accordance with exemplary embodiments of the present disclosure.
Figure 2G:
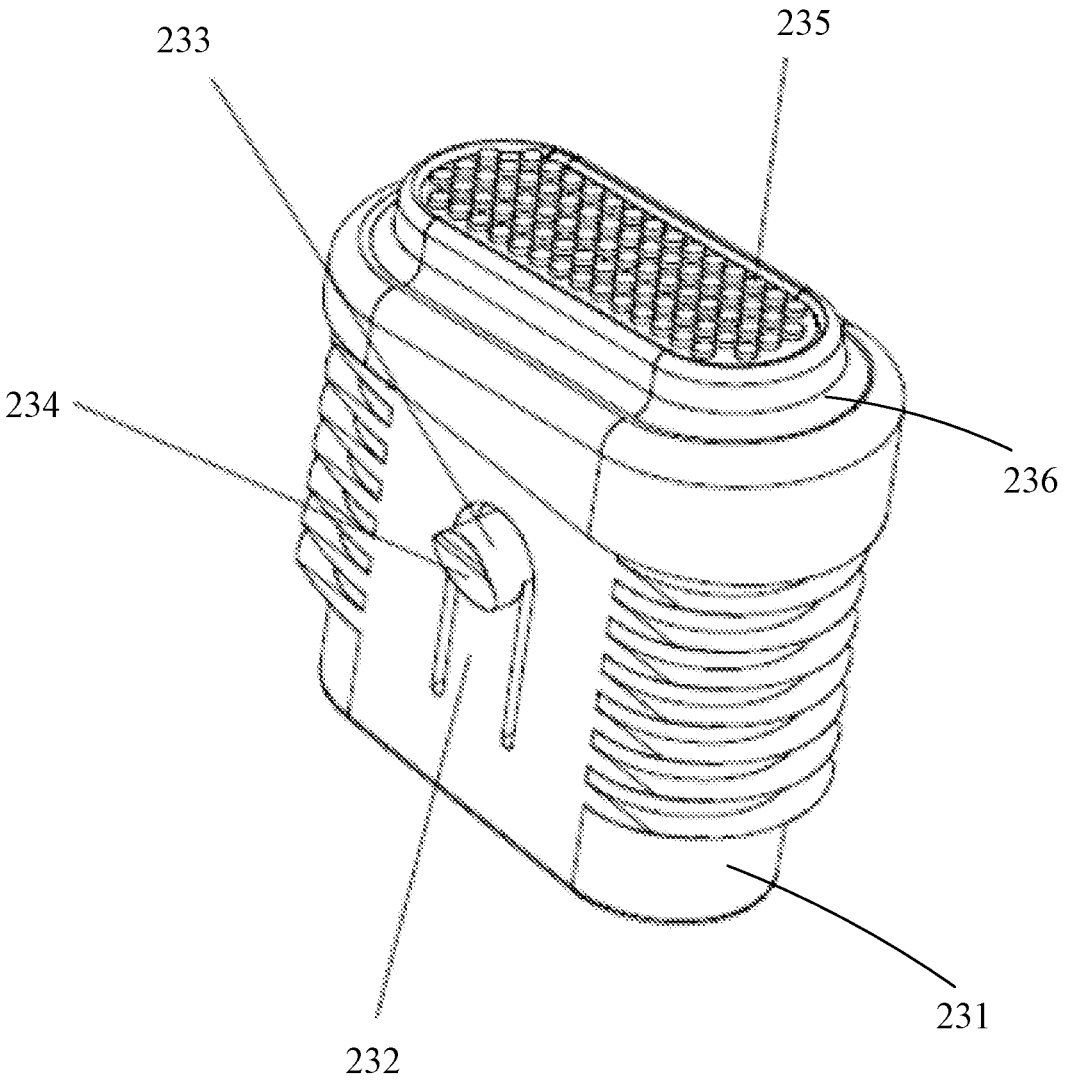
FIG. 2G is a perspective view illustrating an exemplary base in accordance with exemplary embodiments of the present disclosure.

In some exemplary embodiments, after detached, the pair of table leg assemblies can be folded onto the table panel as illustrated in FIG. 1G, and the pair of bench leg assemblies of one bench can be folded onto the bench panel as illustrated in FIG. 1I. The folded table or bench can be carried or stored seperably. The folded table and one or more benches can also be packed or stacked together, such as placing one or more folded benches on top of the folded stable, as illustrated in FIG. 1J.

When the second end portion of the linking member is connected to the table leg assembly, the bench leg assembly is connected to the table leg assembly. When the pair of the bench leg assemblies of one bench is connected to the pair of the table leg assemblies, the table and one bench are consolidated and integrated into one single structure, e.g., resulting in a picnic table or the like that has one table and one bench. Similar, when the pair of the bench leg assemblies of one bench and the pair of the bench leg assemblies of another bench are connected to the pair of the table leg assemblies, the table and two benches are consolidated and integrated into one single structure, e.g., resulting in a picnic table or the like that has one table and two bench, as illustrated in FIG. 1A.

In some exemplary embodiments, the second end portion of linking member 162 is detachably connected to table leg 122 of the table leg assembly by a second coupler, such as coupler 180. In some exemplary embodiments, coupler 180 is fixed at the second end portion of linking member 162, for instance, formed with or fixedly coupled with the second end portion of linking member 162.

Referring in particular to FIGS. 1B and 1E, coupler 180 includes a mounting port, such as mounting port 181, configured to receive an end portion of table leg 122 of the table leg assembly. In some exemplary embodiments, coupler 180 also includes a pair of lugs, such as lug 182, each extended beyond the mounting port. The pair of lugs collectively forms a groove to accommodate at least a portion of table leg 122 when the second end portion of linking member 162 is connected to the table leg assembly (e.g., when the end portion of table leg 122 is inserted into mounting port 181). In some exemplary embodiments, once the end portion of table leg 122 is inserted into mounting port 181, a fastener, such as fastener 183, is used to detachably affix table leg 122 on one lug 182 or on the pair of lugs, for instance, via through hole 184. When the second end portion of linking member 162 is disconnected from the table leg assembly and the linking member is rotated toward the bench leg assembly, the groove collectively formed by the pair of lugs accommodates at least a portion of bench leg 142 of the bench leg assembly.

Referring now to FIGS. 2A-2G, there is depicted exemplary picnic table 200 in accordance with some embodiments of the present disclosure. As shown, picnic table 200 includes a table, such as table 110, and a pair of benches, such as bench 130. Picnic table 200 also includes a pair of linking assemblies, such as linking assembly 210, to detachably connect table 110 with each bench 130.

Linking assembly 210 includes a linking member, such as linking member 162, a first coupler, such as coupler 170, and a second coupler, such as coupler 220. Coupler 170 pivotally connects the first end portion of linking member 162 to bench leg 142 of the bench leg assembly, and coupler 220 detachably connects the second end portion of linking member 162 to table leg 122 of the table leg assembly. As such, when the second end portion of the linking member is disconnected from the table leg assembly, linking member 162 can be rotated toward bench leg 142 of the bench leg assembly.

In some exemplary embodiments, a retainer, such as retainer 240, is disposed at the bench leg to detachably hold the linking member when it rotates to the bench leg. In an exemplary embodiment, the retainer includes two lever arms, such as lever arm 241, to enclose, cross-sectional-wise, at least a portion of the linking member when it rotates to the bench leg. While retainer 240 is provided at the bench leg, it should be noted that a retainer can be provided at either the linking member or the bench leg or both of the linking member and bench leg. In addition, the retainer can be any suitable retainer that detachably holds the linking member, including but not limited to snap fit, press fit, hook and loop fasteners (e.g., Velco connection), magnetic connection, bolts and nuts, screws, or the like.

In some exemplary embodiments, coupler 220 is fixed at the second end portion of linking member 162, e.g., formed or fixedly coupled with the second end portion of linking member 162. For instance, in an exemplary embodiment, the linking member or at least the second end portion of the linking member is hollow. Coupler 220 is formed with a slot, such as slot 221 to receive the second end portion of the linking member. In another exemplary embodiment, coupler 220 is press-fitted or fastened on the second end portion of the linking member.

Coupler 220 includes a mounting port, such as mounting port 181, to receive an end portion of table leg 122 of the table leg assembly. In some exemplary embodiments, a plurality of ribs, such as rib 222 are formed on at least a portion of a side wall of the mounting port to enhance a strength of the mounting port. For instance, in an exemplary embodiment, one or more ribs are formed on one side and one or more ribs are formed on another side of the mounting port, and each rib is elongated substantially along an axis of the mounting port. In some exemplary embodiments, a flange, such as flange 223, is configured to enhance the strength of the mounting port or to aid insertion of the end portion of table leg 122 of the table leg assembly. The flange is generally protruded outwardly along an upper edge of the mounting port or at least a portion of the upper edge of the mounting port. In some exemplary embodiments, a shoulder, such as shoulder 234, is configured to prevent the end portion of the table leg from protruding out of the mounting portion. The shoulder is generally protruded inwardly along a lower edge of the mounting port or along at least a portion of the lower edge of the mounting port.

In some exemplary embodiments, a base, such as base 230, is disposed at the end portion of the table or bench leg. For instance, in some exemplary embodiments, table leg 122 or at least the end portion of the table leg is hollow to receive at least a portion of the base. In some exemplary embodiments, a hole, such as hole 123, is formed on the side wall of the end portion of table leg 122. The base includes a body such as body 231, an elastic piece such as elastic piece 232, and a pin such as pin 233. The elastic piece has one end portion coupled or formed with the body and another end portion coupled or formed with the pin. Gaps are provided between the body and the two sides of the elastic piece, resulting in the pin elastically formed or coupled with the body. When the base is inserted into the end portion of table leg 122 and the pin is aligned with the hole formed at the end portion of table leg 122, the pin protrudes out of the hole and thus affixes the base with the table leg.

In some exemplary embodiments, the pin is formed with an inclined surface, such as surface 234, to aid insertion of the base into the table or bench leg. In some exemplary embodiments, one or more slip-resistant elements, (e.g., traction patterns, ribs, dots or the like), such as element 235, are formed at the bottom of the base to increase friction between the base and the ground. In some exemplary embodiments, the base is formed with a step, such as step 236, at a lower portion of the base, e.g., at or adjacent to the bottom of the base. When the base is inserted into the table leg and the table leg is inserted into the mounting port, the step of the base resides on the shoulder of the coupler and thus prevents the table leg from protruding out of the mounting port of the coupler.

Hollow table or bench leg reduces the overall weight of the table or bench, makes it easier and more convenient to fold and transport, and reduces material consumption. The base lowers the center of the gravity of the table or bench and prevents the table or bench legs from deformation, thereby making the table or bench more stable. In addition, when an individual base is worn or damaged, the base can be replaced directly, making it more cost-effective and environmentally friendly.

Figure 3A:
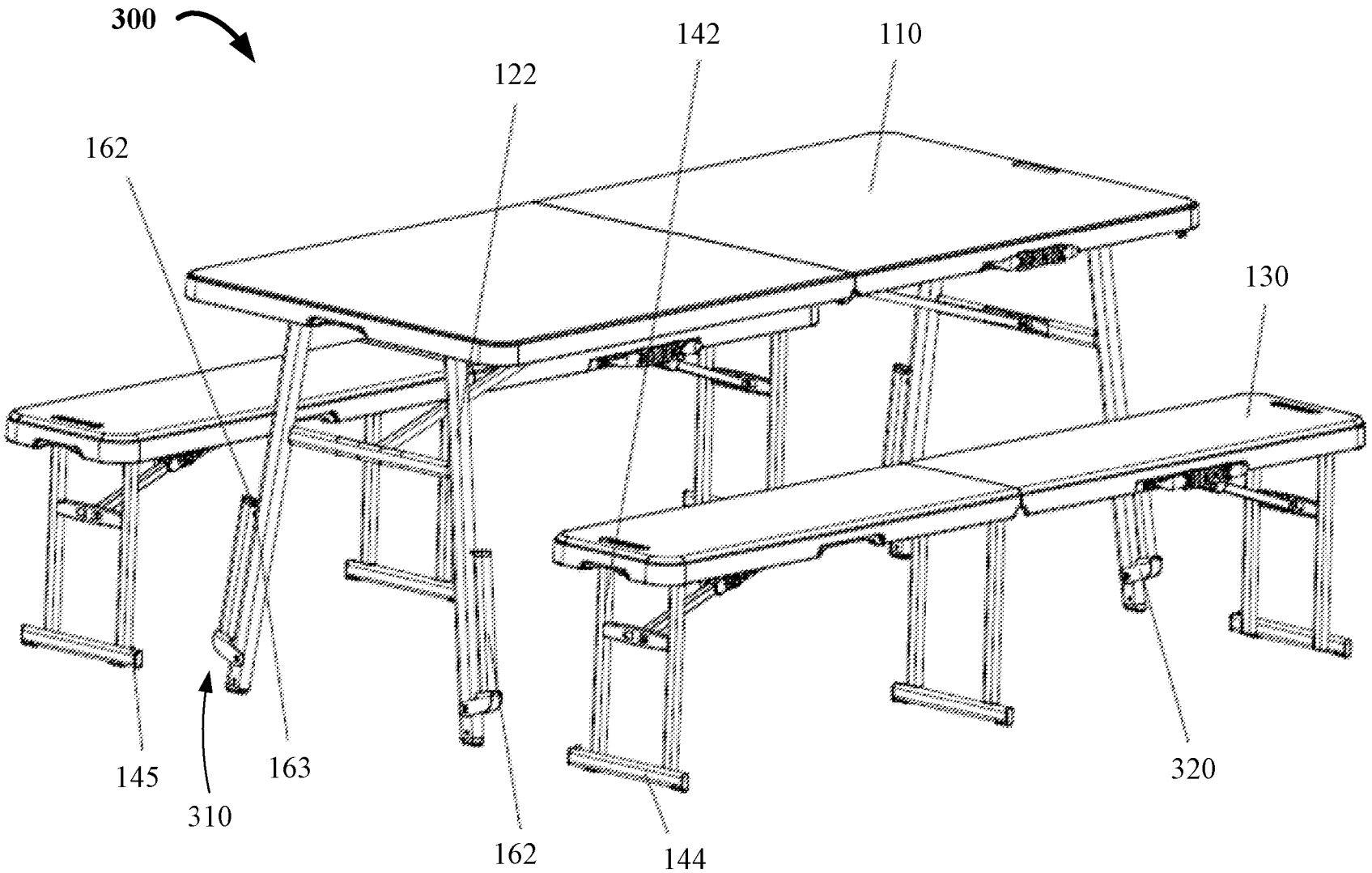
FIG. 3A is a top perspective view illustrating an exemplary picnic table in which the table and benches are separated from each other in accordance with exemplary embodiments of the present disclosure.
Figure 3B:
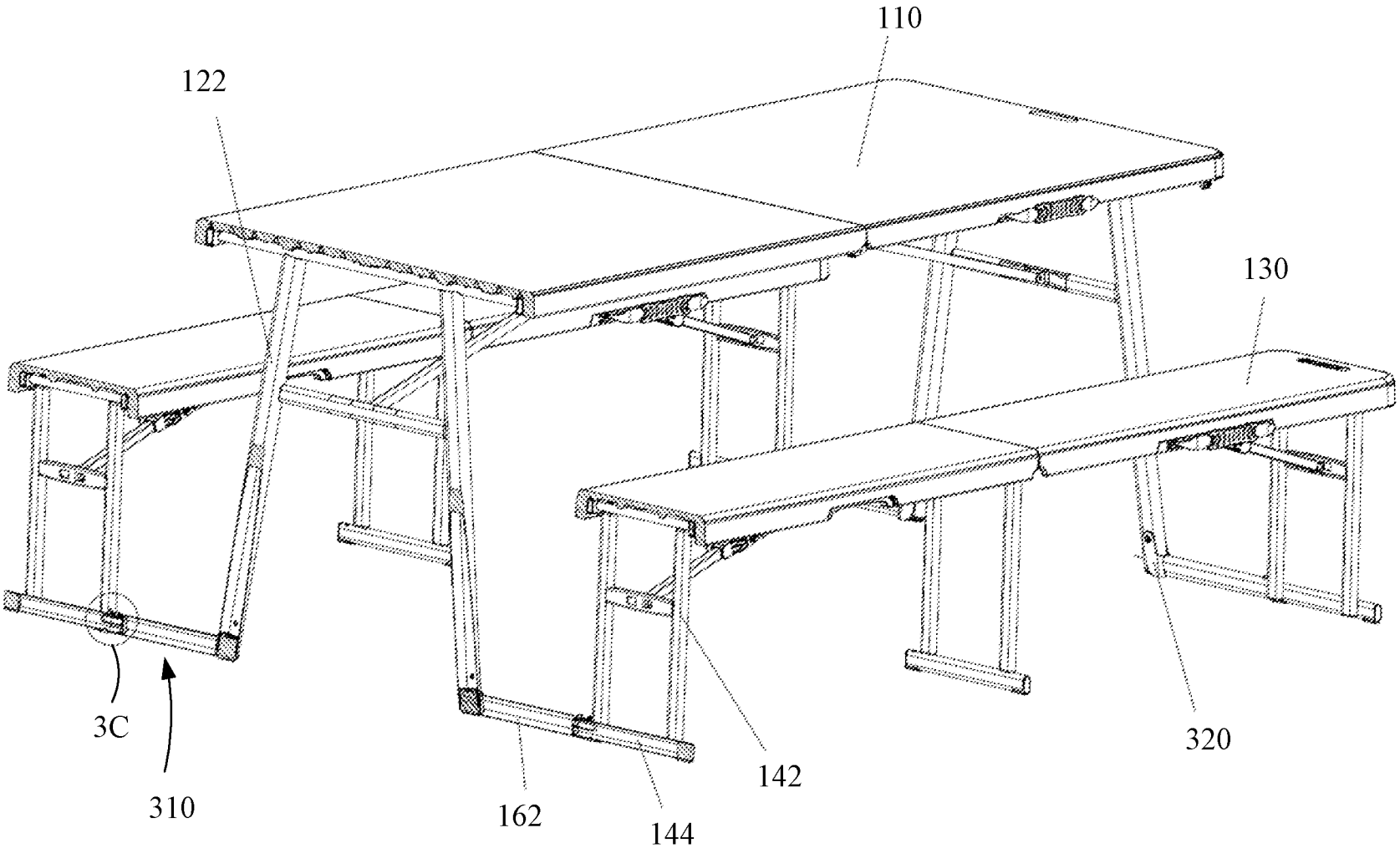
FIG. 3B is a partially cut-out view illustrating the exemplary picnic table of FIG. 3A in which the table and benches are connected to each other in accordance with exemplary embodiments of the present disclosure.
Figure 3C:
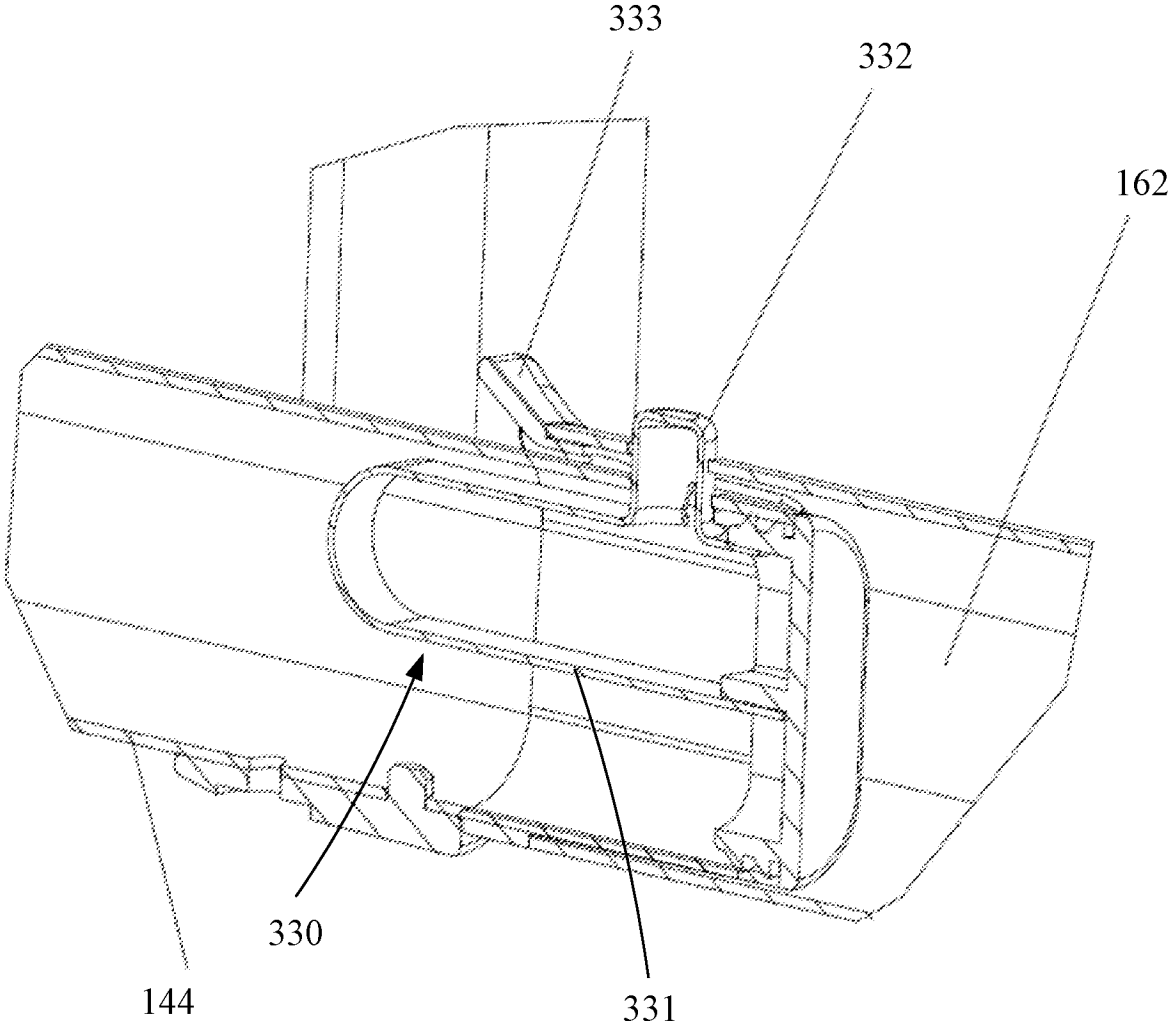
FIG. 3C is an enlarged view taken along circle 3C of FIG. 3B.

Referring now to FIGS. 3A-3C, there is depicted exemplary picnic table 300 in accordance with some embodiments of the present disclosure. As shown, picnic table 300 includes a table, such as table 110, and a pair of benches, such as bench 130. Picnic table 300 also includes a pair of linking assemblies, such as linking assembly 310, to detachably connect table 110 with each bench 130.

Linking assembly 310 includes a linking member, such as linking member 162, a first coupler, such as coupler 320, and a second coupler, such as coupler 330. Coupler 320 pivotally connects the first end portion of linking member 162 to table leg 122 of the table leg assembly, and coupler 330 detachably connects the second end portion of linking member 162 to bench leg lateral bar 144 of the bench leg assembly. As such, when the second end portion of the linking member is disconnected from the bench leg assembly, linking member 162 can be rotated toward table leg 122 of the table leg assembly.

In some exemplary embodiments, the bench leg lateral bar or at least an end portion of the bench leg lateral bar is hollow. A first restriction hole, such as first restriction hole 145, is formed at a side wall of the end portion of the bench leg lateral bar. The linking member or at least the second end portion of the linking member is hollow to receive the end portion of the bench leg lateral bar. A second restriction hole, such as restriction hole 163, is formed at a side wall of the linking member.

Coupler 330 includes an elastic piece, such as elastic piece 331, and a pin, such as pin 332, coupled with the elastic piece. The elastic piece is disposed in the end portion of the bench leg lateral bar with the pin positioned at or adjacent to the first restriction hole. When the first and second limitation holes are aligned with each other, the elastic piece pushes the pin to protrude out of the first and second restriction holes, thereby connecting the linking member with the bench leg lateral bar of the bench leg assembly. Pushing the pin inwardly will disengage the pin from the first and/or second restriction holes and thus allow separation of the linking member from the bench leg lateral bar of the bench leg assembly.

In some exemplary embodiments, a guide, such as guide 333, is formed or disposed at the second end portion of the linking member to aid insertion of the end portion of the bench leg lateral bar into the second end portion of the linking member. The guide is generally inclined or sloped with respect to the length direction of the linking member.

Figure 4A:
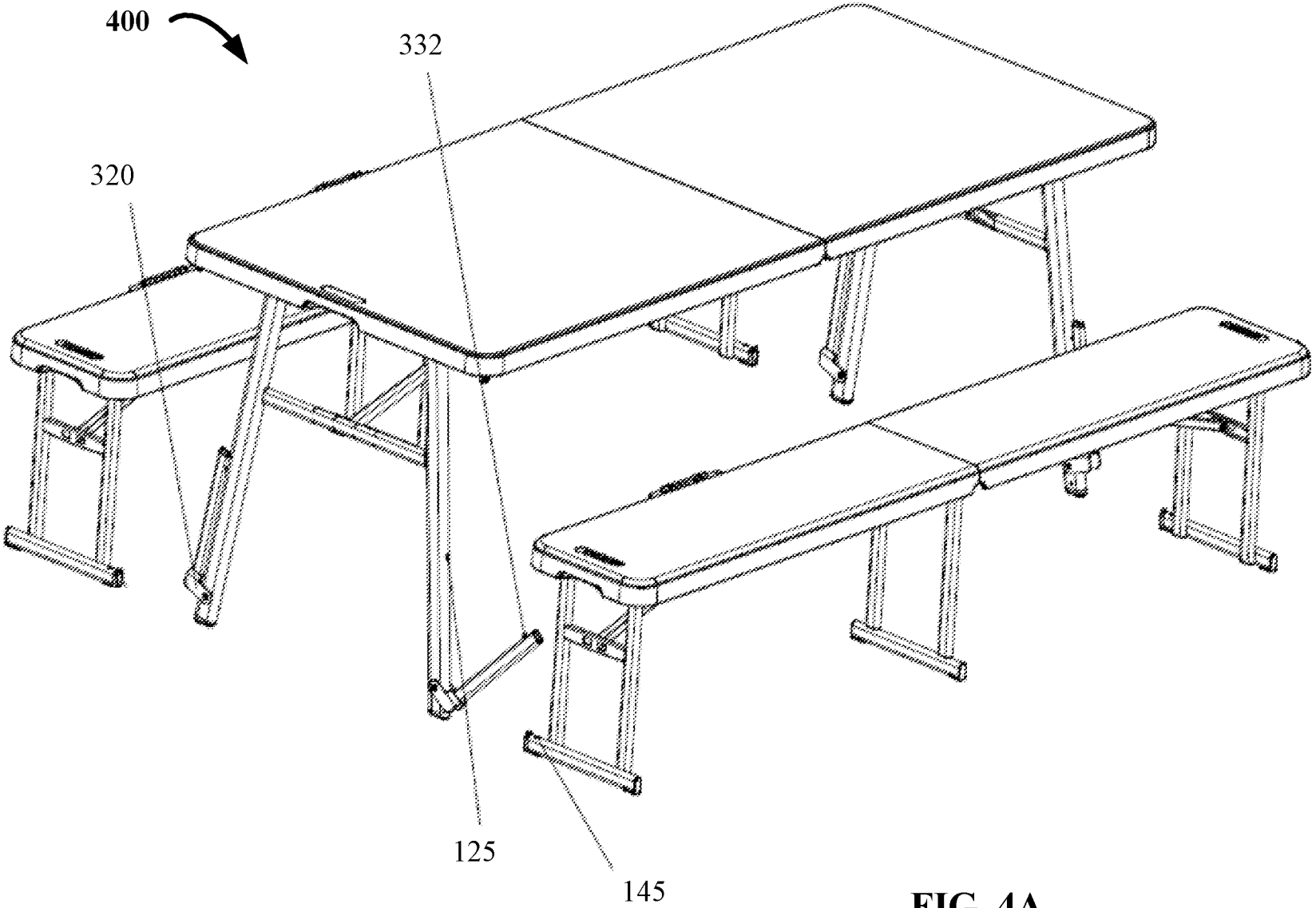
FIG. 4A is a top perspective view illustrating an exemplary picnic table in which the table and benches are separated from each other in accordance with exemplary embodiments of the present disclosure.
Figure 4B:
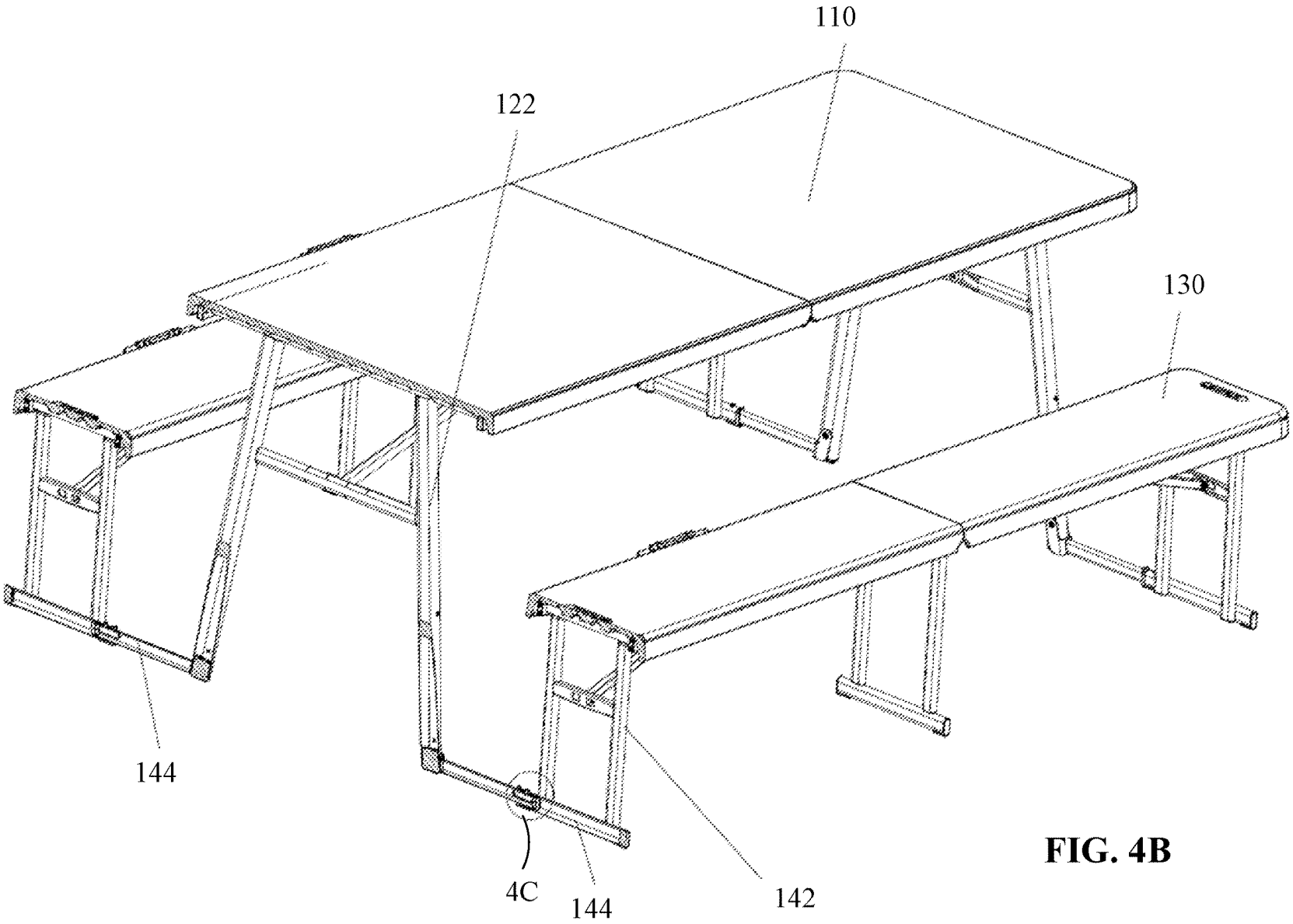
FIG. 4B is a partially cut-out view illustrating the exemplary picnic table of FIG. 4A in which the table and benches are connected to each other in accordance with exemplary embodiments of the present disclosure.
Figure 4C:
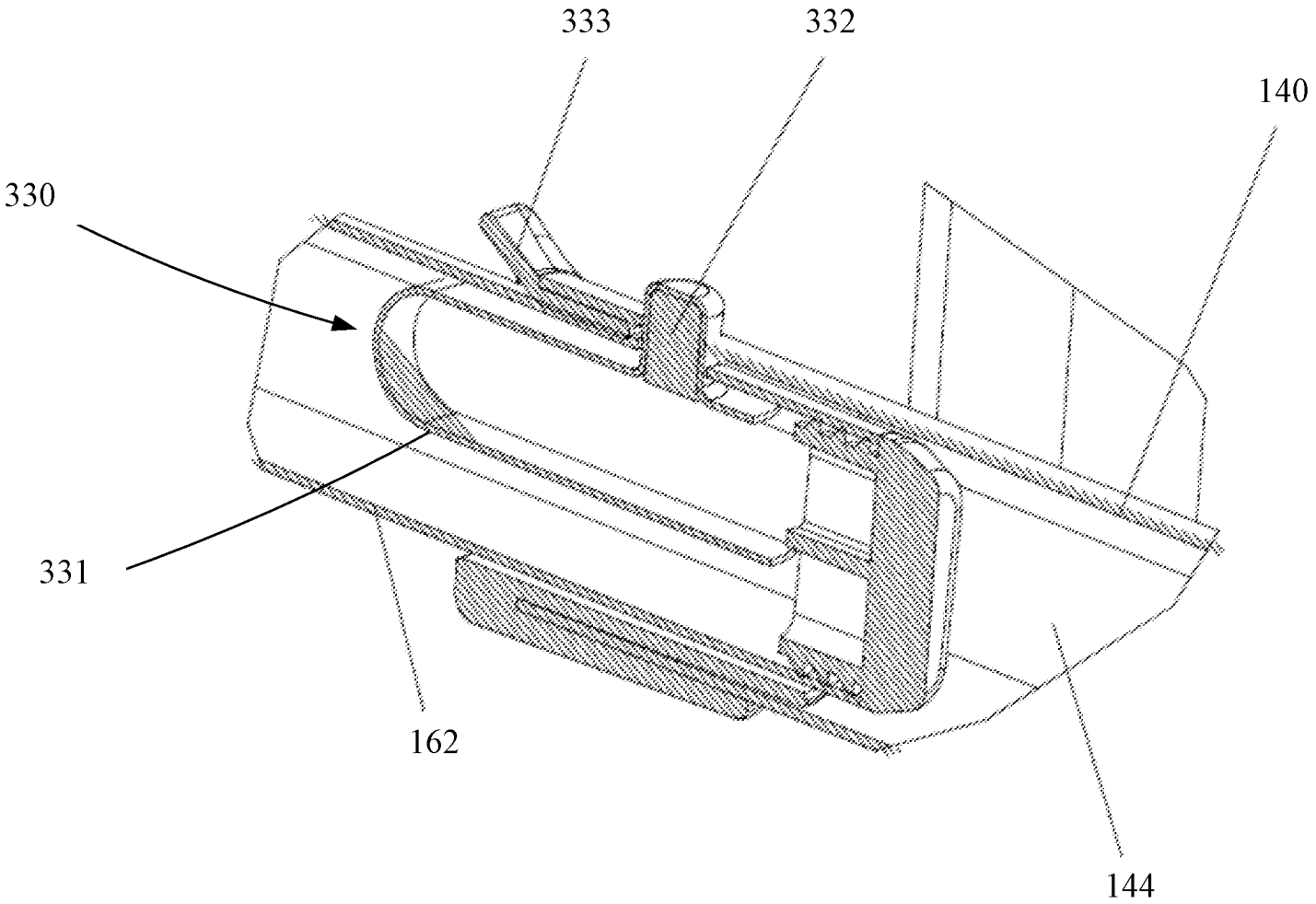
FIG. 4C is an enlarged view taken along circle 4C of FIG. 4B.
Figure 5A:
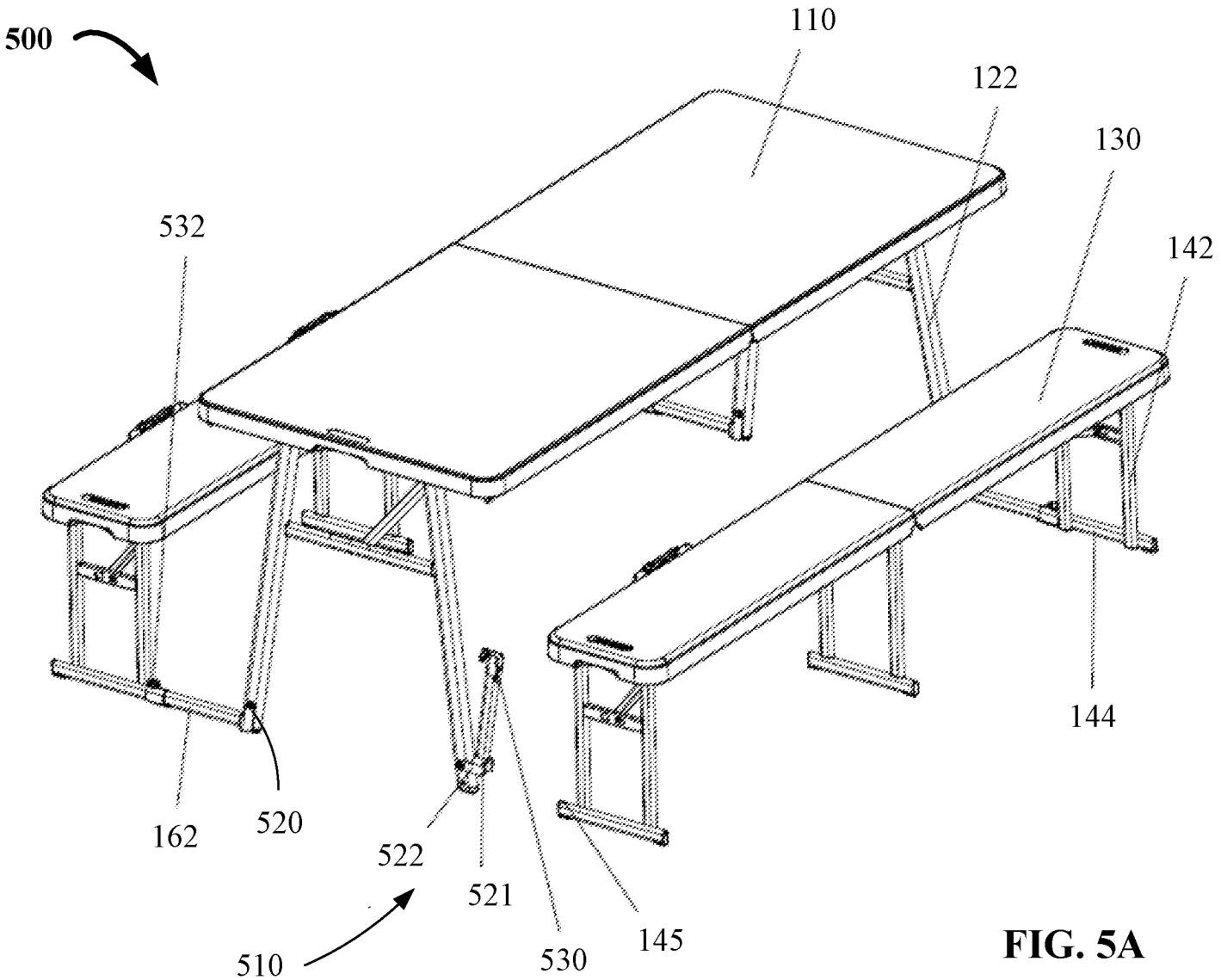
FIG. 5A is a top perspective view illustrating an exemplary picnic table in which a bench is partially connected to and partially separated from a table in accordance with exemplary embodiments of the present disclosure.
Figure 5B:
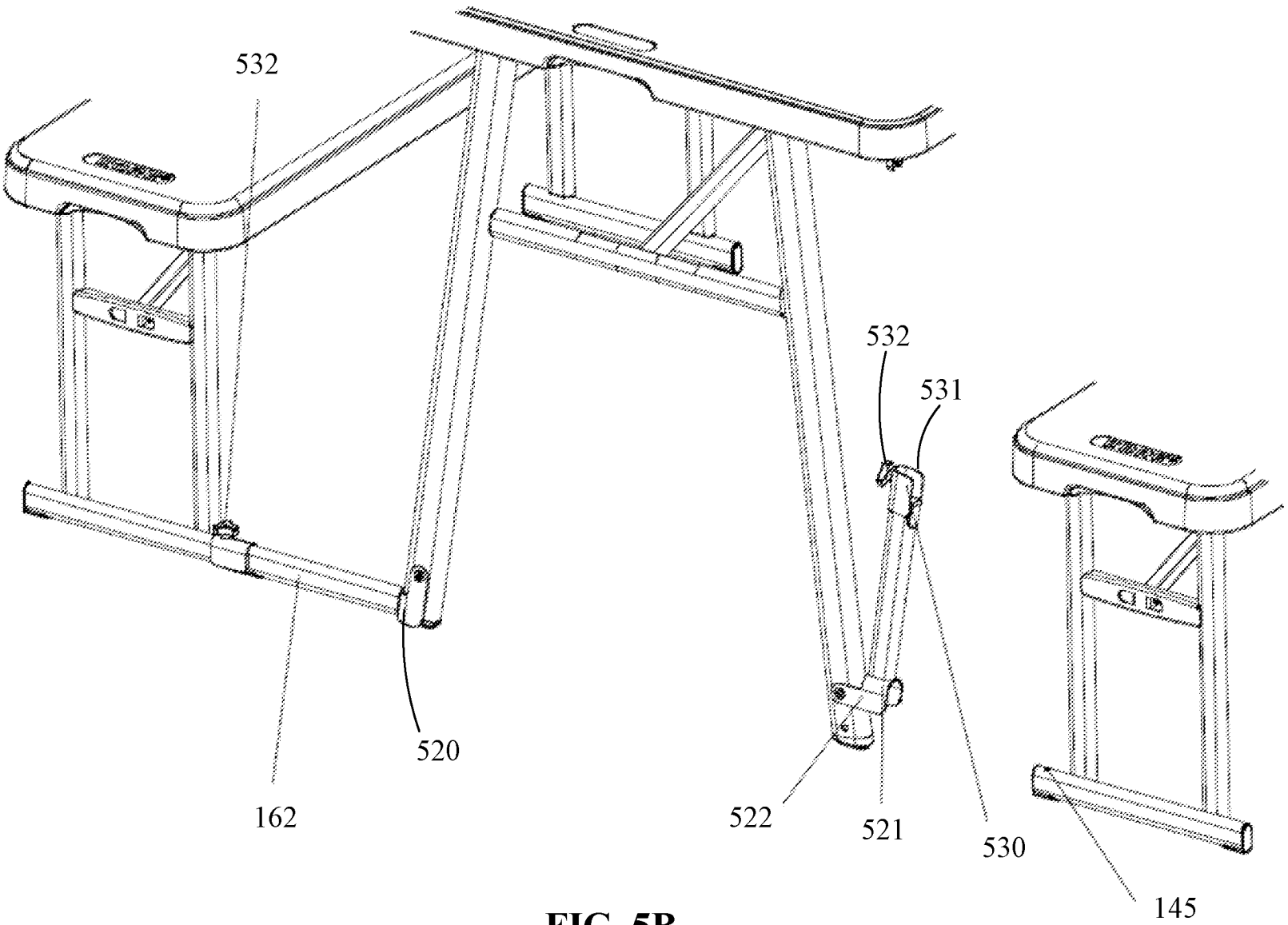
FIG. 5B is a partially enlarged view of FIG. 5A.
Figure 5C:
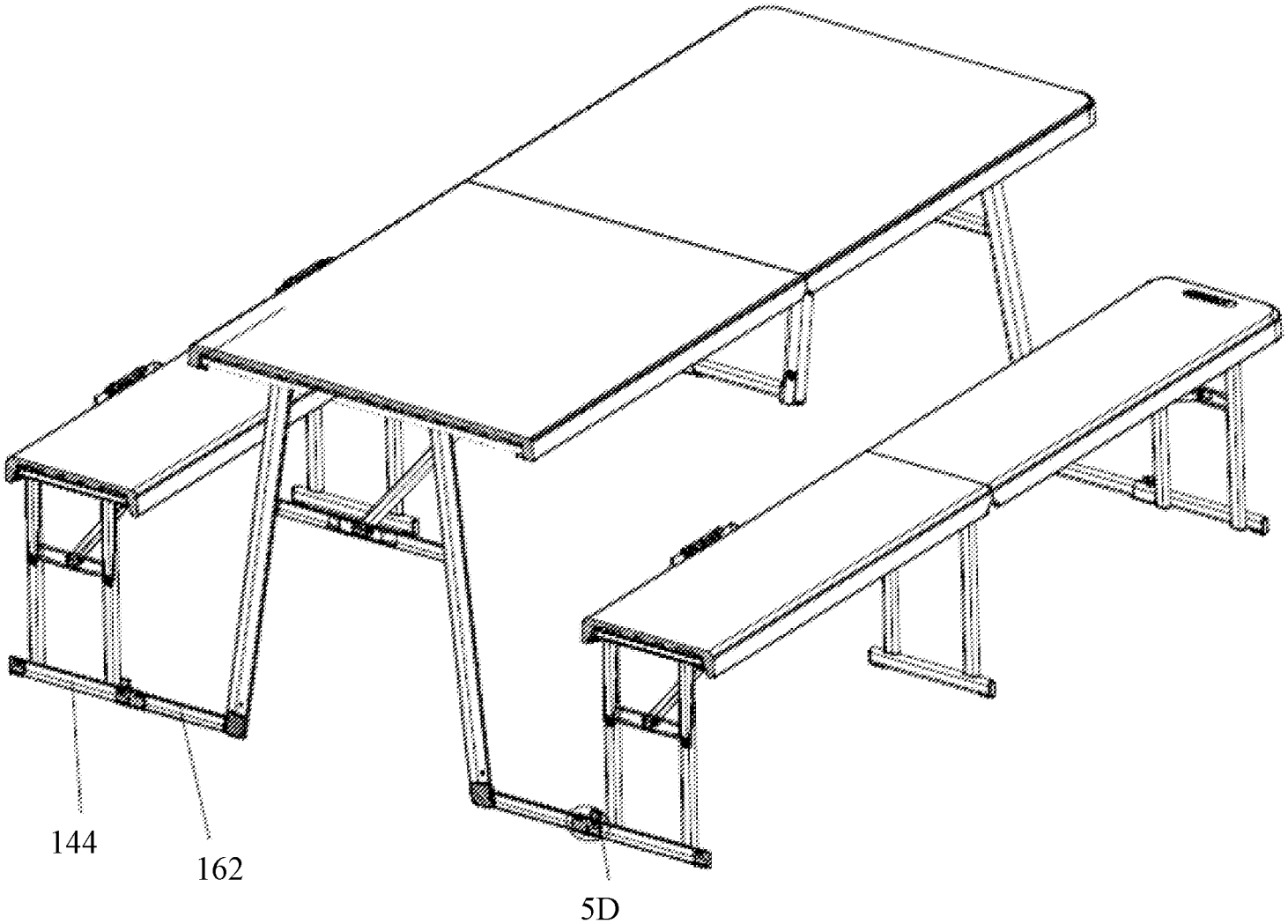
FIG. 5C is a partially cut-out view illustrating the exemplary picnic table of FIG. 5A in which the table and benches are connected to each other in accordance with exemplary embodiments of the present disclosure.
Figure 5D:
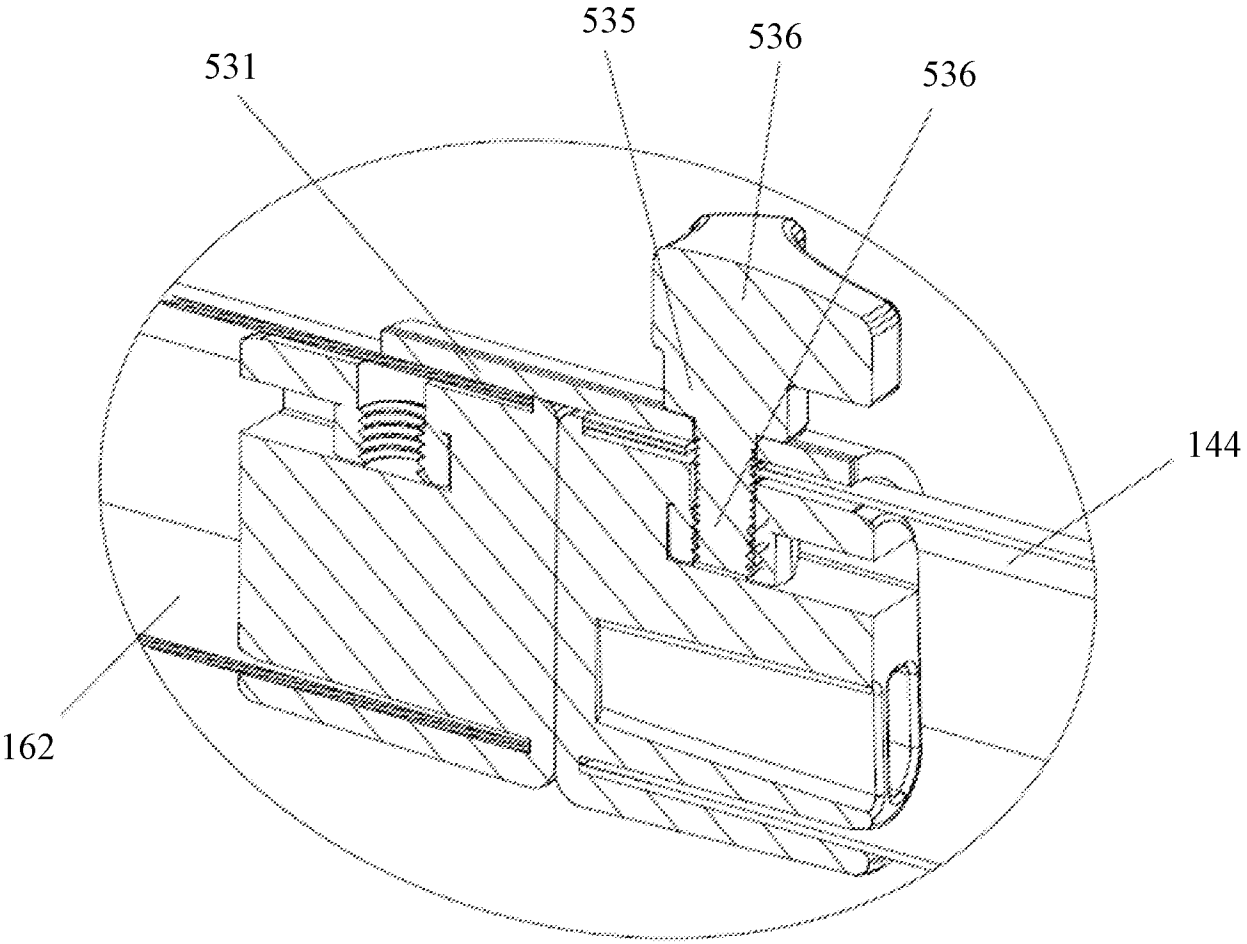
FIG. 5D is an enlarged view taken along oval 5D of FIG. 5C.
Figure 6A:
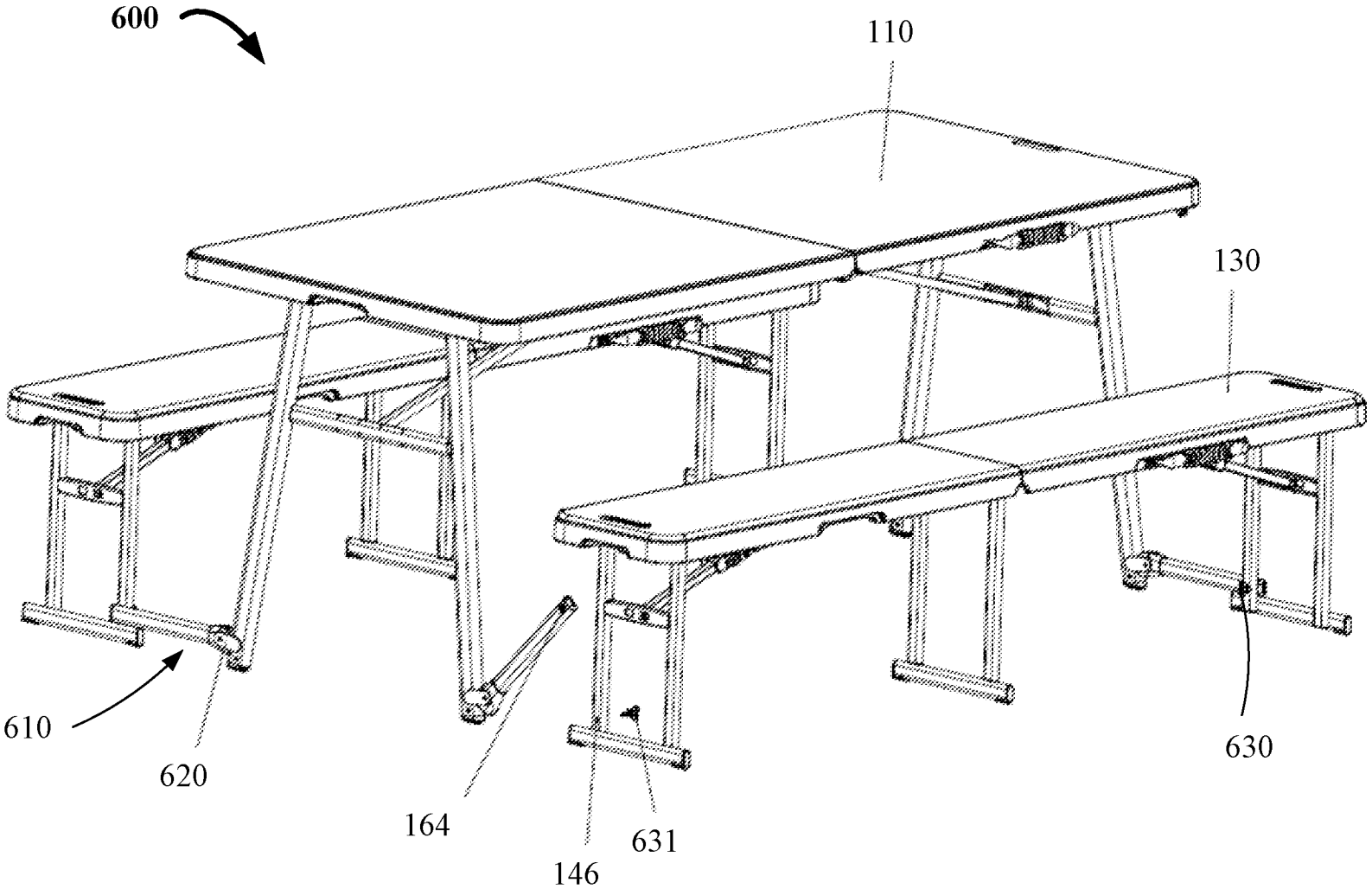
FIG. 6A is a top perspective view illustrating an exemplary picnic table in which a bench is partially connected to and partially separated from a table in accordance with exemplary embodiments of the present disclosure.
Figure 6B:
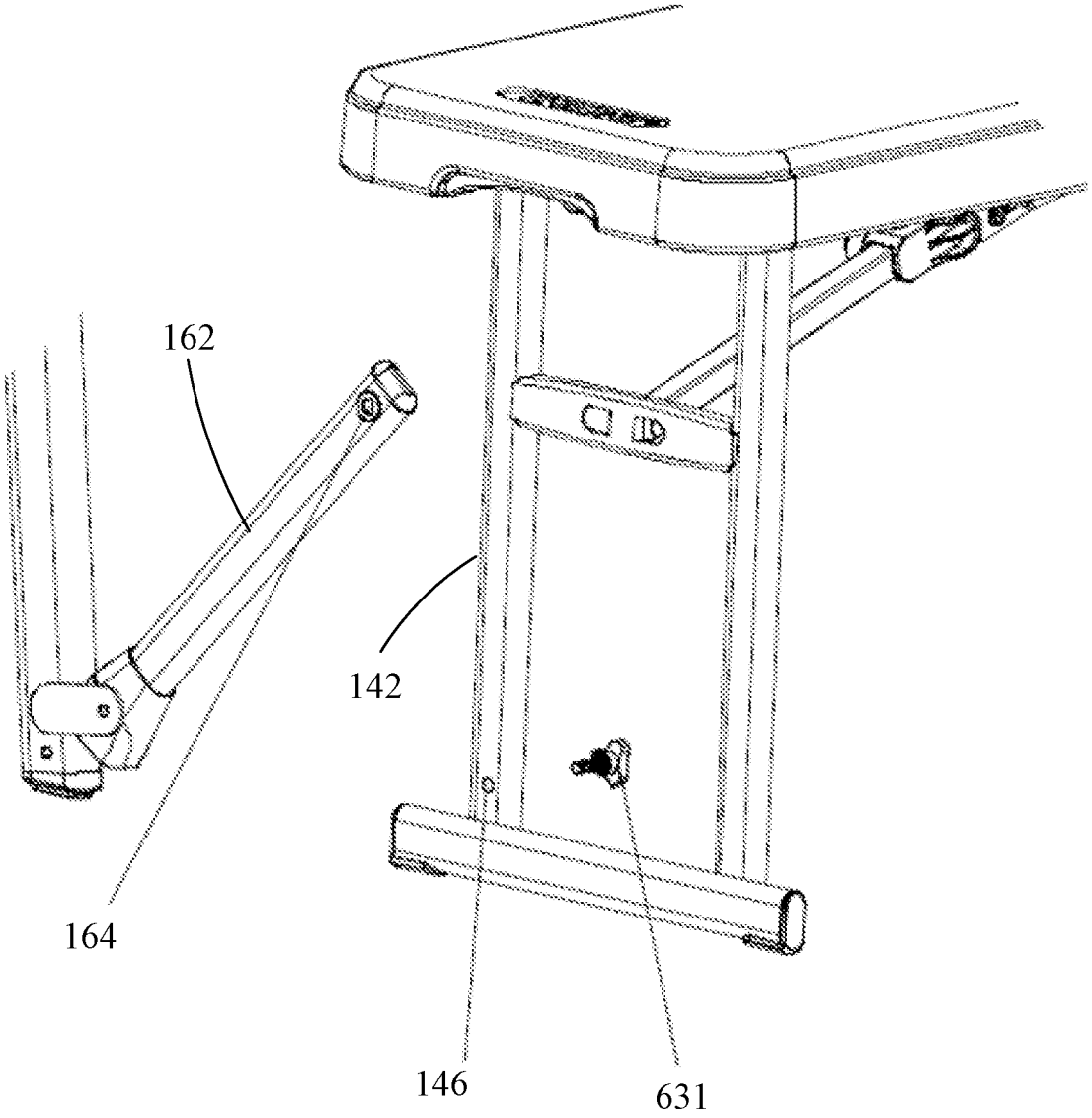
FIG. 6B is a partially enlarged view of FIG. 6A.
Figure 6C:
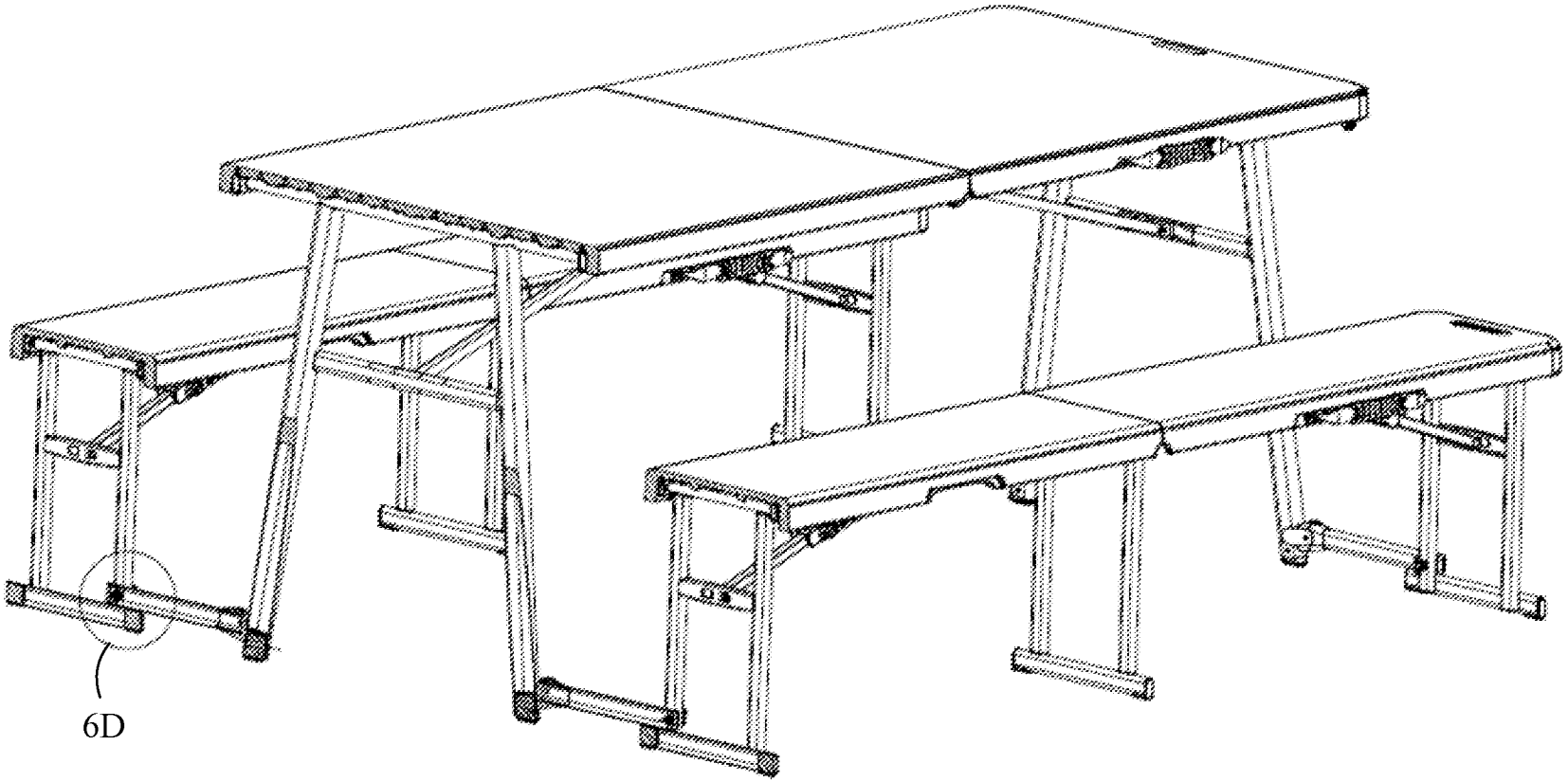
FIG. 6C is a partially cut-out view illustrating the exemplary picnic table of FIG. 6A in which the table and benches are connected to each other in accordance with exemplary embodiments of the present disclosure.
Figure 6D:
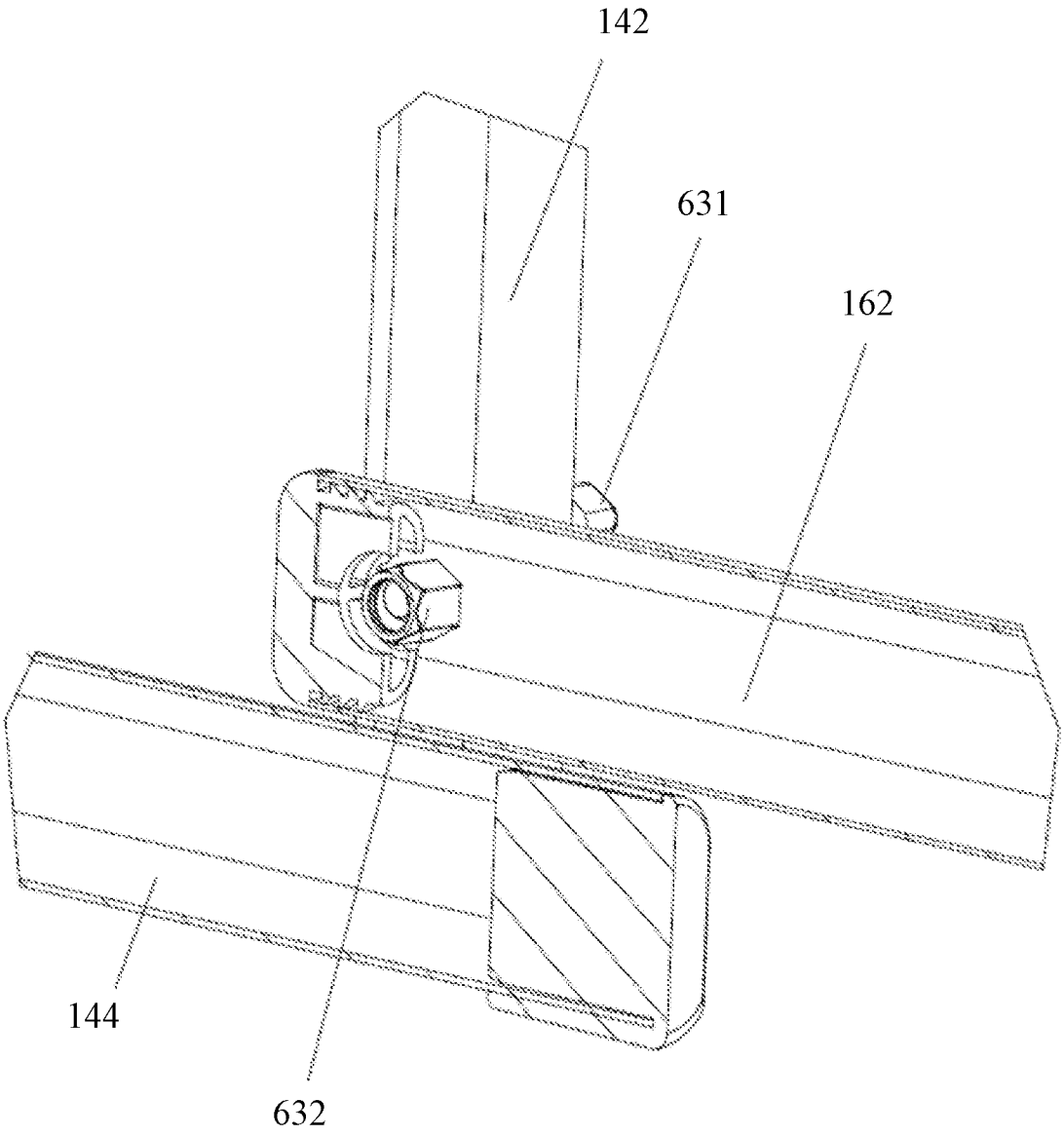
FIG. 6D is an enlarged view taken along circle 6D of FIG. 6C.

Referring now to FIGS. 4A-4C, there is depicted exemplary picnic table 400 in accordance with some embodiments of the present disclosure. Picnic table 400 is substantially the same as picnic table 300, except coupler 330 is disposed in the second end portion of the linking member, the second end portion of the linking member is inserted into the bench leg lateral bar, and the guide is formed at the bench leg lateral bar. Specifically, the elastic piece is disposed in the second end portion of the linking member with the pin positioned at or adjacent to the second restriction hole. When the first and second limitation holes are aligned with each other, the elastic piece pushes the pin to protrude out of the first and second restriction holes, thereby connecting the linking member with the bench leg lateral bar of the bench leg assembly. In some exemplary embodiments, a guide, such as guide 333, is formed or disposed at the end portion of the bench leg lateral bar to aid insertion of the second end portion of the linking member into the end portion of the bench leg lateral bar. The guide is generally inclined or sloped with respect to the length direction of the bench leg lateral bar.

In some exemplary embodiments, a third restriction hole, such as restriction hole 125, is formed at the table leg at a position corresponding to the second restriction hole formed at the linking member. When the linking member disconnected from the bench leg assembly and rotated to the table leg, the third restriction hole is aligned with the second restriction hole. The elastic piece pushes the pin to protrude out of the second restriction hole and into the third restriction hole, and thus retains the linking member on the table leg.

Referring now to FIGS. 5A-5D, there is depicted exemplary picnic table 500 in accordance with some embodiments of the present disclosure. As shown, picnic table 500 includes a table, such as table 110, and a pair of benches, such as bench 130. Picnic table 500 also includes a pair of linking assemblies, such as linking assembly 510, to detachably connect table 110 with each bench 130.

Linking assembly 510 includes a linking member, such as linking member 162, a first coupler, such as coupler 520, and a second coupler, such as coupler 530. Coupler 520 pivotally connects the first end portion of linking member 162 to table leg 122 of the table leg assembly, and coupler 530 detachably connects the second end portion of linking member 162 to bench leg lateral bar 144 of the bench leg assembly. As such, when the second end portion of the linking member is disconnected from the bench leg assembly, linking member 162 can be rotated toward table leg 122 of the table leg assembly.

In some exemplary embodiments, coupler 520 includes a substantially U-shaped first body, such as body 521, and a pair of lugs, such as lug 522, coupled or formed with the substantially U-shaped first body. Body 521 is fixedly connected to the end portion of the linking member and the pair of lugs 522 is pivotally connected to table leg 122 of the table leg assembly. As such, when the second end portion of the linking member is disconnected from the bench leg assembly, linking member 162 can be rotated toward table leg 122 of the table leg assembly. When the linking member is unfolded with respect to table leg 122 of the table leg assembly (e.g., when it is placed substantially horizontally), the linking member is aligned substantially with the end portion of the bench leg lateral bar. At such a position, body 521 and the pair of lugs 522 collectively enclose, cross-sectional-wise, a portion of table leg 122 of the table leg assembly.

In some exemplary embodiments, coupler 530 includes a substantially U-shaped second body, such as body 531. Body 531 is fixedly connected to the second end portion of the linking member, and configured to enclose, cross-sectional-wise, a portion of the bench leg lateral bar. A fastener, such as fastener 532, is coupled with body 531, and configured to be inserted into a hole, such as restriction hole 145, formed at the bench leg lateral bar. As such, coupler 530 selectively or detachably connects the second end portion of the linking member with the bench leg lateral bar of the bench leg assembly.

In some exemplary embodiments, fastener 532 includes a knob portion, such as knob portion 534, and a screw portion, such as screw portion 536. In some exemplary embodiments, fastener 532 further includes a spacing portion, such as spacing portion 535, between the knob portion and screw portion. As such, fastener 532 can be easily and conveniently tightened or loosened to connect or disconnect the second end portion of the linking member with the bench leg lateral bar of the bench leg assembly.

Referring now to FIGS. 6A-6D, there is depicted exemplary picnic table 600 in accordance with some embodiments of the present disclosure. As shown, picnic table 600 includes a table, such as table 110, and a pair of benches, such as bench 130. Picnic table 600 also includes a pair of linking assemblies, such as linking assembly 610, to detachably connect table 110 with each bench 130.

Linking assembly 610 includes a linking member, such as linking member 162, a first coupler, such as coupler 620, and a second coupler, such as coupler 630. Coupler 620 pivotally connects the first end portion of linking member 162 to table leg 122 of the table leg assembly, and coupler 630 detachably connects the second end portion of linking member 162 to bench leg 142 of the bench leg assembly. As such, when the second end portion of the linking member is disconnected from the bench leg assembly, linking member 162 can be rotated toward table leg 122 of the table leg assembly.

In some exemplary embodiments, coupler 630 includes a fastener, such as fastener 631, to selectively or detachably connects the second end portion of the linking member with bench leg 142 of the bench leg assembly, for instance, via hole 164 formed at the second end portion of the linking member and hole 146 formed at bench leg 142. In some exemplary embodiments, a nut, such as nut 632, is disposed inside the second end portion of the linking member at a position adjacent to hole 164 and configured to couple with fastener 631.

In some exemplary embodiments, when the second end portion of the linking member is connected to the bench leg of the bench leg assembly, the second end portion of the linking member is placed on top of the bench leg lateral bar of the bench leg assembly. As such, the bench leg lateral bar of the bench leg assembly supports the linking member and thus helps to enhance the stability of the picnic table.

Referring now to FIGS. 7A-7F, there is depicted exemplary picnic table 700 in accordance with some embodiments of the present disclosure. As shown, picnic table 700 includes a table, such as table 110, and a pair of benches, such as bench 130. Picnic table 700 also includes a pair of linking assemblies, such as linking assembly 710, to detachably connect table 110 with each bench 130.

Linking assembly 710 includes a linking member, such as linking member 162, a first coupler, such as coupler 720, and a second coupler, such as coupler 730. Coupler 720 pivotally connects the first end portion of linking member 162 to bench leg 142 of the bench leg assembly, and coupler 730 detachably connects the second end portion of linking member 162 to table leg 122 of the table leg assembly. As such, when the second end portion of the linking member is disconnected from the table leg assembly, linking member 162 can be rotated toward bench leg 142 of the bench leg assembly.

In some exemplary embodiments, a through hole, such as through hole 124, is formed at table leg 122 of the table leg assembly. Coupler 730 includes a bolt or the like, such as bolt 731, and a nut or the like, such as nut 732. The bolt is fixed at the second end portion of the linking member, and configured to pass through hole 124 formed at table leg 122. The bolt includes a thread, such as thread 732, to detachably couple with the nut.

In some exemplary embodiments, a stopper, such as stopper 740, is disposed at the first end portion of the linking member, for instance, affixed at the first end portion of the linking member by the first coupler. Stopper 740 includes a first surface, such as first surface 741, and a second surface, such as second surface 742. In some exemplary embodiments, the first and second surfaces are substantially perpendicular to each other.

Figure 7A:
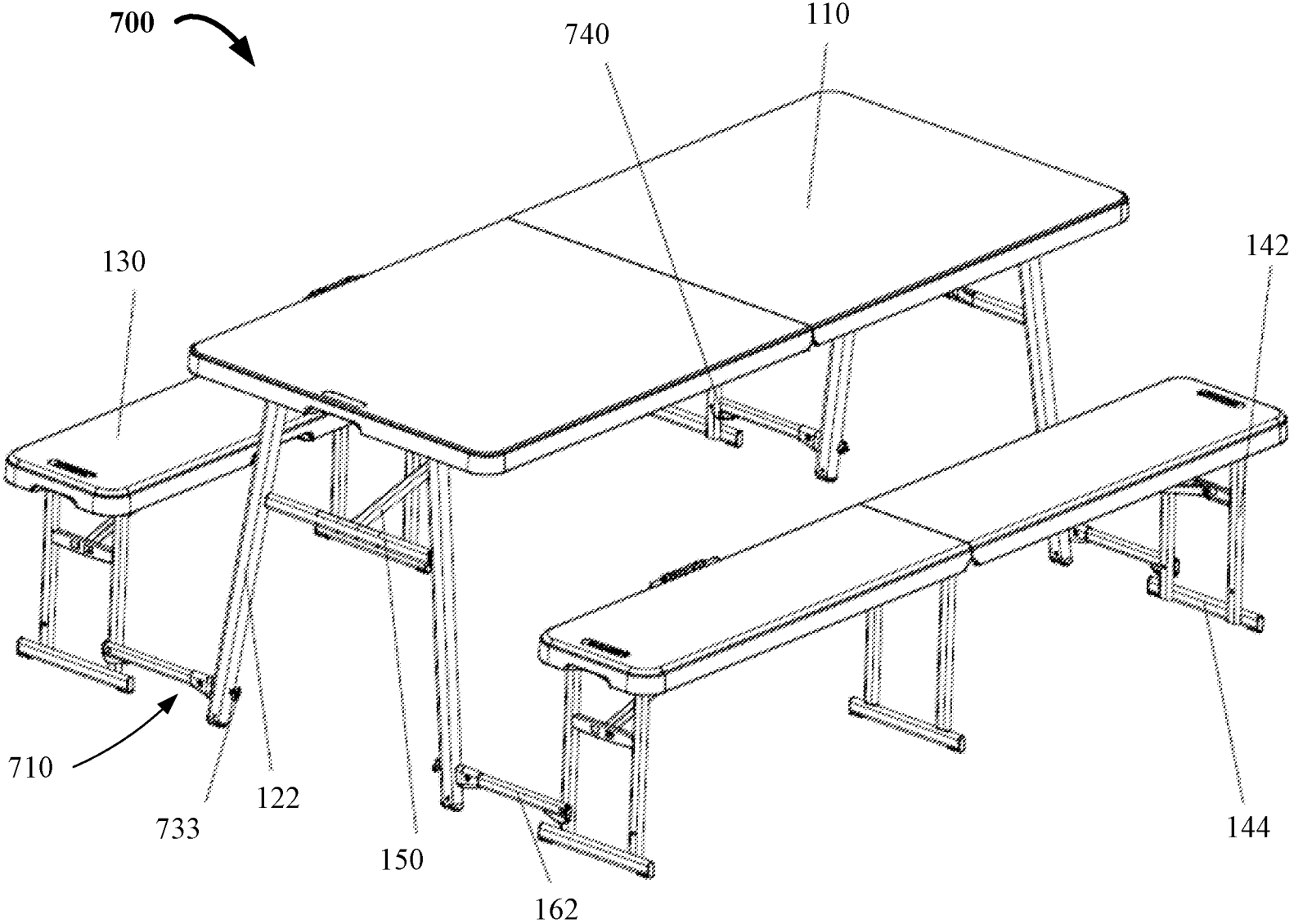
FIG. 7A is a top perspective view illustrating an exemplary picnic table in which the table and benches are connected to each other in accordance with exemplary embodiments of the present disclosure.
Figure 7B:
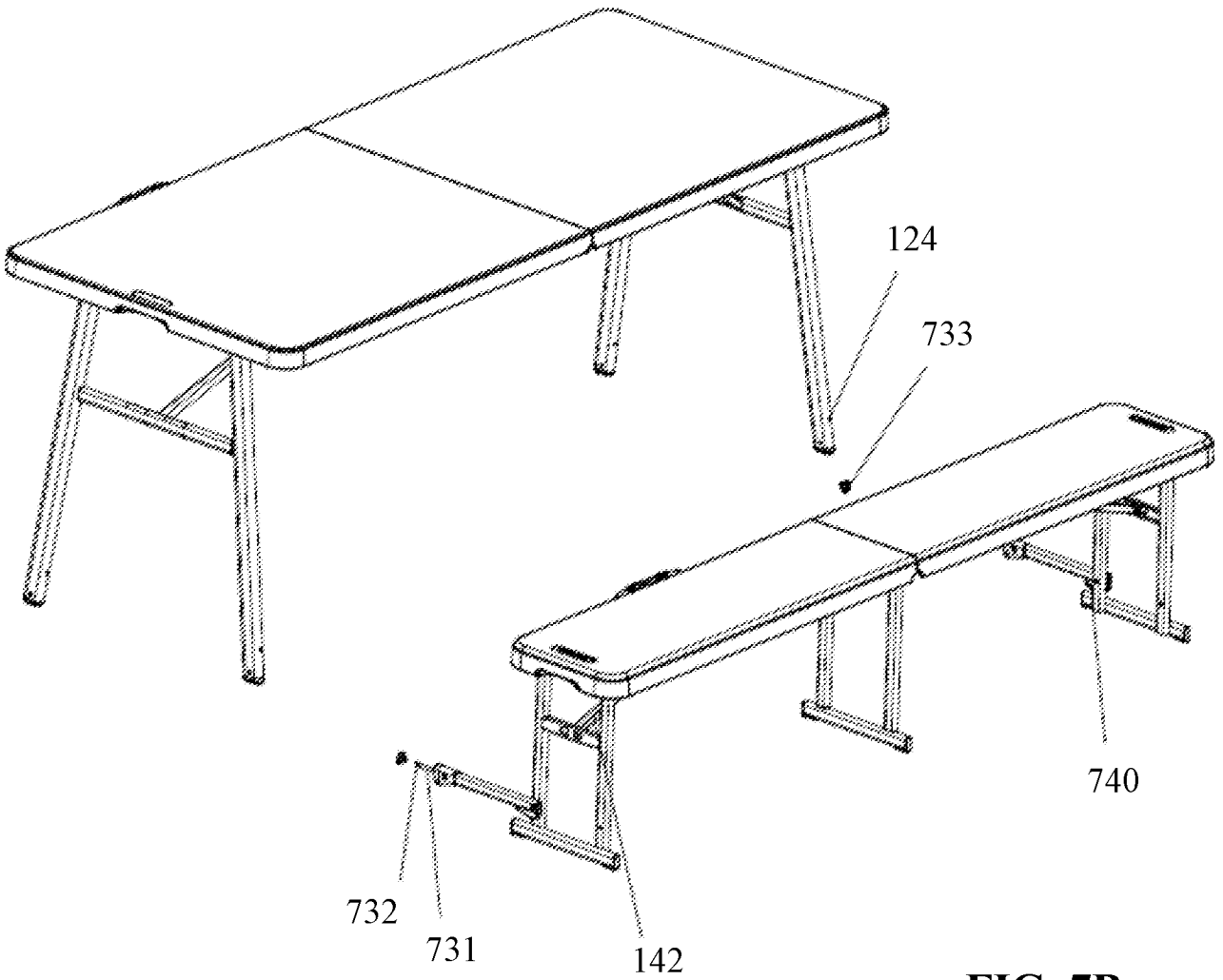
FIG. 7B is a top perspective view illustrating an exemplary picnic table in which the table and bench are separated from each other in accordance with exemplary embodiments of the present disclosure.
Figure 7C:
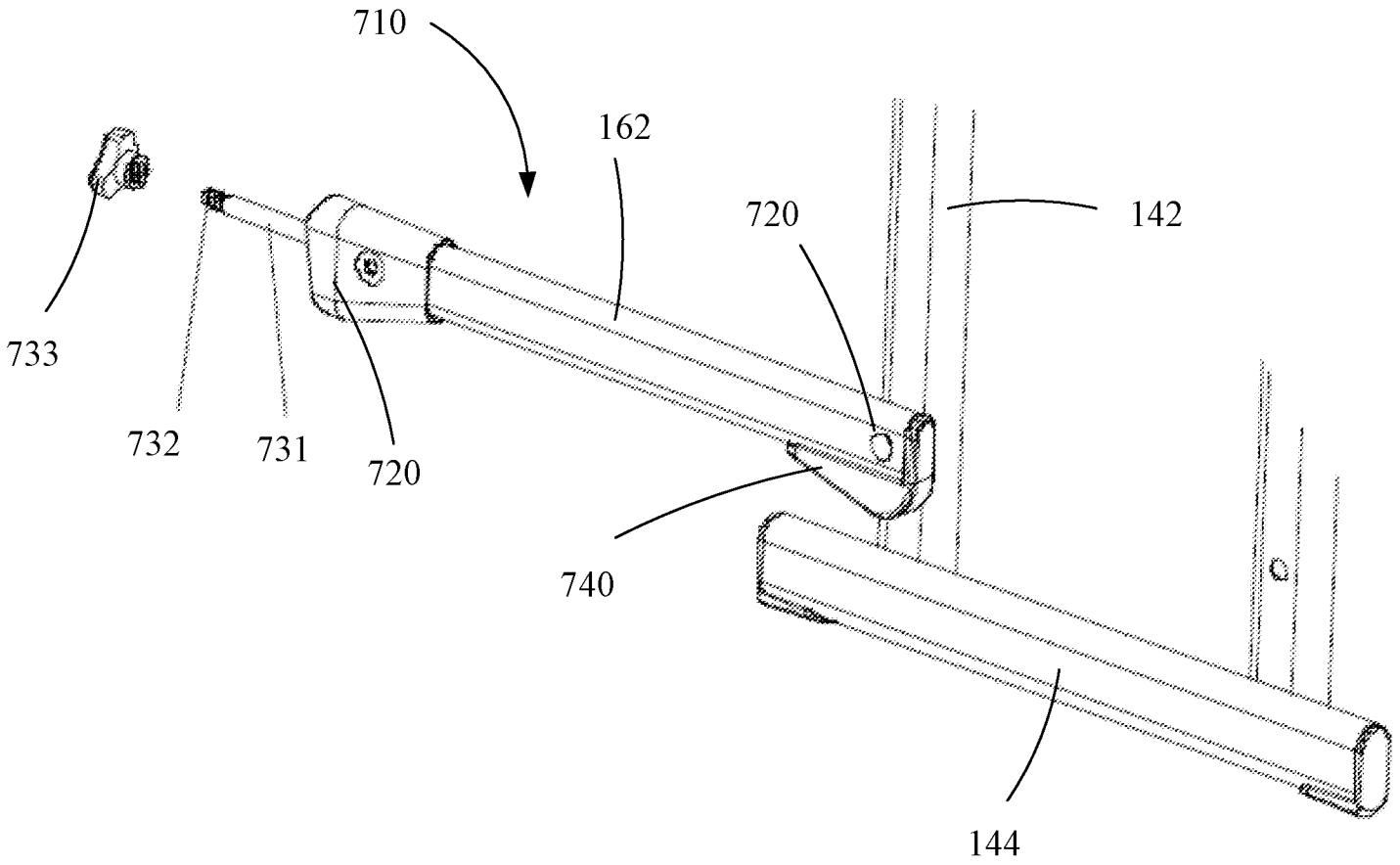
FIG. 7C is a partially enlarged view of FIG. 7B.
Figure 7D:
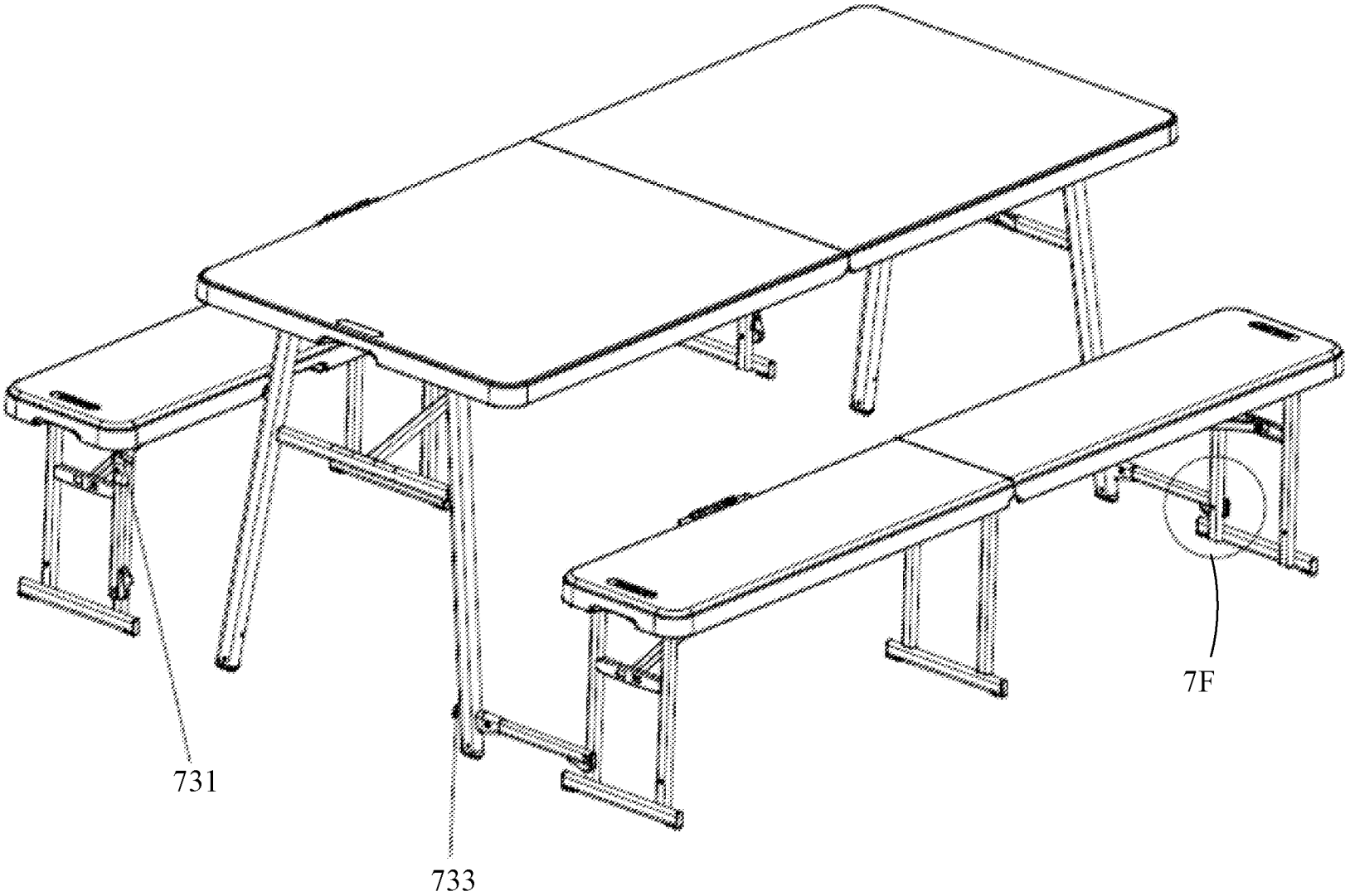
FIG. 7D is a top perspective view illustrating the exemplary picnic table of FIG. 7A in which one bench is connected to the table and another bench is separated from the table in accordance with exemplary embodiments of the present disclosure.
Figure 7E:
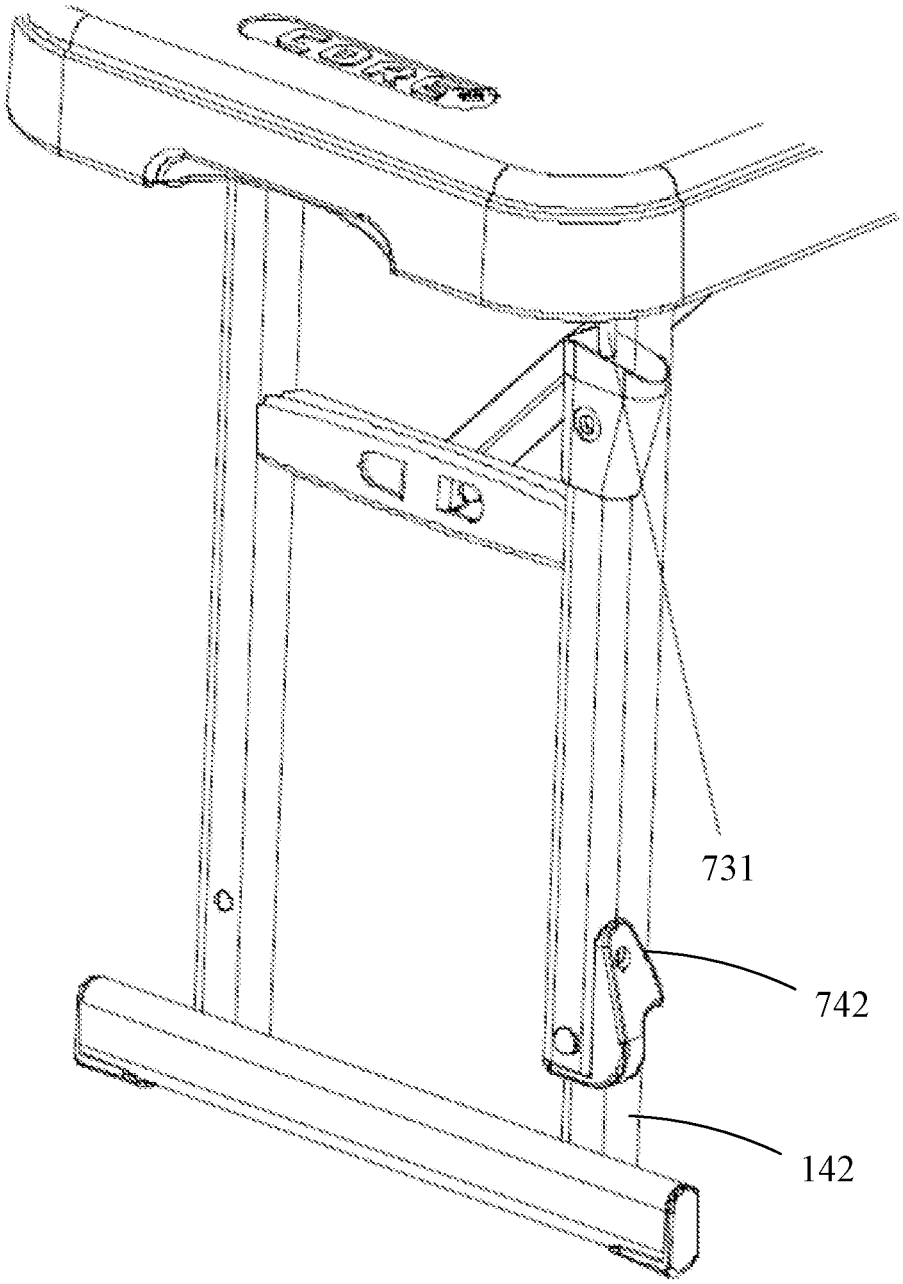
FIG. 7E is a partially enlarged view of FIG. 7D.
Figure 7F:
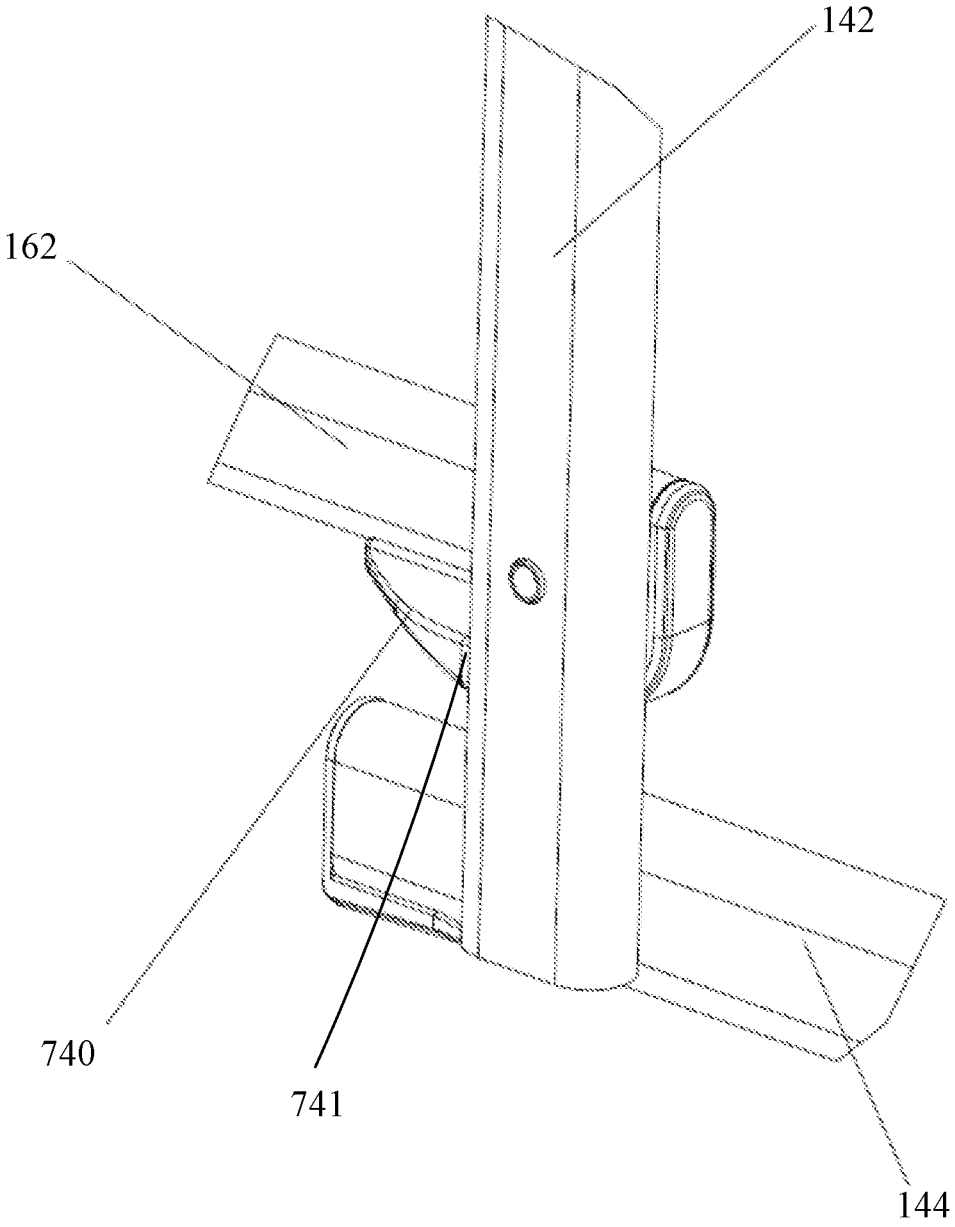
FIG. 7F is an enlarged view taken along circle 7F of FIG. 7D.
Figure 8A:
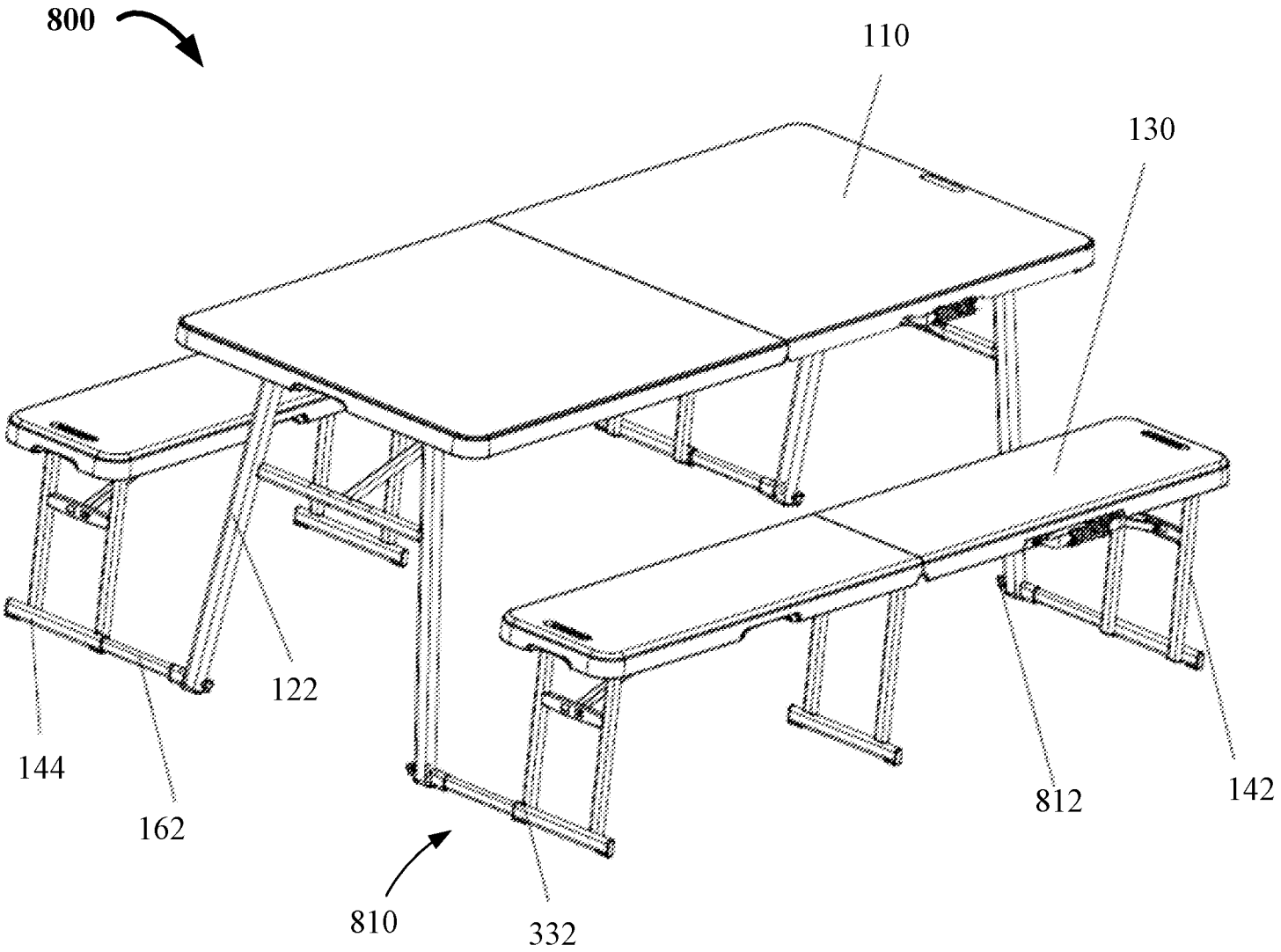
FIG. 8A is a top perspective view illustrating an exemplary picnic table in which the table and benches are connected to each other in accordance with exemplary embodiments of the present disclosure.
Figure 8B:
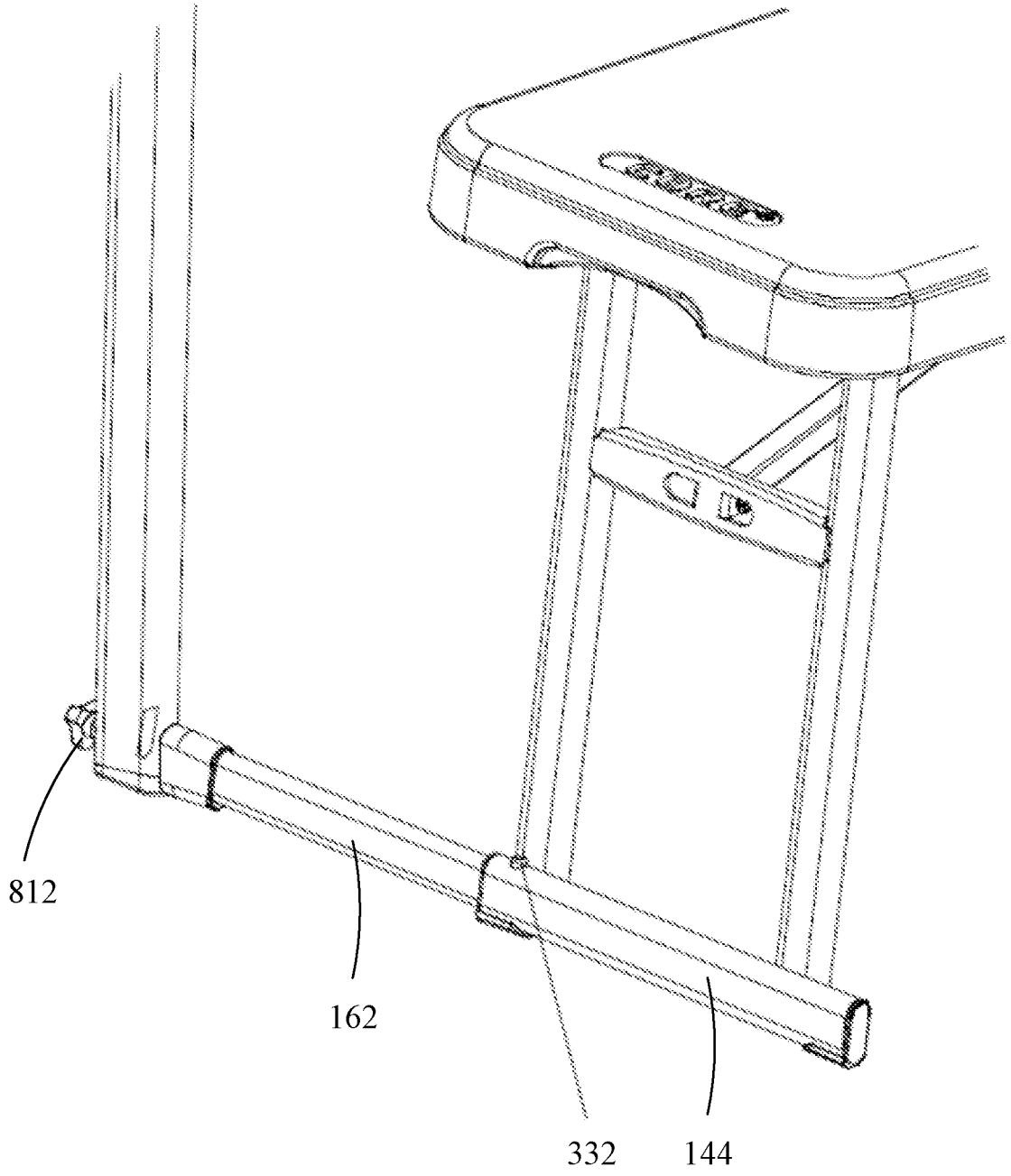
FIG. 8B is a partially enlarged view of FIG. 8A.
Figure 8C:
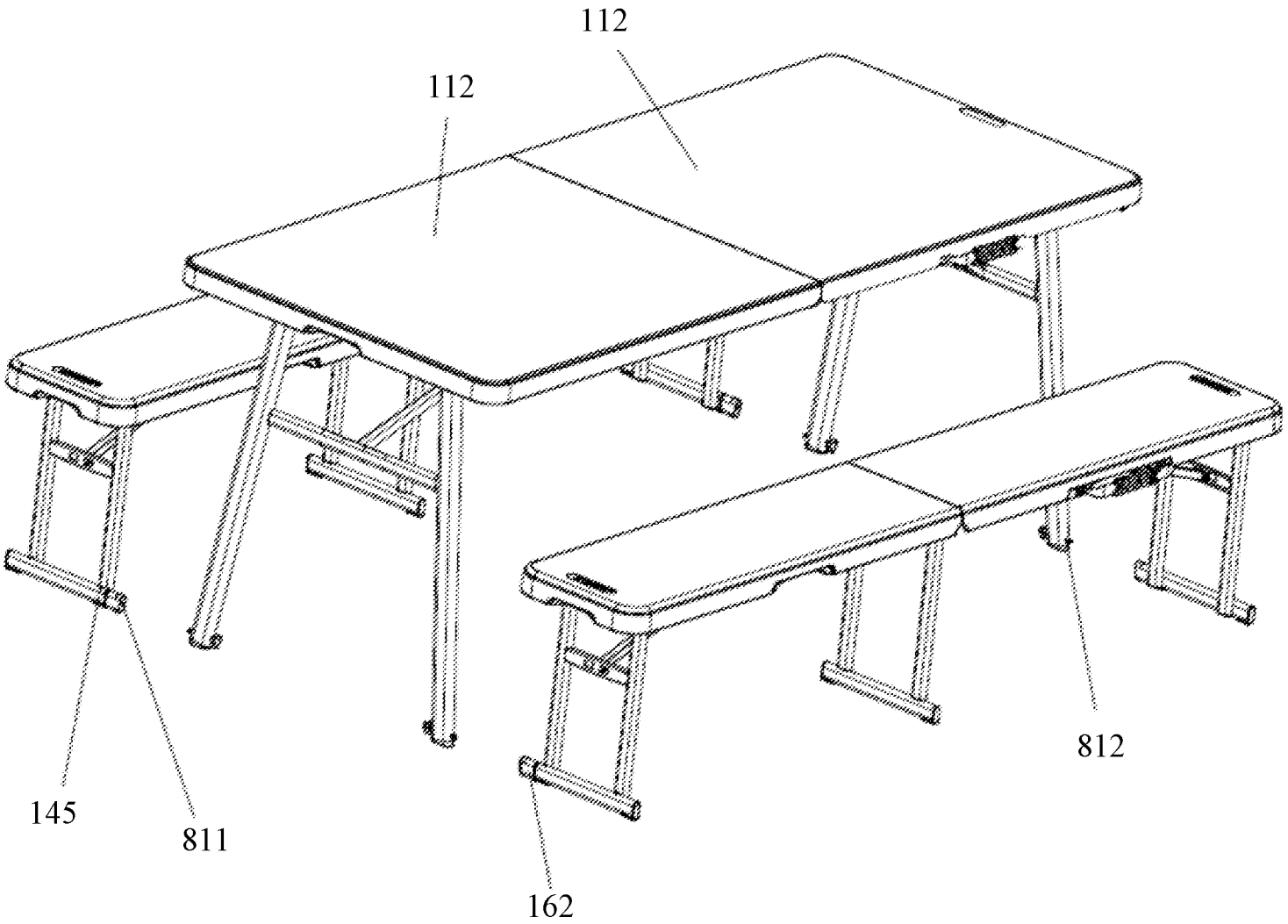
FIG. 8C is a top perspective view illustrating the exemplary picnic table of FIG. 8A in which the table and benches are separated from each other in accordance with exemplary embodiments of the present disclosure.
Figure 8D:
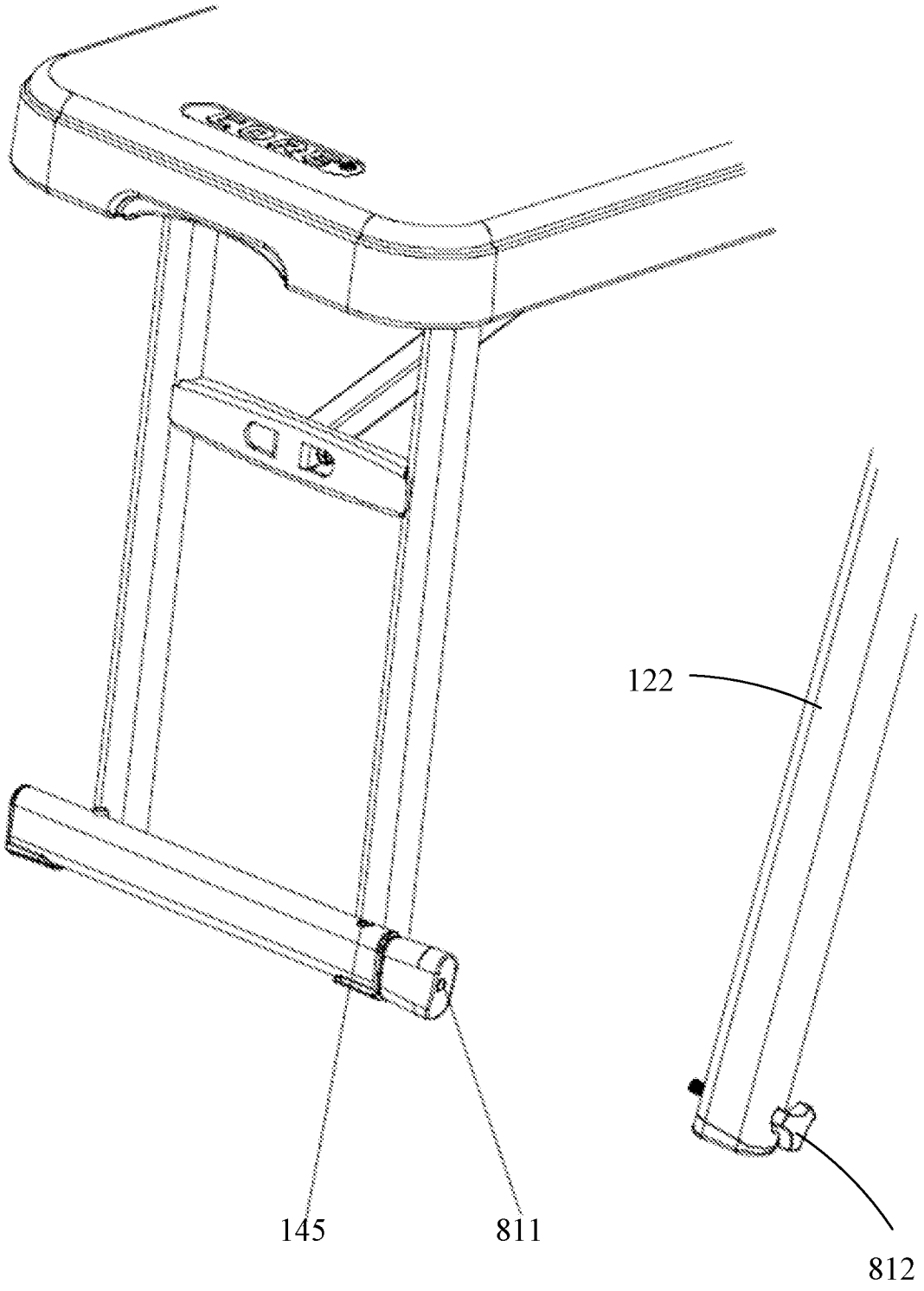
FIG. 8D is a partially enlarged view of FIG. 8C.
Figure 8E:
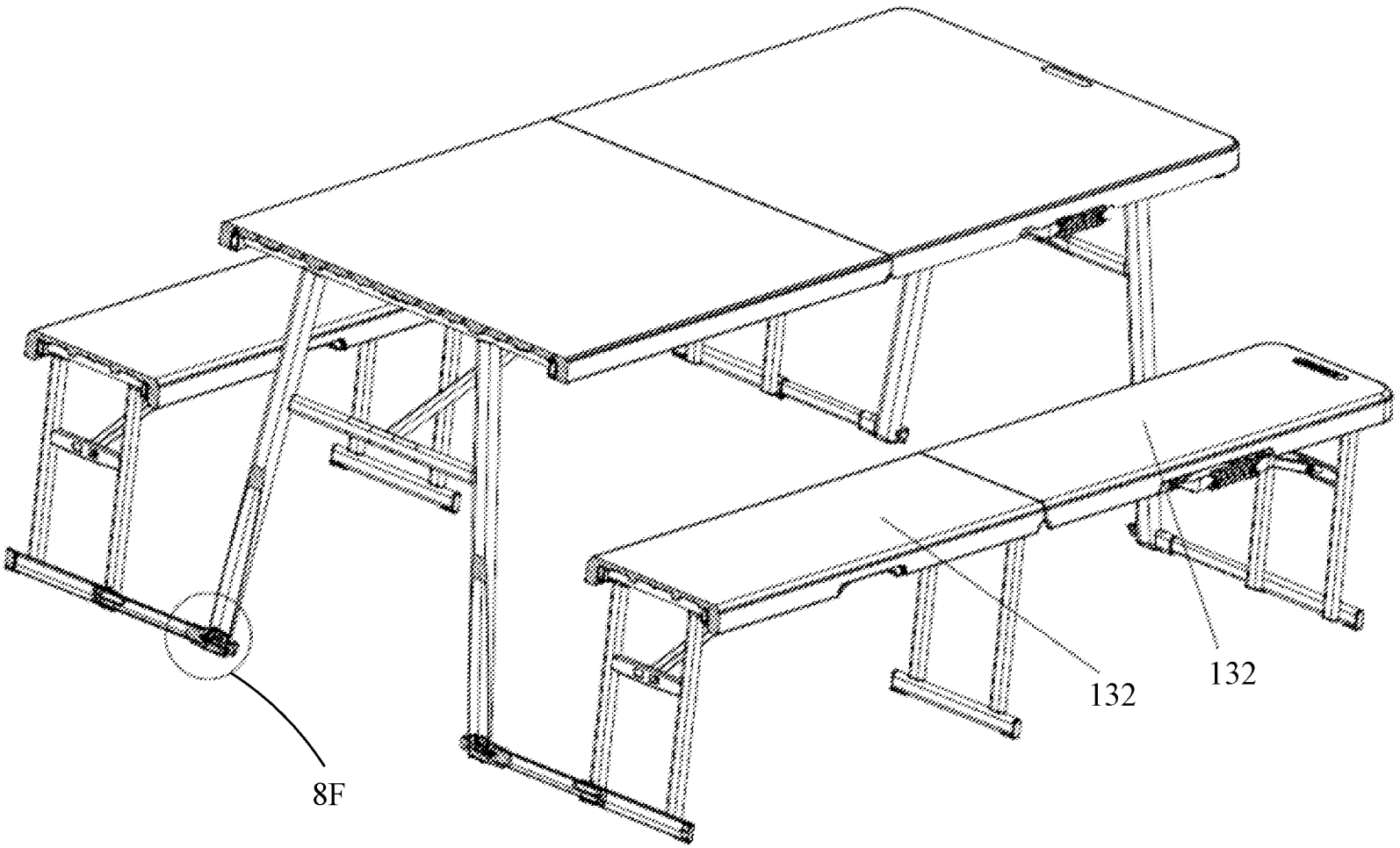
FIG. 8E is a partially cut-out view illustrating the exemplary picnic table of FIG. 8A in accordance with exemplary embodiments of the present disclosure.
Figure 8F:
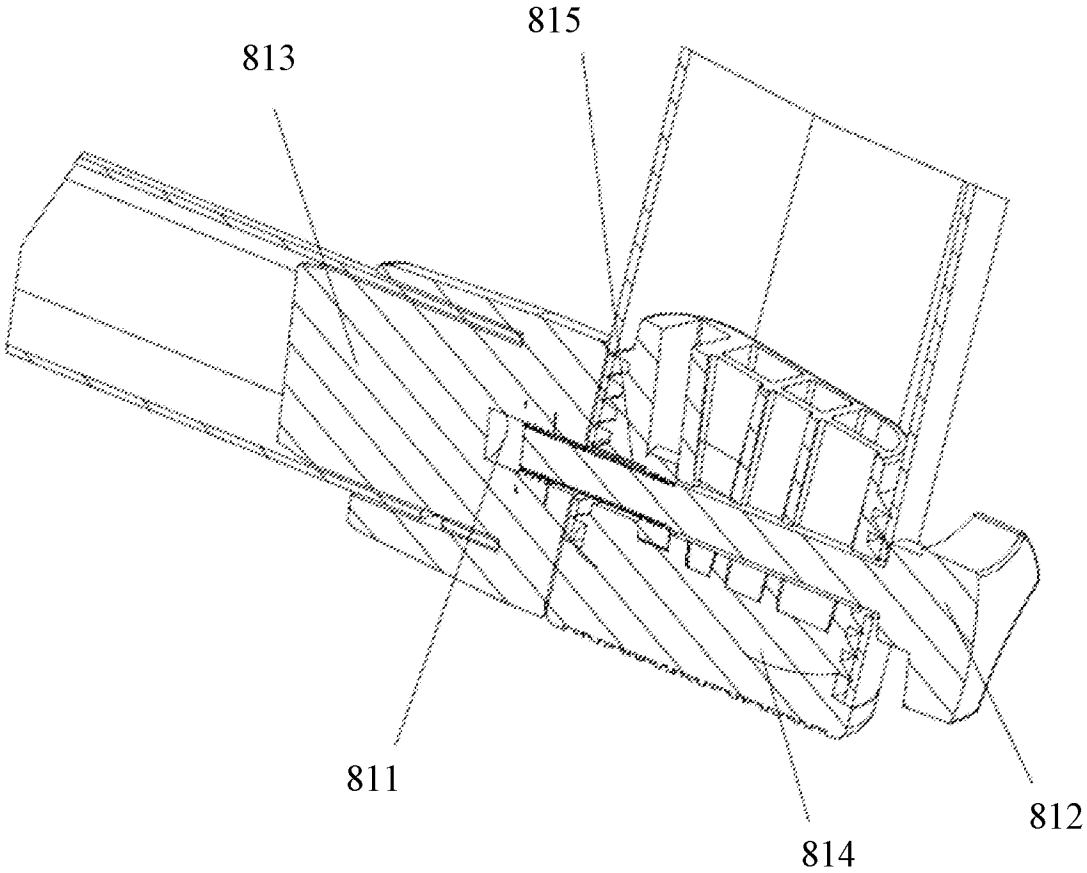
FIG. 8F is a partially enlarged view of FIG. 8E.
Figure 9A:
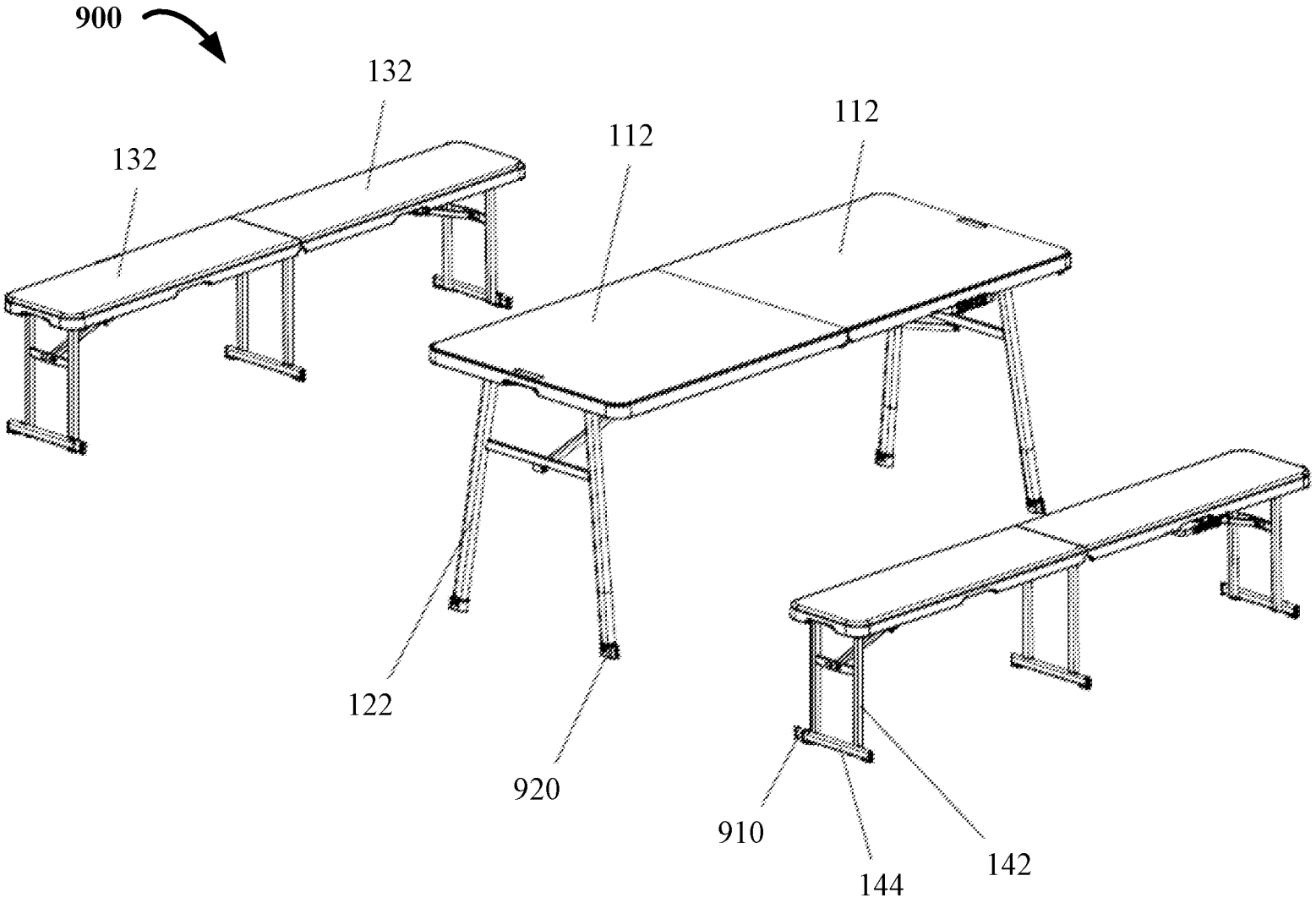
FIG. 9A is a top perspective view illustrating an exemplary picnic table in which the table and benches are separated from each other in accordance with exemplary embodiments of the present disclosure.
Figure 9B:
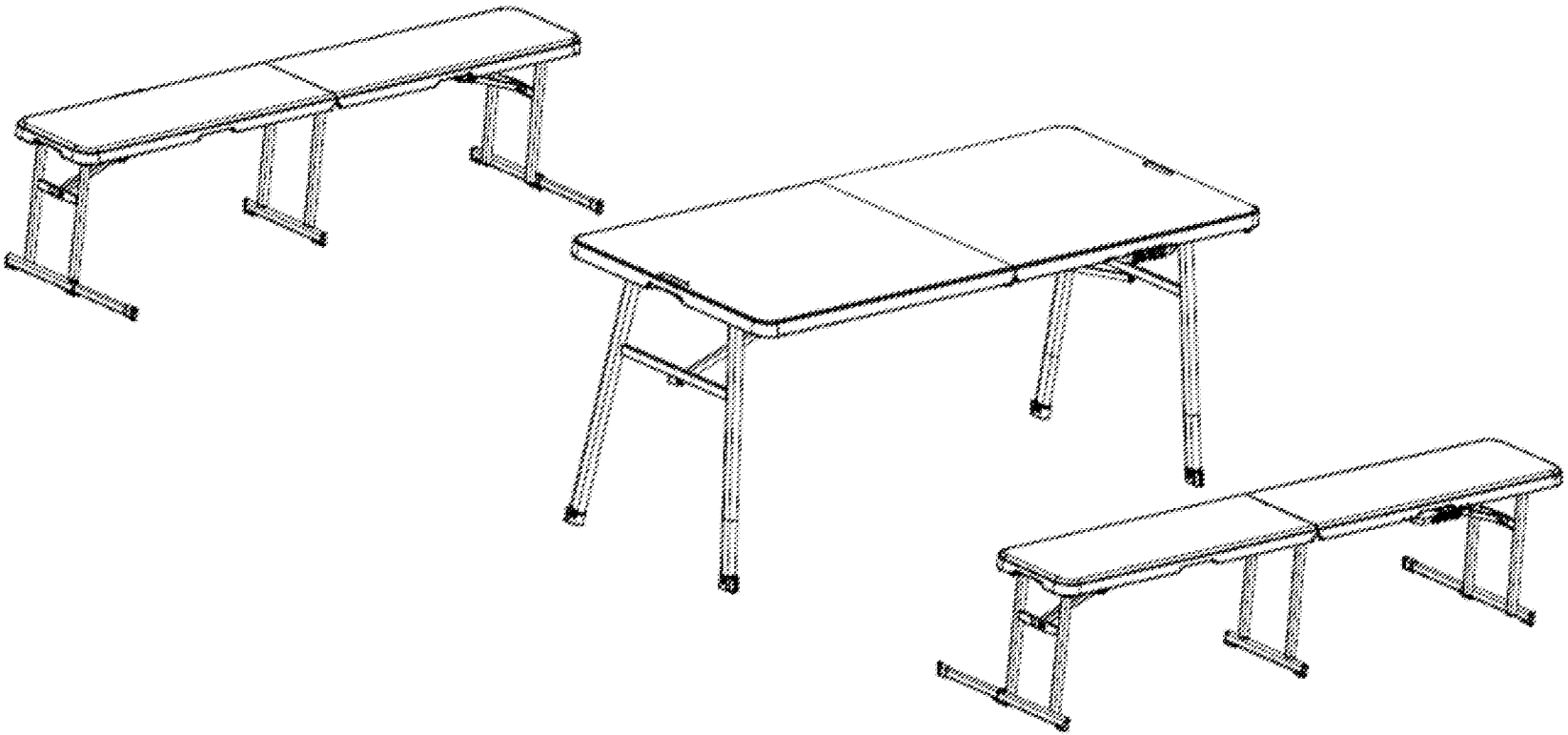
FIG. 9B is a top perspective view illustrating the exemplary picnic table of FIG. 9A in which an exemplary linking member is deployed in accordance with exemplary embodiments of the present disclosure.
Figure 9C:
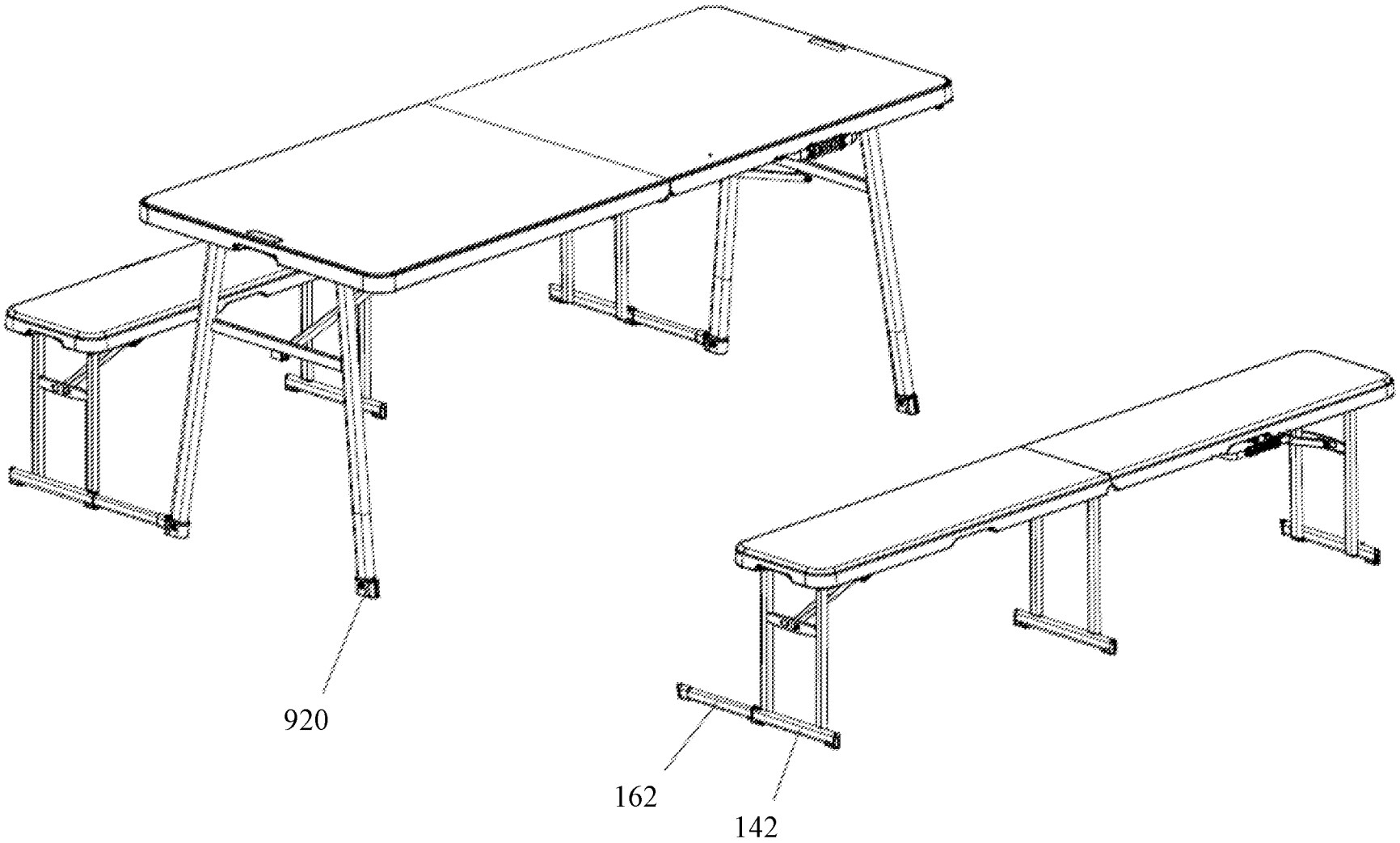
FIG. 9C is a top perspective view illustrating the exemplary picnic table of FIG. 9A in which one bench is connected to the table and another bench is separated from the table in accordance with exemplary embodiments of the present disclosure.
Figure 9D:
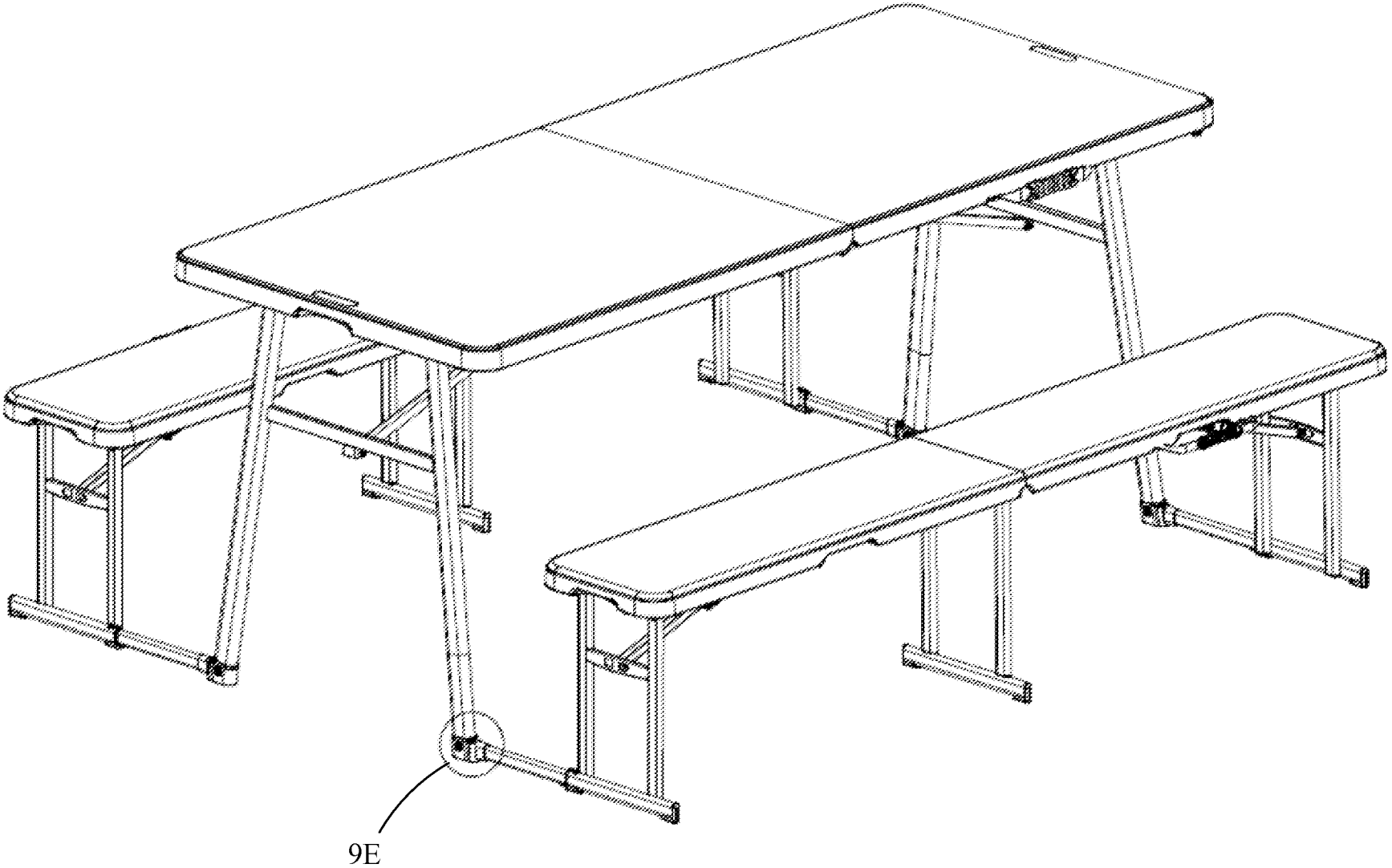
FIG. 9D is a top perspective view illustrating the exemplary picnic table of FIG. 9A in which the table and benches are connected to each other in accordance with exemplary embodiments of the present disclosure.
Figure 9E:
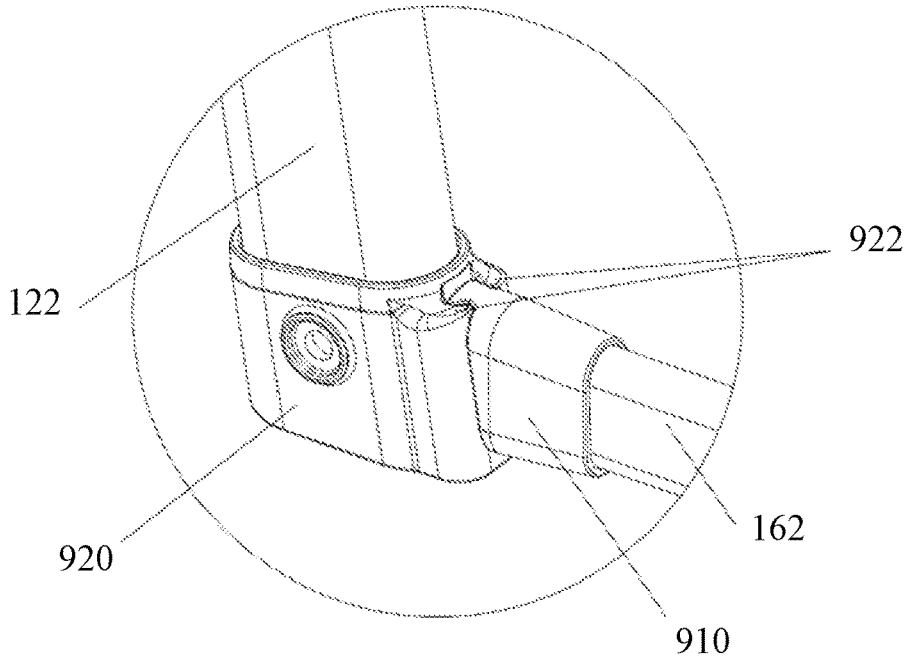
FIG. 9E is an enlarged view taken along circle 9E of FIG. 9D.
Figure 9F:
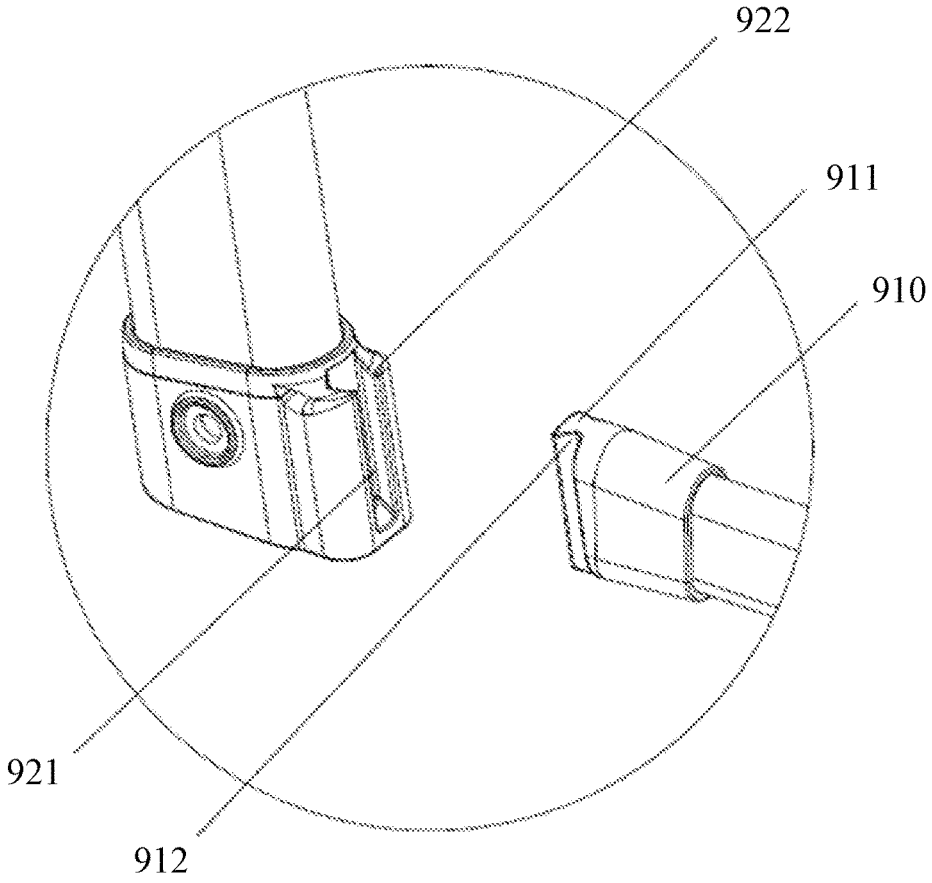
FIG. 9F is a dissembled view of FIG. 9E.
Figure 9G:
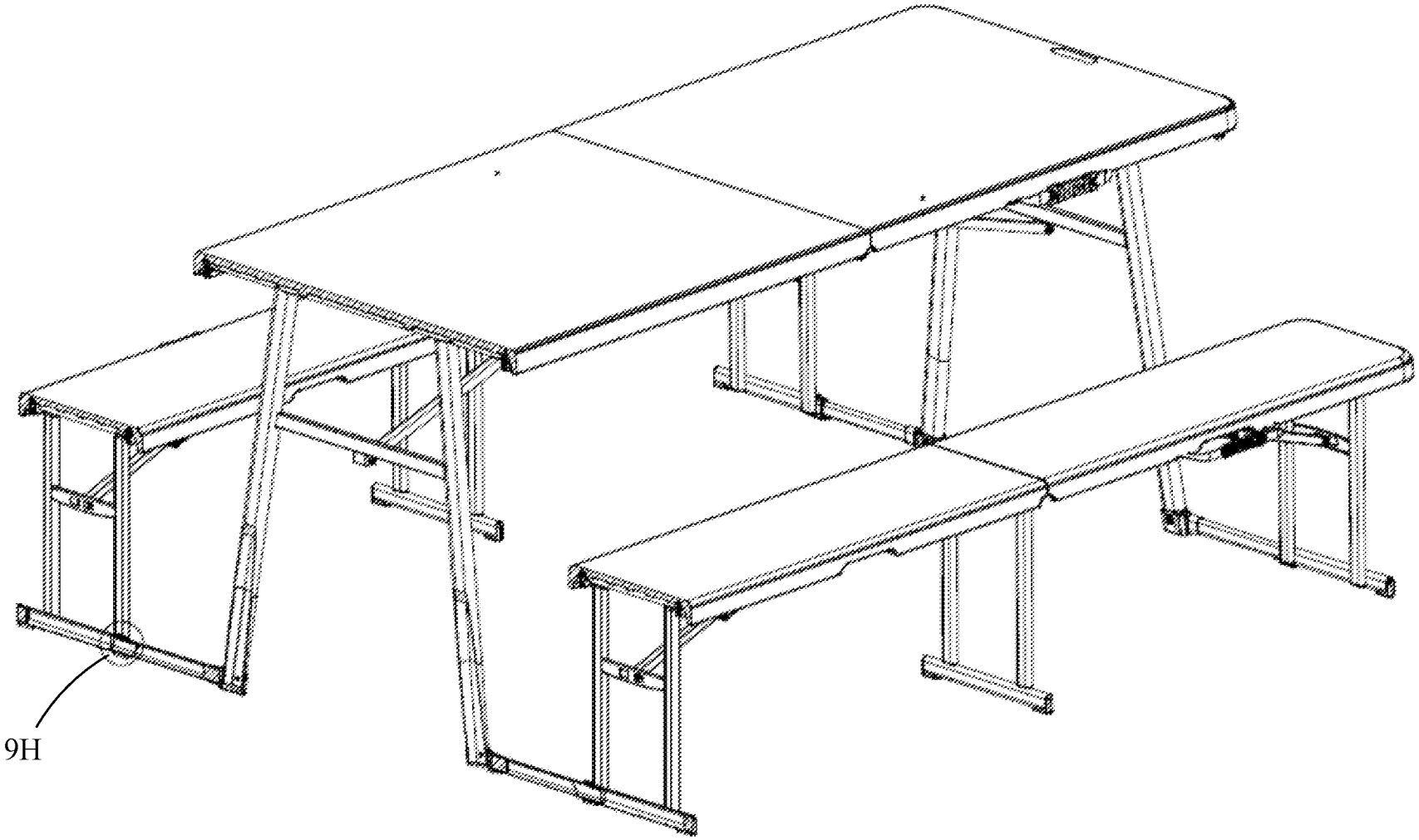
FIG. 9G is a partially cut-out view illustrating the exemplary picnic table of FIG. 9D in accordance with exemplary embodiments of the present disclosure.
Figure 9H:
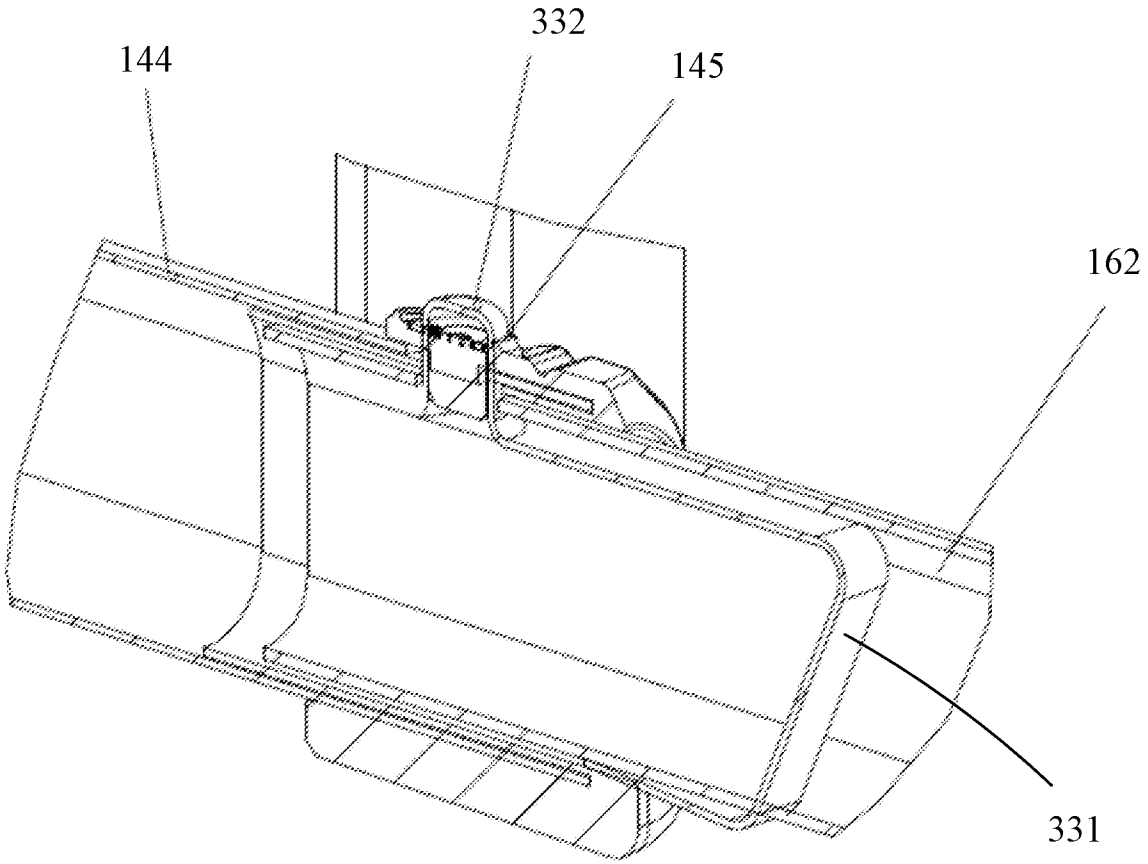
FIG. 9H is an enlarged view taken along circle 9H of FIG. 9G.

The first surface is configured to abut bench leg 142 when the linking member is unfolded with respect to the bench leg. As such, the stopper helps to align the linking member in a certain direction that facilitates connecting the second end portion of the linking member with table leg 122 of the table leg assembly. In an exemplary embodiment, when the first surface abuts the bench leg, the linking member is positioned substantially horizontally as illustrated in FIG. 7F. The second surface is configured to abut bench leg 142 when the linking member is folded with respect to the bench leg as illustrated in FIG. 7E. As such, the stopper prevents the linking member from rotating beyond the bench leg.

Referring now to FIGS. 8A-8F, there is depicted exemplary picnic table 800 in accordance with some embodiments of the present disclosure. As shown, picnic table 800 includes a table, such as table 110, and a pair of benches, such as bench 130. Picnic table 800 also includes a pair of linking assemblies, such as linking assembly 810, to detachably connect table 110 with each bench 130.

Linking assembly 810 includes a linking member, such as linking member 162 telescopically coupled with bench leg lateral bar 144 of the bench leg assembly. For instance, in some exemplary embodiments, the bench leg lateral bar or at least a portion of the bench leg lateral bar is hollow. The first end portion of the linking member is inserted into the bench leg lateral bar, and the linking member is movable along the length direction of the bench leg lateral bar.

To prevent the linking member from being completely pulled out of the bench leg lateral bar, a first restriction hole, such as restriction hole 145, is formed at a side wall of the bench leg lateral bar. The linking member or at least the first end portion of the linking member is hollow. A second restriction hole, such as restriction hole 163, is formed at a side wall of the first end portion of the linking member. An elastic piece, such as elastic piece 331, is disposed in the first end portion of the linking member. A pin, such as pin 332, is coupled with the elastic piece and positioned at or adjacent to the second restriction hole. When the first and second limitation holes are aligned with each other, the elastic piece pushes the pin to protrude out of the first and second restriction holes, thereby locking the first linking member with the bench leg lateral bar.

The second end portion of the linking member is detachably connected to table leg 122 of the table leg assembly. For instance, in some embodiments, an engaging hole, such as engaging hole 811, is formed at the second end portion of the linking member. A fastener, such as fastener 812, is disclosed at the table leg. The fastener is configured to engage, selectively or detachably, with the engaging hole of the linking member, and thus connects, selectively or detachably, the second end portion of the linking member with the table leg of the table leg assembly.

In some exemplary embodiments, a connecting piece, such as connecting piece 813, is coupled with the second end portion of the linking member and formed with the engaging hole. In some exemplary embodiments, a base, such as base 814, is disposed at the end portion of the table leg to increase slip resistance or the like. In an exemplary embodiment, the base is formed with hole or thread 815 to allow the fastener to pass through.

Referring now to FIGS. 9A-9H, there is depicted exemplary picnic table 900 in accordance with some embodiments of the present disclosure. Picnic table 900 is similar to picnic table 800, except the detachable connection of the second end portion of the linking member with the table leg of the table leg assembly. In picnic table 900, the second end portion of the linking member and the table leg of the table leg assembly are coupled with each other by two coupling pieces, one disposed at the second end portion of the linking member and one disposed at the table leg of the table leg assembly.

For instance, in some embodiments, a first coupling piece, such as coupling piece 910, is disposed at the second end portion of the linking member and a second coupling piece, such as coupling piece 920, is disposed at the table leg. The first and second coupling piece are configured to engage, selectively or detachably, with each other. For instance, in some embodiments, coupling piece 920 includes a slot, such as slot 921 and coupling piece 910 includes a rib, such as rib 911, that can be inserted into the slot. Alternatively, in some embodiments, coupling piece 910 includes a slot and coupling piece 920 includes a rib that can be inserted into the slot.

In some exemplary embodiments, one or more side walls 922 of the slot are hook-shaped, and one or more sides 912 of the rib of the first coupling piece are indented. The one or more indented sides of the rib mate with the one or more hook-shaped side walls of the slot and prevents accidental separation of the second end portion of the linking member from the table leg.

The picnic tables disclosed herein can include other additional, optional or alternative components. For instance, as a non-limiting example, a table can include two or more table panels 112. In an exemplary embodiment, a table includes two table panels, and/or can be folded in half once detached. Similarly, a bench can include two or more bench panels 132. In an exemplary embodiment, a bench includes two bench panels and once detached, and/or can be folded in half. As another non-limiting example, a table or bench can include one or more additional leg assemblies. As a further non-limiting example, a picnic table can include different numbers of tables and benches, e.g., one table with one bench, one bench with two tables, or two tables with two benches, or the like.

As used herein, the phrase "a pair of" refers to a set of two components, which can be identical to each other or different from each other. For instance, a pair of leg assemblies can refer to two leg assemblies that have the same, similar or different configurations. Each of the two leg assemblies can be any one of the leg assemblies disclosed herein, or the like. Similarly, a pair of linking assemblies can refer to two linking assemblies that have the same, similar or different configurations. Each of the two linking assemblies can be any one of the linking assemblies disclosed herein, or the like. A pair of benches can refer to two benches that have the same, similar or different configurations.

The components illustrated in the figures and disclosed herein are combinable in any useful number and combination. For instance, as a non-limiting example, a picnic table can include one linking assembly 160, and one linking assembly (e.g., linking assembly 210, linking assembly 310, linking assembly 510, etc.) that is different than linking assembly 160. As another non-limiting example, first coupler 170 can be replaced by first coupler 320, first coupler 520, first coupler 620 or the like.

The picnic tables of the present disclosure can meet the needs and preferences of various end users in various situations. For instance, with the linking assemblies disclosed herein, it is easy and convenient to connect a table with a bench, a table with a table, a bench with a bench, or the like to form an integrated picnic table when needed. It is also easy and convenient to disconnect a table from a bench, a table from a table, a bench from a bench, or the like, such that the table or bench can be used alone, folded easily, carried around separately, or stacked together for transport or storage.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A picnic table, comprising:

a first structure and a second structure, one of the first and second structures being a table and the other of the first and second structures being a bench, wherein:

the first structure comprises a first panel, and a pair of first leg assemblies coupled with the first panel at first and second sides of the first panel; and the second structure comprises a second panel, and a pair of second leg assemblies coupled with the second panel at first and second sides of the second panel; and a pair of first linking assemblies configured to detachably connect the pair of first leg assemblies with the pair of second leg assemblies, thereby selectively integrating the first and second structures into a single structure or allowing the first and second structures to be separated from each other, wherein a respective first linking assembly in the pair of first linking assemblies comprises a first linking member;

a first end portion of the first linking member is connected to a corresponding first leg assembly in the pair of first leg assemblies;

a second end portion of the first linking member is configured to be detachably connected to a corresponding second leg assembly in the pair of second leg assemblies; and the first linking member is rotatable toward the corresponding first leg assembly when the second end portion of the first linking member is disconnected from the corresponding second leg assembly.

2. The picnic table of claim 1, wherein:

each first leg assembly in the pair of first leg assemblies is foldable with respect to the first panel; and each second leg assembly in the pair of second leg assemblies is foldable with respect to the second panel.

3. The picnic table of claim 1, further comprising:

a third structure comprising a third panel, and a pair of third leg assemblies coupled with the third panel at first and second sides of the third panel; and a pair of second linking assemblies configured to detachably connect the pair of third leg assemblies with the pair of first or second leg assemblies, thereby selectively integrating the third structure into the single structure or allowing the third structure to be separated from the first or second structure.

4. The picnic table of claim 3, wherein a respective second linking assembly in the pair of second linking assemblies comprises a second linking member;

a first end portion of the second linking member is connected to the corresponding first or second leg assembly;

a second end portion of the second linking member is configured to be detachably connected to a corresponding third leg assembly in the pair of third leg assemblies; and the second linking member is retractable or rotatable towards the corresponding first or second leg assembly when the second end portion of the second linking member is disconnected from the corresponding third leg assembly.

5. The picnic table of claim 3, wherein a respective second linking assembly in the pair of second linking assemblies comprises a second linking member;

a first end portion of the second linking member is connected to a corresponding third leg assembly in the pair of third leg assemblies;

a second end portion of the second linking member is configured to be detachably connected to the corresponding first or second leg assembly; and the second linking member is retractable or rotatable towards the corresponding third leg assembly when the second end portion of the second linking member is disconnected from the corresponding first or second leg assembly.

6. The picnic table of claim 3, wherein the third structure is a bench or a table.

7. The picnic table of claim 1, wherein:

the corresponding first leg assembly comprises a first leg member;

the corresponding second leg assembly comprises a second leg member; and the respective first linking assembly comprises:

a first coupler pivotally connecting the first end portion of the first linking member with the first leg member of the corresponding first leg assembly; and a second coupler detachably connecting the second end portion of the first linking member with the second leg member of the corresponding second leg assembly.

8. The picnic table of claim 7, wherein:

at least an end portion of the second leg member is hollow to receive the second end portion of the first linking member and a first restriction hole is formed at a side wall of the end portion of the second leg member;

at least the second end portion of the first linking member is hollow with a second restriction hole formed at a side wall thereof; and the second coupler comprises an elastic piece and a pin coupled with the elastic piece, wherein the elastic piece is disposed in the second end portion of the first linking member with the pin positioned at or adjacent to the second restriction hole;

a third restriction hole is formed at the first leg member of the first leg assembly at a position corresponding to the second restriction hole;

when the first and second restriction holes are aligned with each other, the elastic piece pushes the pin to protrude out of the first and second restriction holes, thereby connecting the first linking member with the second leg assembly; and when the first linking member is disconnected from the second leg assembly and rotated to the first leg member of the first leg assembly, the third restriction hole is aligned with the second restriction hole and the elastic piece pushes the pin to protrude out of the second restriction hole and into the third restriction hole, thereby retaining the first linking member on the first leg member of the first leg assembly.

9. The picnic table of claim 7, wherein the second leg member is a lateral bar of the corresponding second leg assembly, and the second coupler comprises:

a substantially U-shaped second body fixedly connected to the second end portion of the first linking member, and configured to enclose, cross-sectional-wise, a portion of the second leg member; and a fastener coupled with the substantially U-shaped second body, and configured to be inserted into a hole formed at the second leg member, thereby selectively connecting the second end portion of the first linking member with the second leg member of the corresponding second leg assembly.

10. The picnic table of claim 7, wherein the second leg member is a leg of the corresponding second leg assembly, wherein the second coupler comprises a fastener selectively connecting the second end portion of the first linking member with the second leg member of the corresponding second leg assembly through a hole formed at the second end portion of the first linking member and a hole formed at the second leg member.

11. The picnic table of claim 7, wherein a stopper is disposed at the first end portion of the first linking member and comprises:

a first surface configured to abut the first leg member when the first linking member is unfolded with respect to the first leg member, thereby aligning the first linking member to facilitate connecting the second end portion of the first linking member with the second leg member; and a second surface configured to abut the first leg member when the first linking member is folded with respect to the first leg member, thereby preventing the first linking member from rotating beyond the first leg member.

12. The picnic table of claim 7, wherein the second coupler is fixed at the second end portion of the first linking member and comprises a mounting port to receive an end portion of the second leg member, thereby detachably coupling the second end portion of the first linking member with the corresponding second leg assembly.

13. The picnic table of claim 12, wherein the second coupler further comprises:

a pair of lugs extended beyond the mounting port and collectively forming a groove to accommodate at least a portion of the second leg member when the second end portion of the first linking member is connected to the second leg assembly and to accommodate at least a portion of the first leg member or another leg member of the first leg assembly when the second end portion of the first linking member is disconnected from the second leg assembly and the first linking member is rotated toward the first leg assembly.

14. The picnic table of claim 12, wherein a retainer is disposed at the first leg member to hold the first linking member when it rotates to the corresponding first leg assembly.

15. The picnic table of claim 12, wherein the second coupler further comprises:

a plurality of ribs formed on at least a portion of a side wall of the mounting port to enhance a strength of the mounting port; and a flange protruded outwardly along at least a portion of an upper edge of the mounting port to enhance the strength of the mounting port or to aid insertion of the end portion of the second leg member.

16. The picnic table of claim 12, wherein:

the second coupler further comprises a shoulder protruded inwardly along at least a portion of a lower edge of the mounting port; and a base is disposed at the end portion of the second leg member and formed with a step at a lower portion of the base, wherein the step resides on the shoulder of the second coupler when the end portion of the second leg member is received in the mounting port of the second coupler.

17. The picnic table of claim 16, wherein:

at least the end portion of the second leg member is hollow to receive at least a portion of the base, wherein a hole is formed at a side wall of the end portion of the second leg member; and the base comprises a body and a pin elastically formed or coupled with the body, wherein the pin is configured to selectively protrude out of the hole formed at the side wall of the end portion of the second leg member, thereby selectively affixing the base with the second leg member, wherein one or more slip-resistant elements are formed on a bottom of the base to increase friction between the base and a ground.

18. The picnic table of claim 7, wherein a through hole is formed at the second leg member; and the second coupler comprises a bolt and a nut, wherein the bolt is fixed at the second end portion of the first linking member, and configured to pass through a hole formed at the second leg member and coupled with the nut.

19. A frame assembly, comprising:

a first frame comprising:

a first mounting assembly; and a pair of first leg assemblies coupled with the first mounting assembly at first and second sides of the first mounting assembly;

a second frame comprising:

a second mounting assembly; and a pair of second leg assemblies coupled with the second mounting assembly at first and second sides of the second mounting assembly; and a pair of first linking assemblies configured to detachably connect the pair of first leg assemblies with the pair of second leg assemblies, thereby selectively integrating the first and second frames into a single frame or allowing the first and second frames to be separated from each other, wherein a respective first linking assembly in the pair of first linking assemblies comprises a first linking member;

a first end portion of the first linking member is connected to a corresponding first leg assembly in the pair of first leg assemblies;

a second end portion of the first linking member is configured to be detachably connected to a corresponding second leg assembly in the pair of second leg assemblies; and the first linking member is rotatable towards the corresponding first leg assembly when the second end portion of the first linking member is disconnected from the corresponding second leg assembly, wherein the first mounting assembly is configured to couple with one of a table panel and a bench panel and the second mounting assembly is configured to couple with the other of the table panel and the bench panel.

20. The frame assembly of claim 19, further comprising:

a third frame comprising:

a third mounting assembly; and a pair of third leg assemblies coupled with the third mounting assembly at first and second sides of the third mounting assembly; and a pair of second linking assemblies configured to detachably connect the pair of third leg assemblies with the pair of first or second leg assemblies, thereby selectively integrating the third frame into the single frame or allowing the third frame to be separated from the first or second frame.

* * * * *